US012480067B2

(12) United States Patent
Wilson et al.

(10) Patent No.: US 12,480,067 B2
(45) Date of Patent: Nov. 25, 2025

(54) LUBRICATING OIL COMPOSITIONS

(71) Applicant: Infineum International Limited, Abingdon (GB)

(72) Inventors: Linda Wilson, Abingdon (GB); Abigail Perry, Abingdon (GB); Robert Stallwood, Abingdon (GB); James Lee Head, Abingdon (GB); Barry Corber, Abingdon (GB); Gregory Killian, Abingdon (GB); Viral Bobby Patel, Abingdon (GB); Stuart Alexander Taylor, Abingdon (GB); Chloe Allen, Abingdon (GB); Allyson Ruth Doyle, Abingdon (GB)

(73) Assignee: Infineum International Limited, Milton Hill (GB)

( * ) Notice: Subject to any disclaimer, the term of this patent is extended or adjusted under 35 U.S.C. 154(b) by 0 days.

(21) Appl. No.: 18/475,160

(22) Filed: Sep. 26, 2023

(65) Prior Publication Data

US 2024/0141250 A1 May 2, 2024

(51) Int. Cl.
*C10M 143/02* (2006.01)
*C10M 125/22* (2006.01)
(Continued)

(52) U.S. Cl.
CPC ..... *C10M 143/02* (2013.01); *C10M 125/22* (2013.01); *C10M 129/10* (2013.01);
(Continued)

(58) Field of Classification Search
CPC ..... C10M 143/02; C10M 125/22; C10M 129/10; C10M 129/52; C10M 129/54;
(Continued)

(56) References Cited

U.S. PATENT DOCUMENTS

2004/0038836 A1* 2/2004 Devlin ..... C10M 161/00 508/378
2005/0124509 A1* 6/2005 Gutierrez ..... C10M 169/044 508/291

(Continued)

FOREIGN PATENT DOCUMENTS

EP 0 280 580 A2 8/1988
EP 3 473 694 A1 4/2019
WO WO 2022/066721 3/2022

OTHER PUBLICATIONS

European Patent Office Extended Search Report Application No. 22202145.3, Mar. 17, 2023, EPO Form 1507N.

(Continued)

*Primary Examiner* — Ellen M Mcavoy
(74) *Attorney, Agent, or Firm* — Robert A. Migliorini; Catherine L. Bell

(57) ABSTRACT

This invention relates to a lubricating oil composition comprising or resulting from the admixing of: a) 50 to 99 mass % of one or more base oils; b) 0.1 to 15 mass % of one or more functionalized olefin copolymer having an Mn of from 10,000 to 35,000 g/mol; c) 0.1 to 20 mass % of one or more detergents wherein the detergent comprises at least one calcium detergent having a TBN of more than 100 mg KOH/g; at least one calcium detergent having a TBN of 100 mg KOH/g or less; and at least one magnesium detergent, where the difference in the TBN's for the Ca detergents is at least 100 mg KOH/g; d) 0.01 to 40 mass % of one or more dispersants wherein the dispersants comprise at least one borated dispersant and at least one non borated dispersant; e) 0.01 to 20 of mass % sulfurized fatty acid ester; f) 0.01 to 5 mass % of one or more amine or phenol based antioxidants; and g) 0.001 to 15 mass % of molybdenum containing compound, where the lubricating oil composition has: 1) a sulfated ash content of 0.9 mass % or less; 2) a Mack T-11

(Continued)

graph of selected data from Example 2.

Solid line is oil A-8, Dashed line is oil B-8.

final soot %@15 cSt of 6.7% or more; 3) a total base number of 5 to 30 mg KOH/g; 4) HTCBT of copper level increase of 20 ppm or less; 5) T-13 IR peak EOT of 40 abs/cm or less; and 6) Cam wear outlet of 45 μm or less.

21 Claims, 3 Drawing Sheets

(51) Int. Cl.

| | |
|---|---|
| ***C10M 129/10*** | (2006.01) |
| ***C10M 129/52*** | (2006.01) |
| ***C10M 129/54*** | (2006.01) |
| ***C10M 143/04*** | (2006.01) |
| ***C10M 169/04*** | (2006.01) |
| *C10N 10/04* | (2006.01) |
| *C10N 10/06* | (2006.01) |
| *C10N 10/12* | (2006.01) |
| *C10N 20/04* | (2006.01) |
| *C10N 30/00* | (2006.01) |
| *C10N 30/02* | (2006.01) |
| *C10N 30/04* | (2006.01) |
| *C10N 30/06* | (2006.01) |
| *C10N 30/10* | (2006.01) |
| *C10N 30/12* | (2006.01) |
| *C10N 30/18* | (2006.01) |
| *C10N 40/25* | (2006.01) |

(52) U.S. Cl.
CPC ..... *C10M 129/52* (2013.01); *C10M 129/54* (2013.01); *C10M 143/04* (2013.01); *C10M 169/04* (2013.01); *C10M 2201/084* (2013.01); *C10M 2205/022* (2013.01); *C10M 2205/024* (2013.01); *C10M 2207/023* (2013.01); *C10M 2207/262* (2013.01); *C10N 2010/04* (2013.01); *C10N 2010/06* (2013.01); *C10N 2010/12* (2013.01); *C10N 2020/04* (2013.01); *C10N 2030/02* (2013.01); *C10N 2030/04* (2013.01); *C10N 2030/06* (2013.01); *C10N 2030/10* (2013.01); *C10N 2030/12* (2013.01); *C10N 2030/18* (2013.01); *C10N 2030/45* (2020.05); *C10N 2030/52* (2020.05); *C10N 2040/252* (2020.05)

(58) Field of Classification Search
CPC ..... C10M 143/04; C10M 169/04; C10M 2201/084; C10M 2205/022; C10M 2205/024; C10M 2207/023; C10M 2207/262; C10N 2010/04; C10N 2020/04; C10N 2030/02; C10N 2030/04; C10N 2030/06; C10N 2030/10; C10N 2030/12; C10N 2030/18; C10N 2030/45; C10N 2030/52; C10N 2040/252
See application file for complete search history.

(56) References Cited

U.S. PATENT DOCUMENTS

| | | | | |
|---|---|---|---|---|
| 2006/0116299 | A1* | 6/2006 | Arrowsmith | C10M 163/00 508/518 |
| 2006/0116300 | A1* | 6/2006 | Arrowsmith | C10M 167/00 508/518 |
| 2008/0110799 | A1 | 5/2008 | Matsui | |
| 2009/0011963 | A1* | 1/2009 | Anderson | C10M 167/00 508/342 |
| 2009/0325831 | A1* | 12/2009 | Mathur | C08L 51/06 508/307 |
| 2011/0245120 | A1 | 10/2011 | Bertram et al. | |
| 2013/0172220 | A1* | 7/2013 | Ruhe, Jr. | C10M 147/00 508/238 |
| 2016/0264908 | A1* | 9/2016 | Jones | C10M 135/18 |
| 2018/0016515 | A1* | 1/2018 | Lagona | C10M 161/00 |
| 2019/0119602 | A1* | 4/2019 | Ransom | C10M 169/048 |
| 2021/0147760 | A1* | 5/2021 | Vincent | C10M 135/10 |

OTHER PUBLICATIONS

European Patent Office Extended Search Report Application No. 23204112.9, Nov. 9, 2023, EPO Form 1507W.

* cited by examiner

Figure 1

| Constituent/Blend | B-3 | B-4 | B-5 | B-6 | B-7 | B-8 | A-2 | A-3 | A-4 | A-5 | A-6 | A-7 |
|---|---|---|---|---|---|---|---|---|---|---|---|---|
| B- PIBSA-PAM-950 | 0.801 | 0.801 | 1.000 | 1.000 | 1.000 | 1.000 | 0.968 | 0.968 | 0.966 | 0.905 | 0.905 | 0.968 |
| PIBSA-PAM 1000 Mn | 2.401 | 2.430 | 2.700 | 2.851 | 2.727 | 2.851 | 2.899 | 2.899 | 2.898 | 2.712 | 2.712 | 2.899 |
| PIBSA-PAM 2200 Mn | 7.999 | 7.999 | 8.004 | 8.004 | 8.004 | 8.004 | 5.797 | 5.797 | 5.796 | 5.424 | 5.424 | 5.797 |
| Amine Funct EP Copol | -- | -- | -- | -- | -- | -- | 1.382 | 1.382 | 1.381 | 1.293 | 1.293 | 1.382 |
| Ca Salicylate-350 TBN | 1.050 | 1.050 | 1.050 | 1.050 | 1.050 | 1.050 | 0.483 | 0.483 | 0.483 | 0.452 | 0.452 | 0.483 |
| Mg sulfonate-400 TBN | 1.000 | 1.000 | 0.920 | 1.000 | 0.920 | 1.000 | 0.968 | 0.968 | 0.966 | 0.905 | 0.905 | 0.968 |
| Ca salicylate -64 TBN | -- | -- | -- | -- | -- | -- | 1.642 | 1.642 | 1.642 | 1.537 | 1.537 | 1.642 |
| ZDDP | 1.000 | 1.000 | 1.000 | 1.000 | 1.000 | 1.000 | 0.919 | 0.919 | 0.918 | 0.860 | 0.860 | 0.919 |
| Mo Friction modifier | 0.089 | 0.089 | 0.090 | 0.090 | 0.090 | 0.090 | 0.117 | 0.117 | 0.100 | 0.110 | 0.110 | 0.117 |
| DPA Antioxidant | 1.000 | 1.000 | 1.430 | 1.430 | 1.430 | 1.430 | 2.329 | 2.319 | 2.000 | 2.170 | 2.170 | 2.329 |
| Phenol antioxidant | 1.000 | 1.000 | 2.600 | 2.600 | 2.600 | 2.600 | -- | -- | -- | -- | -- | -- |
| Sulfurize FAME | -- | -- | -- | -- | -- | -- | 0.774 | 0.774 | 0.773 | 0.724 | 0.724 | 0.774 |
| LAO | -- | -- | -- | -- | -- | -- | 0.580 | 0.580 | 0.580 | 0.542 | 0.542 | 0.580 |
| PIBSA | 0.600 | 0.600 | 0.600 | 0.600 | 0.600 | 0.600 | 0.194 | 0.194 | 0.194 | 0.181 | 0.181 | 0.194 |
| Anti-foamant | 0.002 | 0.002 | 0.002 | 0.002 | 0.002 | 0.002 | 0.002 | 0.002 | 0.002 | 0.002 | 0.002 | 0.002 |
| PIB- 950 Mn | 1.500 | 1.500 | 1.500 | 1.300 | 1.480 | 1.500 | -- | -- | -- | -- | -- | -- |
| diluent | 2.307 | 2.278 | 2.302 | 2.302 | 2.302 | 1.172 | 1.147 | 1.157 | 1.201 | 1.083 | 1.083 | 1.147 |
| LOFI | -- | -- | -- | -- | -- | -- | 0.200 | 0.200 | 0.200 | 0.200 | 0.200 | 0.200 |
| H-SIB block copol VM | 9.100 | 9.100 | 5.300 | 11.900 | 11.900 | 11.200 | -- | -- | -- | -- | -- | -- |
| Star H-SD block copol VM | -- | -- | -- | -- | -- | -- | 11.400 | 3.900 | 11.400 | -- | 12.000 | 11.400 |
| Purity™ VHVI 4 | 57.150 | 57.150 | -- | -- | -- | -- | -- | -- | -- | -- | -- | -- |
| Purity™ VHVI 8 | 13.000 | 13.000 | -- | -- | -- | -- | -- | -- | -- | -- | -- | -- |
| Priolube™ 3970 | -- | -- | 5.000 | 5.000 | 5.000 | -- | -- | -- | -- | -- | -- | -- |
| Yubase 4 | -- | -- | -- | -- | -- | -- | 49.100 | 53.000 | 47.900 | 67.100 | 46.200 | 47.700 |
| Yubase 4+ | -- | -- | 58.502 | 52.100 | 52.395 | 56.100 | -- | -- | -- | -- | -- | -- |
| Yubase 6 | -- | -- | 8.000 | 7.771 | 7.500 | 10.400 | 19.100 | 22.700 | 20.600 | 13.800 | 22.700 | 20.500 |
| Package (wt%) | 20.750 | 20.750 | 23.198 | 23.229 | 23.205 | 22.300 | 20.200 | 20.200 | 19.900 | 18.900 | 18.900 | 20.200 |
| KV100 (cSt) | 11.55 | 11.60 | 9.73 | 12.27 | 12.14 | 12.12 | 12.01 | 9.65 | 12.19 | 7.74 | 12.01 | 11.96 |
| HTHS150 (cP) | 3.52 | 3.48 | 3.03 | 3.49 | 3.51 | 3.50 | 3.56 | 3.03 | 3.68 | 2.55 | 3.57 | 3.50 |

Figure 2

| Test/Blend | | B-3 | B-4 | B-5 | B-6 | B-7 | B-8 | A-2 | A-3 | A-4 | A-5 | A-6 | A-7 |
|---|---|---|---|---|---|---|---|---|---|---|---|---|---|
| OM 646LA | Cam wear outlet (μm) | | | 48.9 | | | | | | | 19.4 | | |
| Mack T-11 | Final soot % @ 12 cSt | 6.09 | | | | | | 7.13 | | | | | |
| Mack T-11 | Final soot % @ 15 cSt | 6.71 | | | | | | 7.48 | | | | | |
| Mack T-11 | Final soot % @ 4 cSt | 4.7 | | | | | | 5.11 | | | | | |
| OM 501LA | Bore polishing (%) | | | | | 0 | | | | 0 | | | |
| OM 501LA | Engine sludge, avg. (Merit) | | | | | 9.8 | | | | 9.8 | | | |
| OM 501LA | Oil consumption (g/hr) | | | | | 5.432 | | | | 4.508 | | | |
| OM 501LA | Piston cleanliness (Merit) | | | | | 30.3 | | | | 28.1 | | | |
| Mack T-12 | Avg. Liner Wear (μm) | | 10.1 | | | | | | 14.5 | | | | |
| Mack T-12 | Avg. Top Ring Wt Loss (mg) | | 64 | | | | | | 76 | | | | |
| Mack T-12 | Delta Pb 250-300 hr (ppm) | | 13 | | | | | | 10 | | | | |
| Mack T-12 | End of test lead (ppm) | | 25 | | | | | | 31 | | | | |
| Mack T-12 | Mack merits (T-10) | | 1548.2 | | | | | | 1402.3 | | | | |
| Mack T-12 | Oil consumption (g/h) | | 57.4 | | | | | | 61.4 | | | | |
| OM 646LA Biodiesel | Engine sludge, avg (Merits) | | | | 9.6 | | | | | | | 9.7 | |
| OM 646LA Biodiesel | Piston cleanliness (avg. 4 pistons) (Merits) | | | | 29.3 | | | | | | | 28.9 | |
| OM 646LA Biodiesel | Ring Sticking (ASF value) | | | | N | | | | | | | N | |
| OM 646LA Biodiesel | RL255 Piston Cleanliness (Merits) | | | | 13.9 | | | | | | | 12.3 | |

Figure 3: graph of selected data from Example 2.
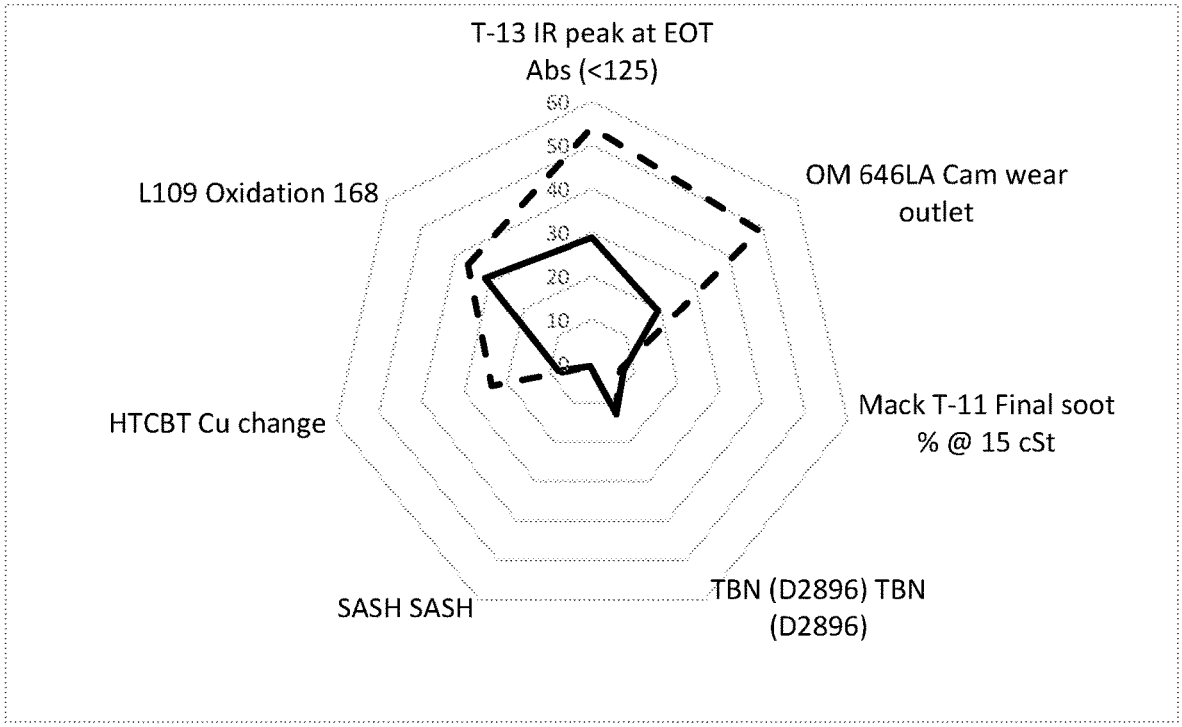
Solid line is oil A-8, Dashed line is oil B-8.

LUBRICATING OIL COMPOSITIONS

STATEMENT OF RELATED APPLICATIONS

This application claims priority to and the benefit of Application EP 22202145.3 filed in the European Patent Office on Oct. 18, 2022.

FIELD OF THE INVENTION

This invention relates to the use additives in lubricant compositions providing good oxidation, wear and anti-corrosion properties, especially for spark or compression ignited engine applications.

BACKGROUND

The present invention relates to internal combustion engine lubricating oil compositions, which exhibit improved oxidation, wear and anti-corrosion characteristics. More specifically, the present invention relates to automotive crankcase lubricating oil compositions for use in gasoline (spark-ignited) and diesel (compression-ignited) internal combustion engines, such compositions being referred to as crankcase lubricants; and to the use of additives in such lubricating oil compositions for reducing corrosion and wear in use of such engines while improving the anti-oxidation performance of an engine lubricated with the lubricating oil composition.

US 2011/245120 discloses lubricating oil compositions having a phosphorus content of up to 0.12 wt %, a sulfated ash content of up to 1.2 wt % comprising: (a) a major amount of an oil of lubricating viscosity; b) an alkali metal or alkaline earth metal alkyl salicylate lubricating oil detergent providing from 7-15 mmol salicylate soap per kilogram of lubricating oil composition; (c) one or more ashless, nitrogen-containing dispersants providing the lubricating oil composition with from at least 0.12 wt % to 0.20 wt % atomic nitrogen, based on the weight of the lubricating oil composition, and (d) a dispersant-viscosity modifier.

EP 3 473 694 A1 discloses lubricating oil compositions which comprise or is made by admixing: (A) an oil of lubricating viscosity, in a major amount; (B) one or more oil-soluble or oil-dispersible sulfur containing anti-oxidant(s), as an additive in an effective minor amount providing the lubricating oil composition with greater than or equal to 0.01 mass % sulfur; and, (C) one or more oil-soluble or oil-dispersible alkene(s) having greater than or equal to 10 carbon atoms, as an additive in an effective minor amount.

WO2022/066721 discloses diesel engine lubricating compositions comprising: an oil of lubricating viscosity having greater than 50 weight percent of a Group III base oil, a Group IV base oil; a Group V base oil, or mixtures thereof; a first PIB succinimide dispersant derived from an 1800 to 2500 Mn PIB; a second PIB succinimide dispersant derived from a PM with an Mn less than 1600, where at least one of the first PIB succinimide dispersant and the second P1B succinimide dispersant is boron-free; an alkaline earth metal salicylate detergent; an alkaline earth metal sulfonate detergent present in an amount to deliver 0.1 wt % to 1.2 wt % of alkaline earth metal soap to the lubricating composition; and a phosphorus anti wear agent present in an amount to deliver 300 to 900 ppm phosphorous to the lubricating composition, the lubricating composition having a total sulfated ash of between 0.3 to 1.1 wt. %; a kinematic viscosity at 100° C. of less than 8.3 cSt; a total alkaline earth metal soap of from 0.6 wt % to 2.1 wt %, and a measured according to ASTM D4683 of less than 2.7 mPa·s.

EP 0 280 580 A2 discloses lubricants having antiwear, corrosion inhibition and antioxidant performance appropriate to modern [1987] oil requirements with reduced or zero amounts of phosphorous and without the need for large amounts and/or expensive forms of antioxidant comprise 5 to 500 parts per million by weight (ppm) of added copper present in oil-soluble form, one or more added oil-soluble sulphur-containing compounds and a bearing corrosion inhibitor.

Other references of interest include US 2008/110799.

It has now surprisingly been found that the described combinations comprising amine functionalized olefin copolymer dispersant, alkaline earth metal salicylate and/or sulfonate detergents in combination with molybdenum containing compounds, antioxidants and sulfurized fatty acid esters can be used in a lubricant composition, such as in internal combustion engines, to provide excellent viscosity, oxidation, wear and anti-corrosion properties, especially while maintaining sulfated ash, total base number, and soot properties for spark or compression ignited engine applications.

SUMMARY OF THE INVENTION

This invention relates to a lubricating oil composition comprising or resulting from the admixing of, based upon the weight of the lubricating composition:

a) 50 to 99 mass % of one or more base oils, such as a Group II and or Group III and or Group IV base oil;
b) 0.1 to 15 mass % of one or more functionalized olefin copolymer having an Mn of from 10,000 to about 35,000 g/mol
c) 0.1 to 20 mass % of one or more detergents wherein the detergent comprises at least one calcium detergent having a TBN of more than 100 mg KOH/g; at least one calcium detergent having a TBN of 100 mg KOH/g or less; and at least one magnesium detergent, where the difference in the TBN's for the Ca detergent having a TBN of 100 mg KOH/g or less and Ca detergent having a TBN of more than 100 mg KOH/g is at least 100 mg KOH/g;
d) 0.01 to 40 mass % of one or more dispersants wherein the dispersants comprise at least one borated dispersant and at least one non borated dispersant;
e) 0.01 to 20 mass % of sulfurized fatty acid ester;
f) 0.01 to 10 mass % of molybdenum containing compound; and
g) 0.01 to 10 mass % of amine or phenol (such as amine) based antioxidant;

based upon the weight of the lubricating composition, where the lubricating oil composition preferably has:

1) a sulfated ash (ASTM D874) content of 0.9 mass % or less;
2) a Mack T-11 final soot %@15 cSt (ASTM D7156-19) of 6.7% or more;
3) a total base number (TBN, ASTM D2896) of 5 to 30 mg KOH/g
4) HTCBT (ASTM D6594) of copper level increase of 20 ppm or less;
5) T-13 IR peak at end of test (ASTM D 8048) of 40 absorbance per cm or less; and
6) Cam wear outlet (CEC OM646LA (CEC L-99-08)) of 45 μm or less.

The lubricating oil composition may have a $KV_{100}$ (ASTM D445-19a) of 16.5 cSt or less, such as 6.9 to 16.3 cSt, such as 9.3 to less than 12.5 cSt.

BRIEF DESCRIPTION OF THE DRAWINGS

FIG. 1 is a table of blends from Example 1.

FIG. 2 is a table of selected characterization data for the blends in FIG. 1.

FIG. 3 is a graph of selected data from Example 2.

DEFINITIONS

For purposes of this specification and all claims to this invention, the following words and expressions, if and when used, have the meanings ascribed below.

For purposes herein, the new numbering scheme for the Periodic Table of the Elements is used as set out in CHEMICAL AND ENGINEERING NEWS, 63(5), 27 (1985), i.e., alkali metals are Group 1 metals (e.g. Li, Na, K, etc.) and alkaline earth metals are Group 2 metals (e.g., Mg, Ca, Ba, etc.)

The term "LOC" means lubricating oil composition.

The term "major amount" means more than 50 mass % of a composition, such as more than 60 mass % of a composition, such as more than 70 mass % of a composition, such as from 80 to 99.009 mass % of a composition, such as from 80 to 99.9 from 80 to 99.009 mass % of a composition, of a composition based upon the mass of the composition.

The term "minor amount" means 50 mass % or less of a composition; such as 40 mass % or less of a composition; such as 30 mass % or less of a composition, such as from 20 to 0.001 mass %, such as from 20 to 0.1 mass %, based upon the mass of the composition.

The term "mass %" means mass percent of a component, based upon the mass of the composition as measured in grams, unless otherwise indicated, and is alternately referred to as weight percent ("weight %", "mass %" or "% w/w").

The term "active ingredient" (also referred to as "a.i." or "A.I."). refers to additive material that is neither diluent nor solvent.

The terms "oil-soluble" and "oil-dispersible," or cognate terms, used herein do not necessarily indicate that the compounds or additives are soluble, dissolvable, miscible, or are capable of being suspended in the oil in all proportions. These do mean, however, that they are, for example, soluble or stably dispersible in oil to an extent sufficient to exert their intended effect in the environment in which the oil is employed. Moreover, the additional incorporation of other additives may also permit incorporation of higher levels of a particular additive, if desired.

The terms "group" and "radical" are used interchangeably herein.

The term "hydrocarbon" means a compound of hydrogen and carbon atoms. A "heteroatom" is an atom other than carbon or hydrogen. When referred to as "hydrocarbons," particularly as "refined hydrocarbons," the hydrocarbons may also contain one or more heteroatoms or heteroatom containing groups (such as halo, especially chloro and fluoro, amino, alkoxyl, mercapto, alkylmercapto, nitro, nitroso, sulfoxy, etc.) in minor amounts (e.g., where the heteroatom(s) do not substantially alter the hydrocarbon properties of the hydrocarbon compound).

The term "hydrocarbyl" means a radical that contains hydrogen and carbon atoms. Preferably, the group consists essentially of, more preferably consists only of, hydrogen and carbon atoms, unless specified otherwise. Preferably, the hydrocarbyl group comprises an aliphatic hydrocarbyl group. The term "hydrocarbyl" includes "alkyl," "alkenyl," "alkynyl," and "aryl" as defined herein. Hydrocarbyl groups may contain one or more atoms/groups other than carbon and hydrogen provided they do not affect the essentially hydrocarbyl nature of the hydrocarbyl group. Those skilled in the art will be aware of such atoms/groups (e.g., halo, especially chloro and fluoro, amino, alkoxyl, mercapto, alkylmercapto, nitro, nitroso, sulfoxy, etc.).

The term "alkyl" means a radical of carbon and hydrogen (such as a $C_1$ to $C_{30}$, such as a $C_1$ to $C_{12}$ group). Alkyl groups in a compound are typically bonded to the compound directly via a carbon atom. Unless otherwise specified, alkyl groups may be linear (i.e. unbranched) or branched, be cyclic, acyclic or part cyclic/acyclic. Preferably, the alkyl group comprises a linear or branched acyclic alkyl group. Representative examples of alkyl groups include, but are not limited to, methyl, ethyl, n-propyl, iso-propyl, n-butyl, sec-butyl, iso-butyl, tert-butyl, n-pentyl, iso-pentyl, neo-pentyl, hexyl, heptyl, octyl, dimethyl hexyl, nonyl, decyl, undecyl, dodecyl, tridecyl, tetradecyl, pentadecyl, hexadecyl, heptadecyl, octadecyl, nonadecyl, icosyl and triacontyl.

The term "alkenyl" means a radical of carbon and hydrogen (such as a $C_2$ to $C_{30}$ radical, such as a $C_2$ to $C_{12}$ radical) having at least one double bond. Alkenyl groups in a compound are typically bonded to the compound directly via a carbon atom. Unless otherwise specified, alkenyl groups may be linear (i.e. unbranched) or branched, be cyclic, acyclic or part cyclic/acyclic.

The term "alkylene" means a $C_1$ to $C_{20}$, preferably a $C_1$ to $C_{10}$, bivalent saturated aliphatic radical which may be linear or branched. Representative examples of alkylene include methylene, ethylene, propylene, butylene, pentylene, hexylene, heptylene, octylene, nonylene, decylene, 1-methyl ethylene, 1-ethyl ethylene, 1-ethyl-2-methyl ethylene, 1,1-dimethyl ethylene and 1-ethyl propylene.

An "olefin," alternatively referred to as "alkene," is a linear, branched, or cyclic compound of carbon and hydrogen having at least one double bond. For purposes of this specification and the claims appended thereto, when a polymer or copolymer is referred to as comprising an olefin, the olefin present in such polymer or copolymer is the polymerized form of the olefin. For example, when a copolymer is said to have an "ethylene" content of 35 mass % to 55 mass %, it is understood that the mer unit in the copolymer is derived from ethylene in the polymerization reaction and said derived units are present at 35 mass % to 55 mass %, based upon the weight of the copolymer. A "polymer" has two or more of the same or different mer units. A "homopolymer" is a polymer having mer units that are the same. A "copolymer" is a polymer having two or more mer units that are different from each other. A "terpolymer" is a polymer having three mer units that are different from each other. Accordingly, the definition of copolymer, as used herein, includes terpolymers and the like. "Different" as used to refer to mer units indicates that the mer units differ from each other by at least one atom or are different isomerically. An "ethylene polymer" or "ethylene copolymer" is a polymer or copolymer comprising at least 50 mole % ethylene derived units, a "propylene polymer" or "propylene copolymer" is a polymer or copolymer comprising at least 50 mole % propylene derived units, and so on.

The term "alkynyl" means a $C_2$ to $C_{50}$ (such as a $C_2$ to $C_{12}$) radical which includes at least one carbon to carbon triple bond.

The term "aryl" means a group containing at least one aromatic ring, such a cyclopentadiene, phenyl, naphthyl, anthracenyl, and the like. Aryl groups are typically $C_5$ to $C_{40}$ (such as $C_5$ to $C_{18}$, such as $C_6$ to $C_{14}$) aryl groups, optionally substituted by one or more hydrocarbyl groups, heteroatoms, or heteroatom containing groups (such as halo, hydroxyl, alkoxy and amino groups). Preferred aryl groups include phenyl and naphthyl groups and substituted derivatives thereof, especially phenyl, and alkyl substituted derivatives of phenyl.

The term "substituted" means that a hydrogen atom has been replaced with hydrocarbon group, a heteroatom or a heteroatom containing group. An alkyl substituted derivative means a hydrogen atom has been replaced with an alkyl group.

An "alkyl substituted phenyl" is a phenyl group where a hydrogen atom has been replaced by an alkyl group, such as a $C_1$ to $C_{20}$ alkyl group, such as methyl, ethyl, n-propyl, iso-propyl, n-butyl, sec-butyl, iso-butyl, tert-butyl, n-pentyl, iso-pentyl, neo-pentyl, hexyl, heptyl, octyl, dimethyl hexyl, nonyl, decyl, undecyl, dodecyl, tridecyl, tetradecyl, pentadecyl, hexadecyl, heptadecyl, octadecyl, nonadecyl, icosyl and/or triacontyl.

The term "halogen" or "halo" means a group 17 atom or a radical of group 17 atom, such as fluoro, chloro, bromo and iodo.

The term "ashless" in relation to an additive means the additive does not include a metal.

The term "ash-containing" in relation to an additive means the additive includes a metal.

The term "effective amount" in respect of an additive means an amount of such an additive in a lubricating oil composition so that the additive provides the desired technical effect.

The term "effective minor amount" in respect of an additive means an amount of such an additive of less than 50 mass % of the lubricating oil composition so that the additive provides the desired technical effect.

The term "ppm" means parts per million by mass, based on the total mass of the lubricating oil composition, unless otherwise indicated.

The term "metal content" of a lubricating oil composition or of an additive component, for example magnesium content, molybdenum content or total metal content (i.e. the sum of all individual metal contents), is measured by ASTM D5185.

The term "Total Base Number" also referred to as "TBN" in relation to an additive component or of a lubricating oil composition (i.e. unused lubricating oil composition) means total base number as measured by ASTM D2896.

The term "Total Acid Number" also referred to as "TAN" means total acid number as measured by ASTM D664.

Phosphorus, Boron, Calcium, Zinc, Molybdenum, and Magnesium content are measured by ASTM 5185.

"Sulfur content" is measured by ASTM D2622.

"Sulfated ash content" is measured by ASTM D874.

The term "aliphatic hydrocarbyl fatty acid" (also referred to as "fatty acid") means a monocarboxylic acid having an aliphatic $C_7$ to $C_{29}$, preferably a $C_9$ to $C_{27}$, most preferably a $C_{11}$ to $C_{23}$ hydrocarbyl chain. Such compounds may be referred to herein as aliphatic ($C_7$ to $C_{29}$), more preferably ($C_9$ to $C_{27}$), most preferably ($C_{11}$ to $C_{23}$), hydrocarbyl monocarboxylic acid(s) or hydrocarbyl fatty acid(s) (wherein $C_x$ to $C_y$ designates the total number of carbon atoms in the aliphatic hydrocarbyl chain of the fatty acid, the fatty acid itself due to the presence of the carboxyl carbon atom includes a total of $C_{x+1}$ to $C_{y+1}$ carbon atoms). Preferably, the aliphatic hydrocarbyl fatty acid, inclusive of the carboxyl carbon atom, has an even number of carbon atoms.

The aliphatic hydrocarbyl chain of the fatty acid may be saturated or unsaturated (i.e. includes at least one carbon to carbon double bond); preferably, the aliphatic hydrocarbyl chain is unsaturated and includes at least one carbon to carbon double bond—such fatty acids may be obtained from natural sources (e.g. derived from animal or vegetable oils) and/or by reduction of the corresponding saturated fatty acid. It will be appreciated that a proportion of the aliphatic hydrocarbyl chain(s) of the corresponding aliphatic hydrocarbyl fatty acid ester(s) is unsaturated (i.e. includes at least one carbon to carbon double bond) to permit reaction with other agents, such as sulfur, to form the corresponding functionalized, such as sulfurized, aliphatic hydrocarbyl fatty acid ester(s).

The term "aliphatic hydrocarbyl fatty acid ester" (also referred to as "fatty acid ester") means an ester obtainable by converting the monocarboxylic acid functional group of the corresponding aliphatic hydrocarbyl fatty acid into an ester group. Suitably, the monocarboxylic acid functional group of the aliphatic hydrocarbyl fatty acid is converted to a hydrocarbyl ester, preferably a $C_1$ to $C_{30}$ aliphatic hydrocarbyl ester, such as an alkyl ester, preferably a $C_1$ to $C_6$ alkyl ester, especially a methyl ester. Alternatively, or additionally, the monocarboxylic acid functional group of the aliphatic hydrocarbyl fatty acid may be in the form of the natural glycerol ester.

Accordingly, the term "aliphatic hydrocarbyl fatty acid ester" embraces aliphatic hydrocarbyl fatty acid glycerol ester(s) and aliphatic hydrocarbyl fatty acid $C_1$ to $C_{30}$ aliphatic hydrocarbyl ester(s), (e.g. aliphatic hydrocarbyl fatty acid alkyl ester(s), more preferably aliphatic hydrocarbyl fatty acid $C_1$ to $C_6$ alkyl ester(s), especially aliphatic hydrocarbyl fatty acid methyl ester(s), also referred to as "fatty acid methyl ester(s)"). Suitably, the term "aliphatic hydrocarbyl fatty acid ester" embraces aliphatic ($C_7$ to $C_{29}$) hydrocarbyl, more preferably aliphatic ($C_9$ to $C_{27}$) hydrocarbyl, most preferably aliphatic ($C_{11}$ to $C_{23}$) hydrocarbyl fatty acid glycerol ester(s) and aliphatic ($C_7$ to $C_{29}$) hydrocarbyl, more preferably aliphatic ($C_9$ to $C_{27}$) hydrocarbyl, most preferably aliphatic ($C_{11}$ to $C_{23}$) hydrocarbyl fatty acid $C_1$ to $C_{30}$ aliphatic hydrocarbyl ester(s). Suitably, to permit functionalization, such as sulfurization, of the aliphatic hydrocarbyl fatty acid ester(s) a proportion of the aliphatic hydrocarbyl chain(s) of the fatty acid ester(s) is unsaturated and includes at least one carbon to carbon double bond.

The term "sulfurized aliphatic hydrocarbyl fatty acid ester" (also referred to as "sulfurized fatty acid") means a compound obtained by sulfurizing an aliphatic hydrocarbyl fatty acid ester as defined herein, and includes "sulfurized aliphatic hydrocarbyl fatty acid methyl esters" (also referred to as "sulfurized fatty acid methyl esters").

The term "absent" as it relates to components included within the lubricating oil compositions described herein and the claims thereto means that the particular component is present at 0 mass %, based upon the weight of the lubricating oil composition, or if present in the lubricating oil composition the component is present at levels that do not impact the lubricating oil composition properties, such as less than 10 ppm, or less than 1 ppm or less than 0.001 ppm.

Kinematic viscosity ($KV_{100}$, $KV_{40}$) is determined pursuant to ASTM D445-19a reported in units of cSt, unless otherwise specified.

Viscosity index is measured according to ASTM D2270.

As used herein, Mn is number average molecular weight, Mw is weight average molecular weight, and Mz is z average molecular weight. Molecular weight distribution (MWD), also referred to as polydispersity index (PDI), is defined to be Mw divided by Mn. Unless otherwise noted, all molecular weight units (e.g., Mw, Mn, Mz) are reported in g/mol.

Unless otherwise indicated, all percentages reported are mass % on an active ingredient basis, i.e. without regard to carrier or diluent oil, unless otherwise stated.

Also, it will be understood that various components used, essential as well as optimal and customary, may react under conditions of formulation, storage or use and that the invention also provides the product obtainable or obtained as a result of any such reaction.

Further, it is understood that any upper and lower quantity, range and ratio limits set forth herein may be independently combined.

Also, it will be understood that the preferred features of each aspect of the present invention are regarded as preferred features of every other aspect of the present invention. Accordingly, preferred and more preferred features of one aspect of the present invention may be independently combined with other preferred and/or more preferred features of the same aspect or different aspects of the present invention.

DETAILED DESCRIPTION

The features of the invention relating, where appropriate, to each and all aspects of the invention, will now be described in more detail as follows.

The lubricating oil compositions of the invention comprise components that may or may not remain the same chemically before and after mixing with an oleaginous carrier (such as a base oil) and/or other additives. This invention encompasses compositions which comprise the components before mixing, or after mixing, or both before and after mixing.

Further, it is understood that any upper and lower quantity, range and ratio limits set forth herein may be independently combined.

Lubricating Oil Compositions

This invention relates to lubricating oil compositions (also referred to as "lubricant compositions," "lubricating compositions," "lubricant oil compositions," or "LOC's) comprising or resulting from the admixing of:

a) from 50 to 99 mass % (alternately 30 to 95 mass %, alternately 50 to 90 mass %, alternately 60 to 95 mass %, alternately 70 to 85 mass %), based on total weight of the lubricating composition, of one or more base oils;

b) from 0.1 to 15 mass % (in particular 0.20 to 12 mass %, alternately 0.25 to 8 mass % alternately 0.3 to 2 mass %), based on total weight of the lubricating composition, of one or more functionalized olefin copolymer having an Mn of from 10,000 to about 35,000 g/mol;

c) from 0.10 to 20 mass % (in particular 0.15 to 10 mass %, alternately 0.20 mass % to 5 mass %, alternately 0.25 to 2 mass %), based upon the weight of the composition, of one or more detergents based on total weight of the lubricating composition, wherein the detergent comprises at least one calcium detergent having a TBN of more than 100 mg KOH/g; at least one calcium detergent having a TBN of 100 mg KOH/g or less; and at least on magnesium detergent, where the difference in the TBN's for the Ca detergent having a TBN of 100 mg KOH/g or less and Ca detergent having a TBN of more than 100 mg KOH/g is at least 100 mg KOH/g;

d) from 0.01 to 20 mass % (in particular 0.1 to 15 mass %, alternately 1 to 12 mass %, alternately 2 to 10 mass %), based on total weight of the lubricating composition, of one or more dispersants wherein the dispersants comprise at least one borated dispersant and at least one non borated dispersant (not including component b));

e) 0.01 to 20 mass % (alternately from 0.1 to 5 mass %, in particular 0.2 to 4 mass %, alternately 0.3 to 3 mass %, alternately 0.4 to 2 mass %, alternately 0.4 to 1 mass %), based on total weight of the lubricating composition, sulfurized fatty acid ester;

f) 0.01 to 10 mass % (alternately from 0.025 to 5 mass %, in particular 0.05 to 4 mass %, alternately 0.05 to 3 mass %, alternately 0.05 to 1 mass %) molybdenum containing compound; and g) 0.01 to 10 mass % (alternately from 0.5 to 5 mass %, in particular 1 to 4 mass %, alternately 1.5 to 3 mass %) amine and or phenol (preferably amine) based antioxidant, where the lubricating oil composition preferably has:

1) a sulfated ash (ASTM D874) content of 0.9 mass % or less (such as 0.85 mass % or less, such as 0.8 mass % or less, such as 0.6 mass % or less, such as 0.01 to 0.5 mass %); 2) a Mack T-11 final soot %@15 cSt (ASTM D7156-19) of 10% or more (such as 6.7% or more, such as 7% or more, such as 7.3% or more, such as 7.4% or more, such as 7.45% or more);

3) a total base number (TBN, ASTM D2896) of 5 to 30 mg KOH/g (such as 10 to 20 mg KOH/g);

4) an HTCBT (ASTM D6594) of copper level increase of 20 ppm or less (such as 15 ppm or less, such as 10 ppm or less, such as 8 ppm or less);

5) a T-13 infrared spectroscopy (IR) peak at end of test (ASTM D 8048) of 40 absorbance per cm or less (such as 35 abs/cm or less, such as 30 abs/cm or less);

6) a Cam wear outlet (CEC OM646LA (CEC L-99-08)) of 45 μm or less (such as 40 μm or less, such as 45 μm or less, such as 35 μm or less, such as 30 μm or less, such as 25 μm or less, such as 23 μm or less, such as 21 μm or less, such as 20 μm or less), and 7) optionally, a $KV_{100}$ (ASTM D445-19a) of 16.5 cSt or less (such as 3.5 to 16.5 cSt, such as 6.5 to 16.5 cSt, such as 9.3 to less than 12.5 cSt.

This invention also relates to lubricating oil compositions comprising or resulting from the admixing of:

A) from 50 to 99 mass % (alternately 50 to 95 mass %, alternately 50 to 90 mass %, alternately 60 to 95 mass %, alternately 70 to 85 mass %), based on total weight of the lubricating composition, of one or more base oils; and B) from 0.1 to 15 mass % (in particular 0.20 to 12 mass %, alternately 0.25 to 8 mass % alternately 0.3 to 2 mass %), based on total weight of the lubricating composition, of one or more functionalized olefin copolymer having an Mn of from 10,000 to about 35,000 g/mol, and C) from 0.10 to 20 mass % (in particular 0.15 to 10 mass %, alternately 0.20 mass % to 5 mass %, alternately 0.25 to 2 mass %), based upon the weight of the composition, of one or more detergents based on total weight of the lubricating composition, of one or more detergents wherein the detergent comprises at least one calcium detergent having a TBN of more than 100 mg KOH/g; at least one calcium detergent having a TBN of 100 mg KOH/g or less; and at least on magnesium detergent, where the difference in the TBN's for the Ca detergent having a TBN of 100 mg KOH/g or less and Ca detergent having a TBN over 100 is at least 100 mg KOH/g; and I) from 0.01 to 20 mass % (in particular 0.1 to 15 mass %, alternately 1 to 12 mass %, alternately 2 to 10 mass %), based on total weight of the lubricating composition, of one or more dispersants wherein the dispersants comprise at least one borated dispersant and at least one non borated dispersant (not including component B); and D-1) 0.01 to 20 mass % (alternately from 0.1 to 5 mass %, in particular 0.2 to 4 mass %, alternately 0.3 to 3 mass %, alternately 0.4 to 2 mass %, alternately 0.4 to 1 mass %), based on total weight of the lubricating composition, sulfurized fatty acid ester, D-3) 0.01 to 10 mass % (alternately from 0.025 to 5 mass %, in particular 0.05 to 4 mass %, alternately 0.05 to 3 mass %, alternately 0.05 to 1 mass %) molybdenum containing compound; and D-2) optionally, from 0.01 to 5 mass % (in particular 0.1 to 4 mass %, alternately 0.25 to 3 mass %), based on total weight of the lubricating composition, of one or more friction modifiers other than the sulfurized fatty acid ester of D-1 and Mo containing compound of D-3, (such as blends of friction modifiers);

E) from 0.01 to 10 mass % (alternately from 0.5 to 5 mass %, in particular 1 to 4 mass %, alternately 1.5 to 3 mass %), based on total weight of the lubricating composition, of antioxidant comprising one or more amine and or phenol based antioxidants (such as blends of antioxidants);

F) optionally, from 0.01 to 5 mass % (in particular 0.01 to 3 mass %, alternately 0.1 to 1.5 mass %), based on total weight of the lubricating composition, of one or more pour point depressants (such as blends of pour point depressants);

G) optionally, from 0.001 to 5 mass % (in particular 0.01 to 3 mass %, alternately 0.1 to 1.5 mass %), based on total weight of the lubricating composition, of one or more anti-foam agents (such as blends of anti-foam agents);

H) optionally, from 0.001 to 10 mass % (in particular 0.01 to 6 mass %, alternately 0.01 to 5 mass %, alternately 0.1 to 4 mass %, alternately 0.1 to 2 mass %, alternately 0.1 to 1 mass %), based on total weight of the lubricating composition, of one or more viscosity modifiers (such as blends of viscosity modifiers);

J) optionally, from 0.01 to 5 mass % (in particular 0.1 to 3 mass %, alternately 0.1 to 1.5 mass %), based on total weight of the lubricating composition, of one or more inhibitors and/or antirust agents (such as blends of inhibitors and/or antirust agents); and/or K) optionally, from 0.001 to 10 mass % (in particular 0.1 to 5 mass %, alternately 0.15 to 3 mass %, alternately 0.15 to 1.5 mass %), based on total weight of the lubricating composition, of one or more anti-wear agents (such as blends of anti-wear agents), O) optionally, from 0.001 to 15 mass %, (in particular 0.15 to 10 mass %, alternately 0.20 mass % to 5 mass %, alternately 0.25 to 2 mass %) based upon the weight of the lubricating composition, of one or more $C_8$ to $C_{36}$ alpha olefins, where the lubricating oil composition preferably has:

1) a sulfated ash (ASTM D874) content of 0.9 mass % or less (such as 0.85 mass % or less, such as 0.8 mass % or less, such as 0.6 mass % or less, such as 0.01 to 0.5 mass %);
2) a Mack T-11 final soot %@15 cSt (ASTM D7156-19) of 10% or more(such as 6.7% or more, such as 7% or more, such as 7.3% or more, such as 7.4% or more, such as 7.45% or more);
3) a total base number (TBN, ASTM D2896) of 5 to 30 mg KOH/g (such as 10 to 20 mg KOH/g);
4) HTCBT (ASTM D6594) of copper level increase of 20 ppm or less (such as 15 ppm or less, such as 10 ppm or less, such as 8 ppm or less);
5) T-13 IR peak at end of test (ASTM D 8048) of 40 absorbance per cm or less (such as 35 abs/cm or less, such as 30 abs/cm or less);
6) Cam wear outlet (CEC OM646LA (CEC L-99-08)) of 45 μm or less (such as 40 μm or less, such as 45 μm or less, such as 35 μm or less, such as 30 μm or less, such as 25 μm or less, such as 23 μm or less, such as 21 μm or less, such as 20 μm or less), and
7) optionally, a $KV_{100}$ (ASTM D445-19a) of 16.5 cSt or less (such as 3.5 to 16.5 cSt, such as 6.5 to 16.5 cSt, such as 9.3 to less than 12.5 cSt.

For purposes of this invention and the claims thereto, component B (functionalized olefin copolymer having an Mn of from 10,000 to about 35,000 g/mol) is not added in the elements C, D, E, F G, H, J, O, D-3, and/or K above for determining weight percentages, even though they may show similar properties, e.g., element B (functionalized olefin copolymer having an Mn of from 10,000 to about 35,000 g/mol) may impact dispersant function positively, but is not added into element I for determining weight percent of dispersant. Likewise, for purposes of this invention and the claims thereto, component D-1 (sulfurized fatty acid ester) is not added in the elements C, D-2, E, F G, H, J, and/or K above for determining weight percentages, even though they may show similar properties, e.g., element D-1 may impact friction modification positively, but is not added into element D-2 for determining weight percent of friction modifier.

Likewise, for purposes of this invention and the claims thereto, component D-3 (molybdenum containing compound) is not added in the elements C, D-2, E, F G, H, J, and/or K above for determining weight percentages, even though they may show similar properties, e.g., element D-3 may impact friction modification positively, but is not added into element D-2 for determining weight percent of friction modifier.

In embodiments, all of elements F, G, H, J, O, and K are present in addition to the elements A, B, C, I, D-3, D-2, E, and D-1 described above.

Suitably, the lubricating oil composition may have an L109 Oxidation 168 hr (CEC-L-109-14 Oxidation Test for Engine Oils Operating in the Presence of Biodiesel Fuel) of 35 absorbance per cm or less, such as 34 abs/cm or less, such as 33 abs/cm or less, such as 32 abs/cm or less.

Suitably, the lubricant composition may have an a high temperature high shear viscosity at 150° C. ("HTHS") of 1.7 cP or more, such as 2.3 cP or more, such as 2.6 cP or more, such as 2.6 or more, such as 2.9 cP or more, such as 3.5 cP or more, such as 3.7 or more, as measured by ASTM D4683.

The lubricating compositions of the present invention may contain low levels of phosphorus, namely not greater than 1600, preferably not greater than 1200, more preferably not greater than 800, more preferably not greater than 700, such as 1 to 1600, such as 5 to 1200, such as 10 to 800 parts per million (ppm) of phosphorus, based on the total mass of the lubricating compositions, as measured by ASTM D5185.

Typically, the lubricating compositions may contain low levels of sulfur. Preferably, the lubricating composition contains up to 0.4 (such as less than 0.4), more preferably up to 0.3 (such as less than 0.3), most preferably up to 0.2 (such as less than 0.2), such as 0.1 to 0.4 (such as 0.01 to less than 0.4, such as 0.1 to less than 0.3, such as 0.15 to less than 0.2) mass % sulfur, expressed as atoms of sulfur, based on the total mass of the lubricating composition, as measured by ASTM D2622.

Optionally, the lubricating oil compositions and concentrates described herein are absent added components containing copper, such as: 1) copper compounds described in EP-A-24146 that are substantially free of phosphorus, 2) the oil-soluble copper salt of a synthetic or natural carboxylic acid, 3) oil-soluble copper dithiocarbamates of the general formula (RR'NCSS)nCu, where n is 1 or 2 and R and R' are the same or different hydrocarbyl radicals containing 1 to 18, preferably 2 to 12 carbon atoms such as alkyl, alkenyl, aryl, aralkyl, alkaryl and cycloalkyl radicals, 4) copper and sulphur containing compounds such as copper mercaptides, disulphides and thioxanthates, 5) copper sulphonates, phenates, and acetylacetonates.

Optionally, the lubricating oil compositions and concentrates described herein are absent added components containing copper, such as: added dihydrocarbyl dithiophosphate metal salt where the metal is copper.

Optionally the lubricating oil compositions and concentrates described herein are absent added components containing copper as described in EP 0 280 580 A2 at page 3, line 30-47, including EP-A-241146 as referenced therein.

Optionally, the lubricating oil compositions and concentrates described herein do not comprise 5 to 500 parts per million by weight (ppm) of added copper present in oil-soluble form. (The term "added copper" is intended to exclude copper present in the oil as a result of accumulation of copper in the oil during use, e.g. by wear or corrosion of copper-containing components.)

Generally, the kinematic viscosity at 100° C. ("$KV_{100}$") of the lubricating composition ranges from 2 to 30 cSt, such as 5 to 20 cSt, such as 6 to 17 cSt as determined according to ASTM D 445-19a). Alternately, the lubricating oil composition a $KV_{100}$ of 6.1 to less than 16.3 cSt, such as 6.9 to less than 16.3 cSt, such as 9.3 to less than 16.3 cSt, such as 9.3 to less than 12.5 cSt. Alternately, the lubricating oil composition a $KV_{100}$ of 6.9 to less than 9.3 cSt.

Suitably, the lubricant composition may have a total base number (TBN) of 1 to 30 mg KOH/g, such as 5 to 15 mg KOH/g, such as 4 to 15 mg KOH/g, preferably 5 to 14 mg KOH/g, such as 7 to 14 mg KOH/g, as determined by ASTM D2896. Alternately, the lubricant composition may have a total base number of 7 mg KOH/g or more, such as 7 to 15 mg KOH/g, such as 7 to 12 mg KOH/g (as determined by ASTM D2896).

In embodiments, the lubricating oil composition comprises a Group III base stock, such as more than 50 mass % Group III basestock, such as more than 60%, such as more than 70 mass % Group III basestock, based upon the weight of the lubrication oil composition.

In embodiments, the lubricating oil composition comprises a Group III+base stock, such as more than 20 mass % Group III+basestock, such as more than 40%, such as more than 60 mass % Group III+basestock, such as more than 70 mass % Group III+basestock, based upon the weight of the lubrication oil composition.

In embodiments, the lubricating oil composition comprises a Group II base stock, such as more than 50 mass % Group II basestock, such as more than 60%, such as more than 70 mass % Group II basestock, based upon the weight of the lubrication oil composition.

In embodiments, the lubricating oil composition comprises a Group IV base stock, such as more than 10 mass % Group IV basestock, such as more than 30%, such as more than 30 mass % Group IV basestock, based upon the weight of the lubrication oil composition.

In embodiments, the lubricating oil composition comprises Group III base stock having a VI of less than 130, such as more than 50 mass % Group III basestock having a VI of less than 130, such as more than 60%, such as more than 70 mass % Group III basestock having a VI of less than 130, based upon the weight of the lubrication oil composition, and the lubricating oil composition has a $KV_{100}$ of 12.5 cSt or less, such as 11.5 cSt or less, such as 10.5 cSt or less, such as 9.5 cSt or less.

Alternately, Group III+ and Group IV base stocks are absent from the LOC.

Alternately, Group IV base stock is absent from the LOC.

Alternately, Group II base stock is absent from the LOC.

Alternately, Group IIII base stock is absent from the LOC.

In embodiments, the lubricating oil compositions described herein are absent added additives comprising copper.

Concentrates

A concentrate, also referred to as an additive package or addpack, is a composition typically having less than 50 mass % (such as less than 40%, such as less than 30 mass %, such as less than 25%, such as less than 20%) base oil) which is typically then further blended with further base oil to form a lubricating oil product.

This invention relates to concentrate compositions comprising or resulting from the admixing of:

(i) from 1 to less than 50 mass % (alternately 5 to 45 mass %, alternately 7 to 40 mass %, alternately 10 to 35 mass %, alternately 10 to 25 mass %), based upon the weight of the composition, of one or more base oil(s);

(ii) from 0.10 to 20 mass % (in particular 0.15 to 15 mass %, alternately 0.20 mass % to 10 mass %), based upon the weight of the composition, of one or more detergent(s), wherein the detergent comprises at least one calcium detergent having a TBN of more than 100 mg KOH/g; at least one calcium detergent having a TBN of 100 mg KOH/g or less; and at least on magnesium detergent, where the difference in the TBN's for the Ca detergent having a TBN of 100 mg KOH/g or less and Ca detergent having a TBN over 100 mg KOH/g is at least 100 mg KOH/g;

(iii) from 0.10 to 40 mass % (in particular 0.10 to 20 mass %, alternately 0.15 to 10 mass %, alternately 0.20 mass % to 5 mass %), based upon the weight of the composition, of one or more dispersant(s) (such as PIBSA-PAM), wherein the dispersants comprise at least one borated dispersant and at least one non borated dispersant (not including component v); and (iv) from 0.10 to 20 mass % (in particular 0.15 to 10 mass %, alternately 0.20 mass % to 5 mass %), sulfurized fatty acid ester;

(v) 0.1 to 15 mass % (in particular 0.15 to 10 mass %, alternately 0.20 mass % to 5 mass %, alternately 0.25 to 4 mass %, alternately 0.25 to 3 mass %), based upon the weight of the composition, of one or more functionalized olefin copolymer having an Mn of from 10,000 to about 35,000 g/mol;

vi) 0.01 to 15 mass % (alternately from 0.05 to 10 mass %, in particular 0.1 to 5 mass %, alternately 0.15 to 3 mass %, alternately 0.15 to 2 mass %) molybdenum containing compound;

vii) 0.01 to 25 mass % (alternately from 0.5 to 20 mass %, in particular 1 to 15 mass %,) amine or phenol based antioxidant; and (viii) optional additional components, such as friction modifiers (other than the sulfurized fatty acid ester friction modifier), anti-oxidants, pour point depressants, anti-foam agents, viscosity modifiers, corrosion inhibitors, anti-wear agents, extreme pressure additives, demulsifiers, seal compatibility agents, additive diluent base oils, $C_8$ to $C_{36}$ alpha olefins, etc.

In embodiments, the concentrate described herein, comprises one or more alpha-olefins, such as linear alpha-olefins (LAO), having 8 to 36 carbon atoms, such as 8 to 24 carbon atoms, more preferably 10 to 20 carbon atoms, more preferably 12 to 20 carbon atoms, more preferably 14 to 18 carbon atoms. In embodiments, the concentrate described herein, comprises mixtures of linear alpha-olefins, having 8 to 24 carbon atoms, more preferably 10 to 20 carbon atoms, more preferably 12 to 20 carbon atoms, more preferably 14 to 18 carbon atoms. In embodiments, the concentrate described herein, comprises mixtures of linear alpha-olefins, having 14 or more carbon atoms. In embodiments, the concentrate described herein, may comprise from 0.001 to 25 mass % (such as 0.001 to 20 mass %, such as 0.001 to 15 mass %, in particular 0.15 to 10 mass %, alternately 0.20 mass % to 5 mass %, alternately 0.25 to 3.5 mass %, alternately 0.25 to 2 mass %) based upon the weight of the concentrate composition, of one or more $C_8$ to $C_{36}$ alpha olefins. In embodiments, the concentrate described herein, may comprise from 0.001 to 15 mass %, (in particular 0.15 to 10 mass %, alternately 0.20 mass % to 5 mass %, alternately 0.25 to 2 mass %,) based upon the weight of the concentrate composition, of one, two, three, four, five or more $C_8$ to $C_{36}$ alpha olefins, such linear alpha olefins having 8 to 24 carbon atoms, more preferably 10 to 20 carbon atoms, more preferably 12 to 20 carbon atoms, more preferably 14 to 18 carbon atoms.

In embodiments, a concentrate, such as the concentrates described herein, comprises one or more alpha-olefins, such as linear alpha-olefins (LAO), having 8 to 36 carbon atoms, such as 8 to 24 carbon atoms, more preferably 10 to 20 carbon atoms, more preferably 12 to 20 carbon atoms, more preferably 14 to 18 carbon atoms. In embodiments, a concentrate, such as the concentrates described herein, comprises mixtures of linear alpha-olefins, having 8 to 24 carbon atoms, more preferably 10 to 20 carbon atoms, more preferably 12 to 20 carbon atoms, more preferably 14 to 18 carbon atoms. In embodiments, a concentrate, such as the concentrates described herein, comprises mixtures of linear alpha-olefins, having 14 or more carbon atoms. In embodiments, the concentrate may comprise from 0.001 to 25 mass % (such as 0.001 to 20 mass %, such as 0.001 to 15 mass %, in particular 0.15 to 10 mass %, alternately 0.20 mass % to 5 mass %, alternately 0.25 to 3.5 mass %, alternately 0.25 to 2 mass %) based upon the weight of the concentrate composition, of one or more $C_8$ to $C_{36}$ alpha olefins. In embodiments, a concentrate, such as the concentrates described herein, from 0.001 to 15 mass %, (in particular 0.15 to 10 mass %, alternately 0.20 mass % to 5 mass %, alternately 0.25 to 2 mass %,) based upon the weight of the concentrate composition, of one, two, three, four, five or more $C_8$ to $C_{36}$ alpha olefins, such linear alpha olefins having 8 to 24 carbon atoms, more preferably 10 to 20 carbon atoms, more preferably 12 to 20 carbon atoms, more preferably 14 to 18 carbon atoms.

Concentrates may be present in the lubricating oil composition at from of 0.5 mass % to 35 mass %, such as 5 mass % to 30 mass %, such as 7.5 mass % to 25 mass %, such as 10 to 22.5 mass %, such as 15 to 20 mass %, based upon the mass of the lubricating oil composition.

In embodiments, the concentrates described herein are absent added additives comprising copper.

A. Base Oil

The base oil (also referred to as "base stock," lubricating oil basestock, or "oil of lubricating viscosity") useful herein may be a single oil or a blend of oils, and is typically a large liquid constituent of a lubricating composition, also referred to as a lubricant, into which additives and optional additional oils are blended, for example, to produce a lubricating composition, such as a final lubricant composition, a concentrate, or other lubricating composition.

A base oil may be selected from vegetable, animal, mineral, and synthetic lubricating oils, and mixtures thereof. It may range in viscosity from light distillate mineral oils to heavy lubricating oils such as gas engine oil, mineral lubricating oil, motor vehicle oil, light duty diesel oil, and heavy duty diesel oil. Generally, the kinematic viscosity at 100° C. ("$KV_{100}$") of the base oil ranges from 1 to 30, such as 2 to 25 cSt, such as 5 to 20 cSt, as determined according to ASTM D 445-19a, in particular from 1.0 cSt to 10 cSt, from 1.5 cSt to 3.3 cSt, from 2.7 cSt to 8.1 cSt, from 3.0 cSt to 7.2 cSt, or from 2.5 cSt to 6.5 cSt. Optionally, the high temperature high shear (HTHS) viscosity at 150° C. of the base oil ranges from 0.5 to 20 cP, such as 1 to 10 cP, such as 2 to 5 cP as determined according to ASTM D4683-20).

Typically, when lubricating oil basestock(s) is used to make a concentrate, it may advantageously be present in a concentrate-forming amount to give a concentrate containing, from 5 mass % to 80 mass %, from 10 mass % to 70 mass %, or from 5 mass % to 50 mass % of active ingredient, based upon the weight of the concentrate.

Common oils useful as base oils include animal and vegetable oils (e.g. castor and lard oil), liquid petroleum oils, and hydrorefined and/or solvent-treated mineral lubricating oils of the paraffinic, naphthenic and mixed paraffinic-naphthenic types. Oils derived from coal or shale are also useful base oils. Base stocks may be manufactured using a variety of different processes including, but not limited to, distillation, solvent refining, hydrogen processing, oligomerization, esterification, and re-refining.

Synthetic lubricating oils useful herein as base oils include hydrocarbon oils such as homopolymerized and copolymerized olefins, referred to as polyalphaolefins or PAO's or group IV base oils (according to the API EOLCS 1509 definition (American Petroleum Institute Publication 1509, see section E.1.3, 19$^{th}$ edition, January 2021, www.API.org)). Examples of PAO's useful as base oils include: poly(ethylene), copolymers of ethylene and propylene, polybutylenes, polypropylenes, propylene-isobutylene copolymers, chlorinated polybutylenes, poly(1-hexenes), poly(1-octenes), poly(1-decenes), homo- or co-polymers of $C_8$ to $C_{20}$ alkenes, homo- or co-polymers of $C_8$, and/or $C_{10}$, and/or Cu alkenes, $C_8/C_{10}$ copolymers, $C_8/C_{10}$/Cu copolymers, and $C_{10}/C_{12}$ copolymers, and the derivatives, analogues and homologues thereof.

In another embodiment, the base oil comprises polyalphaolefins comprising oligomers of linear olefins having 6 to 14 carbon atoms, more preferably 8 to 12 carbon atoms, more preferably 10 carbon atoms having a Kinematic viscosity at 100° C. of 10 or more (as measured by ASTM D 445); and preferably having a viscosity index ("VI"), as determined by ASTM D-2270, of 100 or more, preferably 110 or more, more preferably 120 or more, more preferably 130 or more, more preferably 140 or more; and/or having a pour point of −5° C. or less (as determined by ASTM D 97), more preferably −10° C. or less, more preferably −20 or less.

In another embodiment polyalphaolefin oligomers useful in the present invention comprise $C_{20}$ to $C_{1500}$ paraffins, preferably $C_{40}$ to $C_{1000}$ paraffins, preferably $C_{50}$ to $C_{750}$ paraffins, preferably $C_{50}$ to $C_{500}$ paraffins. The PAO oligomers are dimers, trimers, tetramers, pentamers, etc. of $C_5$ to $C_{14}$ alpha-olefins in one embodiment, and $C_6$ to $C_{12}$ alpha-olefins in another embodiment, and $C_8$ to $C_{12}$ alpha-olefins in another embodiment. Suitable olefins include 1-pentene, 1-hexene, 1-heptene, 1-octene, 1-nonene, 1-decene, 1-undecene and 1-dodecene. In one embodiment, the olefin is 1-decene, and the PAO is a mixture of dimers, trimers, tetramers and pentamers (and higher) of 1-decene. Useful PAO's are described more particularly in, for example, U.S. Pat. Nos. 5,171,908, 5,783,531, and in SYNTHETIC LUBRICANTS AND HIGH-PERFORMANCE FUNCTIONAL FLUIDS 1-52 (Leslie R. Rudnick & Ronald L. Shubkin, ed. Marcel Dekker, Inc. 1999).

PAO's useful in the present invention typically possess a number average molecular weight of from 100 to 21,000 g/mol in one embodiment, and from 200 to 10,000 g/mol in another embodiment, and from 200 to 7,000 g/mol in yet another embodiment, and from 200 to 2,000 g/mol in yet another embodiment, and from 200 to 500 g/mol in yet another embodiment. Desirable PAO's are commercially available as SpectraSyn™ Hi-Vis, SpectraSyn™ Low-Vis, SpectraSyn™ plus, SpectraSyn™ Elite PAO's (ExxonMobil Chemical Company, Houston Texas) and Durasyn™ PAO's from Ineos Oligomers USA LLC.

Synthetic lubricating oils useful as base oils also include hydrocarbon oils such as homopolymerized and copolymerized: alkylbenzenes (e.g. dodecylbenzenes, tetradecylbenzenes, dinonylbenzenes, di(2-ethylhexyl)benzenes); polyphenols (e.g. biphenyls, terphenyls, alkylated polyphenols); and alkylated diphenyl ethers and alkylated diphenyl sulfides; and the derivatives, analogues and homologues thereof.

Another suitable class of synthetic lubricating oils useful as base oils comprises the esters of dicarboxylic acids (e.g. phthalic acid, succinic acid, alkyl succinic acids and alkenyl succinic acids, maleic acid, azelaic acid, suberic acid, sebasic acid, fumaric acid, adipic acid, linoleic acid dimer, malonic acid, alkylmalonic acids, alkenyl malonic acids) reacted with a variety of alcohols (e.g. butyl alcohol, hexyl alcohol, dodecyl alcohol, 2-ethylhexyl alcohol, ethylene glycol, diethylene glycol monoether, propylene glycol). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, and the complex ester formed by reacting one mole of sebacic acid with two moles of tetraethylene glycol and two moles of 2-ethylhexanoic acid.

Esters useful as synthetic oils herein also include those made from $C_5$ to $C_{12}$ monocarboxylic acids and polyols, and polyol ethers such as neopentyl glycol, trimethylolpropane, pentaerythritol, dipentaerythritol and tripentaerythritol.

Desirable ester base oils are commercially available as Esterex™ Esters (ExxonMobil Chemical Company, Houston Texas).

Silicon-based oils such as the polyalkyl-, polyaryl-, polyalkoxy- or polyaryloxysilicone oils and silicate oils comprise another useful class of synthetic lubricants useful herein; such oils include tetraethyl silicate, tetraisopropyl silicate, tetra-(2-ethylhexyl)silicate, tetra-(4-methyl-2-ethylhexyl)silicate, tetra-(p-tert-butyl-phenyl) silicate, hexa-(4-methyl-2-ethylhexyl)disiloxane, poly(methyl)siloxanes and poly(methylphenyl)siloxanes.

Other synthetic lubricating oils useful herein include liquid esters of phosphorous-containing acids (e.g., tricresyl phosphate, trioctyl phosphate, diethyl ester of decylphosphonic acid) and polymeric tetrahydrofurans.

Unrefined, refined, and re-refined oils can be used in the lubricating compositions of the present invention. Unrefined oils are those obtained directly from a natural or synthetic source without further purification treatment. For example, a shale oil obtained directly from retorting operations, a petroleum oil obtained directly from distillation, or an ester oil obtained directly from an esterification process and used without further treatment is considered an unrefined oil. Refined oils are similar to the unrefined oils except they have been further treated in one or more purification steps to improve one or more properties. Many such purification techniques, such as distillation, solvent extraction, acid or base extraction, filtration, and percolation are used by those in the art. Re-refined oils are oils obtained by processes similar to those used to obtain refined oils where the refining processes are applied to previously refined oils which have been previously used in service. Such re-refined oils are also referred to as reclaimed or reprocessed oils and often are additionally processed for removal of spent additive and oil breakdown products. A re-refined base oil is preferably substantially free from materials introduced through manufacturing, contamination or previous use.

Other examples of useful base oils are gas-to-liquid ("GTL") base oils, i.e. the base oil is an oil derived from hydrocarbons made from synthesis gas ("syn gas") containing $H_2$ and CO using a Fischer-Tropsch catalyst. These hydrocarbons typically require further processing in order to be useful as a base oil. For example, they may, by methods known in the art, be hydroisomerized; hydrocracked and hydroisomerized; dewaxed; or hydroisomerized and dewaxed. For further information on useful GTL base oils and blends thereof, please see U.S. Pat. No. 10,913,916 (column 4, line 62 to column 5, line 60) and U.S. Pat. No. 10,781,397 (column 14, line 54 to column 15, line 5, and column 16, line 44 to column 17, line 55).

In particular, oils from renewable sources, i.e., based in part on carbon and energy captured from the environment, such as biological sources, are useful herein.

The various base oils are often categorized as Group I, II, III, IV, or V according to the API EOLCS 1509 definition (American Petroleum Institute Publication 1509, see section E.1.3, 19$^{th}$ edition, January 2021, www.API.org). Generally speaking, Group I base stocks have a viscosity index of between about 80 to 120 and contain greater than about 0.03% sulfur and/or less than about 90% saturates. Group II base stocks have a viscosity index of between about 80 to 120, and contain less than or equal to about 0.03% sulfur and greater than or equal to about 90% saturates. Group III base stocks have a viscosity index greater than about 120 and contain less than or equal to about 0.03% sulfur and greater than about 90% saturates. Group IV base stocks includes polyalphaolefins (PAO). Group V base stocks include base stocks not included in Groups I-IV. (Viscosity index measured by ASTM D 2270, saturates is measured by ASTM D2007, and sulfur is measured by ASTM D2622, ASTM D4294, ASTM D4927, and ASTM D-3120). A Group III+ base stock is a group III base stock having a VI of 130 or more.

Base oils for use in the formulated lubricating compositions useful in the present disclosure are any one, two, three, or more of the variety of oils described herein. In desirable embodiments, base oils for use in the formulated lubricating compositions useful in the present disclosure are those described as API Group I, Group II, Group III (including Group III+), Group IV, and Group V oils and mixtures thereof, preferably API Group II, Group III, Group IV, and Group V oils and mixtures thereof, more preferably the Group III, Group III+, IV and Group V base oils due to their exceptional volatility, stability, viscometric and cleanliness features. Minor quantities of Group I basestock, such as the amount used to dilute additives for blending into formulated lube oil products, can be tolerated but are typically kept to a minimum, e.g., amounts only associated with their use as diluent/carrier oil for additives used on an "as-received" basis. In regard to the Group II stocks, it is more useful that the Group II base stock be in the higher quality range associated with that stock, i.e. a Group II stock having a viscosity index in the range from 100 to 120.

The base oil useful herein may be selected from any of the synthetic, natural, or re-refined oils (such as those typically used as crankcase lubricating oils for spark-ignited and compression-ignited engines). Mixtures of synthetic and/or natural and/or re-refined base oils may be used if desired. Multi-modal mixtures (such as bi- or tri-modal mixtures) of Group I, II, III, IV, and/or V base stocks may be used if desired.

The base oil or base oil blend used herein conveniently has a kinematic viscosity at 100° C. ($KV_{100}$, as measured according to ASTM D 445-19a, and reported in units of centistoke (cSt) or it its equivalent, $mm^2/s$), of about 2 to about 40 cSt, alternately of 3 to 30 cSt, alternately 4 to 20 cSt at 100° C., alternately 5 to 10 cSt, alternately the base oil or base oil blend may have a kinematic viscosity at 100° C. of 2 to 20 cSt, of 2.5 to 2 cSt, and preferably of about 2.5 cSt to about 9 cSt.

The base oil or base oil blend preferably has a saturate content of at least 65 mass %, more preferably at least 75 mass %, such as at least 85 mass %, such as greater than 90 mass % as determined by ASTM D 2007.

Preferably, the base oil or base oil blend will have a sulfur content of less than 1 mass %, preferably less than 0.6 mass %, most preferably less than 0.4 mass %, such as less than 0.3 mass %, based on the total mass of the lubricating composition, as measured by ASTM D2622.

In embodiments, the volatility of the base oil or base oil blend, as measured by the Noack test (ASTM D5800, procedure B), is less than or equal to 30 mass %, such as less than or equal to 25 mass %, such as less than or equal to 20 mass %, such as less than or equal 16 mass %, such as less than or equal to 12 mass %, such as less than or equal to 10 mass %, based on the total mass of the lubricating composition.

In embodiments, the viscosity index (VI) of the base oil is at least 95, preferably at least 110, more preferably at least 120, even more preferably at least 125, most preferably from about 130 to 240, in particular from about 105 to 140 (as determined by ASTM D 2270).

The base oil may be provided in a major amount, in combination with a minor amount of one or more additive components as described hereinafter, constituting a lubricant. This preparation may be accomplished by adding the additives directly to the oil or by adding the one or more additives in the form of a concentrate thereof to disperse or dissolve the additive(s). Additives may be added to the oil by any method known to those skilled in the art, either before, at the same time as, or after addition of other additives.

The base oil may be provided in a minor amount, in combination with minor amounts of one or more additive components as described hereinafter, constituting an additive concentrate. This preparation may be accomplished by adding the additives directly to the oil or by adding the one or more additives in the form of a solution, slurry or suspension thereof to disperse or dissolve the additive(s) in the oil. Additives may be added to the oil by any method known to those skilled in the art, either before, at the same time as, or after addition of other additives.

The base oil typically constitutes the major component of an engine oil lubricant composition of the present disclosure and typically is present in an amount ranging from about 50 to about 99 weight percent, preferably from about 70 to about 95 weight percent, and more preferably from about 80 to about 95 weight percent, based on the total weight of the composition.

Typically, one or more base oils are present in the lubricating composition in an amount of 32 weight % or more, alternately 55 weight % or more, alternately 60 weight % or more, alternately 65 weight % or more, based on the total weight of the lubricating composition. Typically, one or more base oils are present in the lubricating composition at an amount of 98 weight % or less, more preferably 95 weight % or less, even more preferably 90 weight % or less. Alternately, one or more base oils are present in the lubricating composition at from 1 to 99 mass %, alternately 50 to 97 mass %, alternately to 60 to 95 mass %, alternately 70 to 95 mass %, based upon the weight of the lubricating composition.

The base oils and blends thereof described above are also useful for making concentrates as well as for making lubricants therefrom.

Concentrates constitute a convenient means of handling additives before their use, as well as facilitating solution or dispersion of additives in lubricants. When preparing a lubricant that contains more than one type of additive (sometime referred to as "additive components"), each additive may be incorporated separately, each in the form of a concentrate. In many instances, however, it is convenient to provide a so-called additive "package" (also referred to as an "addpack") comprising one or more additives/co-additives, such as described hereinafter, in a single concentrate.

Typically, one or more base oils are present in the concentrate composition in an amount of 50 weight % or less, alternately 40 weight % or less, alternately 30 weight % or less, alternately 20 weight % or less, based on the total weight of the concentrate composition. Typically, one or more base oils are present in the concentrate composition at an amount of 0.1 to 49 mass %, alternately 5 to 40 mass %, alternately to 10 to 30 mass %, alternately 15 to 25 mass %, based upon the weight of the concentrate composition.

Preferably, the lubricating composition of the present invention is a multigrade oil identified by the viscometric descriptor SAE 20W-X, SAE 15W-X, SAE 10W-X, SAE 5W-X or SAE 0W-X, where X represents any one of 8, 12, 16, 20, 30, 40 and 50; the characteristics of the different viscometric grades can be found in the SAE J300 classification. The lubricating composition is preferably in the form of an SAE 10W-X, SAE 5W-X or SAE 0W-X, more preferably in the form of a SAE 5W-X or SAE 0W-X, wherein X represents any one of 8, 12, 16, 20, 30, 40 and 50. Preferably X is 8, 12, 16, 20, 30 or 40. Alternately X is 20, 30 or 40. (See standard SAE J300 published by SAE International, formerly known as Society of Automotive Engineers.)

Alternately, the lubricating composition of the present invention is a multigrade oil identified by the viscometric descriptor SAE 20W-X, 10W-X, SAE 5W-X or SAE 0W-X, where X represents any one of 8, 12, 16, 20, 30, and 40, such as 16, 20, 30 or 40. Alternately, the lubricating composition of the present invention is a multigrade oil identified by the viscometric descriptor 0W-16, 0W-20, 5W-20, 5W-30, 10W-30, or 10W-40.

The lubricating composition according to the present invention may further comprise one or more additives such as detergents, friction modifiers (other than the sulfurized fatty acid ester friction modifier and Mo containing compound), pour point depressants, anti-foam agents, viscosity modifiers, dispersants, corrosion inhibitors, anti-wear agents, extreme pressure additives, demulsifiers, seal compatibility agents, additive diluent base oils, etc. Specific examples of such additives are described in for example Kirk-Othmer Encyclopedia of Chemical Technology, third edition, volume 14, pages 477-526, and several are discussed in further detail below.

B. Functionalized Olefin Copolymer

Functionalized olefin copolymers used in the formulations of the lubricating compositions herein may be ashless or ash-forming in nature. Preferably, the functionalized olefin copolymers is ashless.

Functionalized olefin copolymers useful herein typically contain a polar group attached to a relatively high molecular weight hydrocarbon chain. The polar group typically contains at least one element of nitrogen, oxygen, or phosphorus. Typical hydrocarbons or copolymers employed in the formation of the functionalized olefin copolymers of the present invention include copolymers, interpolymers or lower molecular weight hydrocarbons. One family of such polymers comprise polymers of ethylene and/or at least one $C_3$ to $C_{28}$ alpha-olefin having the formula $H_2C{=}CHR^1$ wherein $R^1$ is straight or branched chain alkyl radical comprising 1 to 26 carbon atoms and wherein the polymer contains carbon-to-carbon unsaturation, preferably a high degree of terminal ethenylidene unsaturation. Preferably, such polymers comprise interpolymers of ethylene and at least one alpha-olefin of the above formula, wherein $R^1$ is alkyl of from 1 to 18 carbon atoms, and more preferably is alkyl of from 1 to 8 carbon atoms, and more preferably still of from 1 to 2 carbon atoms. The functionalized olefin copolymer of the present invention typically has a number average molecular weight (g/mol) of at least 10,000 g/mol, suitably at least 15,000 g/mol, preferably from 10,000 to 30,000 g/mol, such as from 15,000 to 28,000 g/mol, such as from 20,000 to 25,000 g/mol, and such as from 22,000 to 25,000 g/mol. The olefin copolymer preferably has a narrow molecular weight distribution (MWD), also referred to as polydispersity (PDI), as determined by the ratio of weight average molecular weight ($M_w$) to number average molecular weight (Me) of less than 3, such as less than 2.5 such as less than 2.2, such as less than 2.0, such as from 1.0 to 3.0, such as from 1.5 to 2.5, such as 1.5 to 2.0. Suitable polymers may have an Mw/Mn of from 1.5 to 2.1, preferably from 1.6 to 1.8.

Preferred functionalized copolymers are copolymer-substituted succinic acid and copolymer-substituted succinic anhydride derivatives. In particular, succinimides, succinate esters, or succinate ester amides are prepared by the reaction of a copolymer-substituted succinic acid or anhydride compound, with at least one equivalent of with a polyhydroxy or polyamino compound (such as an alkylene amine).

Succinimides, which are particularly useful herein, are typically formed by the condensation reaction between: 1) copolymer substituted succinic anhydrides, such as ethylene-propylene copolymer succinic anhydride (EP Copolymer-SA); and 2) polyamine (PAM). Examples of suitable polyamines include: polyalkylene polyamines, hydroxy-substituted polyamines, polyoxyalkylene polyamines, and combinations thereof. Examples of polyalkylene polyamines include tetraethylene pentamine, pentaethylene hexamine, tetraethylenepentamine (TEPA), pentaethylene-haxamine (PEHA), and other polyamines having an average of 5, 6, 7, 8, or 9 nitrogen atoms per molecule). Mixtures where the average number of nitrogen atoms per polyamine molecule is greater than 7 are commonly called heavy polyamines or H-PAMs and may be commercially available under trade names such as HPA™ and HPA-X™ from DowChemical, E100™ from Huntsman Chemical, et al. Examples of hydroxy-substituted polyamines include N-hydroxyalkyl-alkylene polyamines such as N-(2-hydroxyethyl)ethylene diamine, N-(2-hydroxyethyl)piperazine, and/or N-hydroxyalkylated alkylene diamines of the type described, for example, in U.S. Pat. No. 4,873,009. Examples of polyoxyalkylene polyamines include polyoxyethylene and/or polyoxypropylene diamines and triamines (as well as co-oligomers thereof) having an average Mn from about 200 to about 5000 g/mol. Products of this type are commercially available under the tradename Jeffamine™. Representative examples of useful succinimides are shown in U.S. Pat. Nos. 3,087,936; 3,172,892; 3,219,666; 3,272,746; 3,322,670; 3,652,616; 3,948,800; 6,821,307; and Canada Patent No. 1,094,044.

Succinate esters useful herein include those formed by the condensation reaction between copolymer substituted succinic anhydrides (EP Copolymer-SA) and alcohols or polyols. For example, the condensation product of a copolymer substituted succinic anhydride and pentaerythritol is a useful herein.

Succinate ester amides useful herein are formed by a condensation reaction between copolymer substituted succinic anhydrides and alkanol amines. Suitable alkanol amines include ethoxylated polyalkylpolyamines, propoxylated polyalkylpolyamines, and polyalkenylpolyamines such as polyethylene polyamines and or propoxylated hexamethylenediamine. Representative examples are shown in U.S. Pat. No. 4,426,305.

Copolymer substituted succinic anhydride esters of hydrocarbyl bridged aryloxy alcohols are also useful herein.

The above (copolymer)alkenylsuccinic derivatives can be post-reacted with various reagents such as sulfur, oxygen, formaldehyde, carboxylic acids such as oleic acid.

The above functionalized olefin copolymers, can also be post reacted with boron compounds such as boric acid, borate esters or highly borated dispersants, to form borated copolymers generally having from about 0.1 to about 5 moles of boron per mole of copolymer reaction product.

The boron-containing copolymer may be present in an amount to deliver boron to the composition at 15 ppm to 2000 ppm, or 25 ppm to 1000 ppm, or 40 ppm to 600 ppm, or 80 ppm to 350 ppm.

In embodiments the functionalized copolymer is an amine functionalized ethylene propylene copolymer. Typically the functionalized ethylene/propylene copolymer is prepared by reacting with maleic anhydride and thereafter reacting with an amine such as one or more of: N-phenyl-diamine (such as N-phenyl-1,4-phenylenediamine, N-phenyl-p-phenylenediamine (a.k.a. 4-amino-diphenylamine, ADPA), N-phenyl-1, 3-phenyl enediamine, N-phenyl-1,2-phenylenediamine), nitroaniline (such as 3-nitroaniline), N-phenylethane-diamine (such as N1-phenylethane-1,2-diamine), N-aminophenylacetamide (such as N-(4-aminophenyl)acetamide), morpholinopropanamine (such as 3-morpholinopropan-1-amine), aminoethylpiperazine (such as 1-(2-aminoethyl)piperazine).

In embodiments the functionalized copolymer is an amine functionalized ethylene propylene copolymer, typically prepared by reacting an ethylene-propylene copolymer with maleic anhydride and thereafter reacting with an amine such as ADPA (amine N-phenyl-p-phenylenediamine).

The functionalized olefin polymer may be present in the lubricant in an amount 0.1 mass % to 20 mass % of the composition, such as 0.2 to 15 mass %, such as 0.25 to 10 mass %, such as 0.3 to 5 mass %, such as 1.0 mass % to 3.0 mass % of the lubricating oil composition.

Compositions according to the present disclosure may contain one or more functionalized olefin copolymer having an Mn of from 10,000 to about 35,000 g/mol that may function as dispersants herein. These one or more functionalized olefin copolymers having an Mn of from 10,000 to about 35,000 g/mol are not included as dispersants for purposes of determining the amount of dispersants in a lubricating oil composition or concentrate herein.

A useful functionalized olefin copolymer may be a functionalized ethylene-propylene copolymer prepared by maleating ethylene-propylene copolymer (Trilene™ CP-80, Lion Elastomers, Mn approx. 23,000 g/mol, E/P approx. 41/59) then reacting with amine N-phenyl-p-phenylenediamine (ADPA) to obtain an amine functionalized ethylene-propylene copolymer having about 35 mass % active ingredient.

Molecular weights (Mw, Mn, Mz) and molecular weight distribution (Mw/Mn) are determined by Gel Permeation Chromatography using polystyrene standards (Acquity™ APC Polystyrene High MW Calibration Kit, 266-1,760,000 Da) using an Agilent Acuity P-SM-FTN and P-15m high temperature GPC-SEC (gel permeation/size exclusion chromatograph) equipped with an on-line differential refractive index (DRI) detector and a PDA UV detector for 215,254 and 304 wavelengths using Empower™ 3, version 7.41.00.00, software.

C. Detergents

The lubricating composition may comprise one or more metal detergents (such as blends of metal detergents) also referred to as a "detergent additive." Metal detergents typically function both as detergents to reduce or remove deposits and as acid neutralizers or rust inhibitors, thereby reducing wear and corrosion and extending engine life. Detergents generally comprise a polar head with a long hydrophobic tail, with the polar head comprising a metal salt of an acidic organic compound. The salts may contain a substantially stoichiometric amount of the metal in which case they are usually described as normal or neutral salts, and would typically have a total base number ("TBN" as measured by ASTM D2896) of up to 150 mg KOH/g, such as from 0 to 80 (or 5-30) mg KOH/g. A large amount of a metal base may be incorporated by reacting excess metal compound (e.g., an oxide or hydroxide) with an acidic gas (e.g., carbon dioxide). Such detergents, sometimes referred to as overbased, may have a TBN of more than 100 mg KOH/g (such as 200 mg KOH/g or more), and typically will have a TBN of 250 mg KOH/g or more, such as 300 mg KOH/g or more, such as 350 mg KOH/g or more, such as 400 mg KOH/g or more, such as from 200 to 800 mg KOH/g, 225 to 700 mg KOH/g, 250 to 650 mg KOH/g, or 300 to 600 mg KOH/g, such as 150 to 650 mg KOH/g.

Suitable detergents include, oil-soluble neutral and overbased sulfonates, phenates, sulfurized phenates, thiophosphonates, salicylates, naphthenates and other oil-soluble carboxylates of a metal, particularly the alkali metals (Group 1 metals, e.g., Li, Na, K, Rb) or alkaline earth metals (Group 2 metals, e.g., Be, Mg, Ca, Sr, Ba,), particularly, sodium, potassium, lithium, calcium, and magnesium, such as Ca and or Mg. Furthermore, the detergent may comprise hybrid detergent comprising any combination of sodium, potassium, lithium, calcium, or magnesium salts of sulfonates, phenates, sulfurized phenates, thiophosphonates, salicylates, and naphthenates or other oil-soluble carboxylates of a Group 1 and/or 2 metal.

Preferably, the detergent additive(s) useful in the present invention comprises calcium and/or magnesium metal salts. The detergent may a calcium and or magnesium carboxylate (e.g., salicylates), sulfonate, or phenate detergent. More preferably, the detergents additives are selected from magnesium salicylate, calcium salicylate, magnesium sulfonate, calcium sulfonate, magnesium phenate, calcium phenate, and hybrid detergents comprising two, three, four or more of more of these detergents and/or combinations thereof.

The metal-containing detergent may also include "hybrid" detergents formed with mixed surfactant systems including phenate and/or sulfonate components, e.g. phenate/salicylates, sulfonate/phenates, sulfonate/salicylates, sulfonates/phenates/salicylates, as described, for example, in U.S. Pat. Nos. 6,429,178; 6,429,179; 6,153,565; and 6,281,179. Where, for example, a hybrid sulfonate/phenate detergent is employed, the hybrid detergent would be considered equivalent to amounts of distinct phenate and sulfonate detergents introducing like amounts of phenate and sulfonate soaps, respectively.

The overbased metal-containing detergent may be sodium salts, calcium salts, magnesium salts, or mixtures thereof of the phenates, sulfur-containing phenates, sulfonates, salixarates and salicylates. Overbased phenates and salicylates typically have a total base number of 180 to 650 mg KOH/g, such as 200 to 450 mg KOH/g. Overbased sulfonates typically have a total base number of 250 to 600 mg KOH/g, or 300 to 500 mg KOH/g. In embodiments, the sulfonate detergent may be predominantly a linear alkylbenzene sulfonate detergent having a metal ratio of at least 8 as is described in paragraphs to of US Patent Publication 2005/065045 (and granted as U.S. Pat. No. 7,407,919). The overbased detergent may be present at 0 mass % to 15 mass %, or 0.1 mass % to 10 mass %, or 0.2 mass % to 8 mass %, or 0.2 mass % to 3 mass %, based upon of the lubricating composition. For example, for a light duty or heavy duty diesel engine, the detergent may be present at 2 mass % to 3 mass % of the lubricating composition. For a passenger car engine, the detergent may be present at 0.2 mass % to 1 mass % of the lubricating composition.

The detergent additive(s) may comprise one or more magnesium sulfonate detergents. The magnesium detergent may be a neutral salt or an overbased salt. Suitably the magnesium detergent is an overbased magnesium sulfonate having TBN of from 80 to 650 mg KOH/g (ASTM D2896), such as 200 to 500 mg KOH/g, such as 240 to 450 mg KOH/g.

Alternately, the detergent additive(s) is a magnesium salicylate. Suitably the magnesium detergent is a magnesium salicylate having TBN of from 30 to 650 mg KOH/g (ASTM D2896), such as 50 to 500 mg KOH/g, such as 200 to 500 mg KOH/g, such as 240 to 450 mg KOH/g or alternately of 150 mg KOH/g or less, such as 100 mg KOH/g or less.

Alternately, the detergent additive(s) is a combination of magnesium salicylate and magnesium sulfonate.

The magnesium detergents may provide the lubricating composition thereof with from 200-4000 ppm of magnesium atoms, suitably from 200-2000 ppm, from 300 to 1500 or from 450-1200 ppm of magnesium atoms (ASTM D5185).

The detergent composition may comprise (or consist of) a combination of one or more magnesium sulfonate detergents and one or more calcium salicylate detergents.

The combination of one or more magnesium sulfonate detergents and one or more calcium salicylate detergents provides the lubricating composition thereof with: 1) from 200-4000 ppm of magnesium atoms, suitably from 200-2000 ppm, from 300 to 1500 or from 450-1200 ppm of magnesium atoms (ASTM D5185), and 2) at least 500 ppm, preferably at least 750 more preferably at least 900 ppm of atomic calcium, such as from 500-4000 ppm, preferably from 750-3000 ppm, more preferably from 900-2000 ppm atomic calcium (ASTM D5185).

The detergent may comprise one or more calcium detergents such as calcium carboxylate (e.g., salicylate), sulfonate, or phenate detergent.

Suitably the calcium detergent has a TBN of from 30 to 700 mg KOH/g (ASTM D2896), such as 50 to 650 mg KOH/g, such as 200 to 500 mg KOH/g, such as 240 to 450 mg KOH/g or alternately of 150 mg KOH/g or less, such as 100 mg KOH/g or less, or 200 mg KOH/g or more, or 300 mg KOH/g or more, or 350 mg KOH/g or more.

Suitably the calcium detergent is a calcium salicylate, sulfonate or phenate having TBN of from 30 to 700 mg KOH/g, 30 to 650 mg KOH/g (ASTM D2896), such as 50 to 650 mg KOH/g, such as 200 to 500 mg KOH/g, such as 240 to 450 mg KOH/g or alternately of 150 mg KOH/g or less, such as 100 mg KOH/g or less, or 200 mg KOH/g or more, or 300 mg KOH/g or more, or 350 mg KOH/g or more.

Calcium detergent is typically present in amount sufficient to provide at least 500 ppm, preferably at least 750 more preferably at least 900 ppm atomic calcium to the lubricating oil composition (ASTM D5185). If present, any calcium detergent is suitably present in amount sufficient to provide no more than 4000 ppm, preferably no more than 3000, more preferably no more than 2000 ppm atomic calcium to the lubricating oil composition (ASTM D5185). If present, any calcium detergent is suitably present in amount sufficient to provide at from 500-4000 ppm, preferably from 750-3000 ppm more preferably from 900-2000 ppm atomic calcium to the lubricating oil composition (ASTM D5185).

Suitably the total atomic amount of metal from detergent in the lubrication composition according to all aspects of the invention is no more than 5000 ppm, preferably no more than 4000 pm and more preferably no more than 2000 ppm (ASTM D5185). The total amount of atomic metal from detergent in the lubrication oil composition according to all aspects of the invention is suitably at least 500 ppm, preferably at least 800 ppm and more preferably at least 1000 ppm (ASTM D5185). The total amount of atomic metal from detergent in the lubrication oil composition according to all aspects of the invention is suitably from 500 to 5000 ppm, preferably from 500 to 3000 ppm and more preferably from 500 to 2000 ppm (ASTM D5185).

Sulfonate detergents may be prepared from sulfonic acids which are typically obtained by the sulfonation of alkyl substituted aromatic hydrocarbons such as those obtained from the fractionation of petroleum or by the alkylation of aromatic hydrocarbons. Examples include those obtained by alkylating benzene, toluene, xylene, naphthalene, diphenyl or their halogen derivatives such as chlorobenzene, chlorotoluene and chloronaphthalene. The alkylation may be carried out in the presence of a catalyst with alkylating agents having from about 3 to more than 70 carbon atoms. The alkaryl sulfonates usually contain from about 9 to about 80 or more carbon atoms, preferably from about 16 to about 60 carbon atoms per alkyl substituted aromatic moiety. The oil soluble sulfonates or alkaryl sulfonic acids may be neutralized with oxides, hydroxides, alkoxides, carbonates, carboxylate, sulfides, hydrosulfides, nitrates, borates and ethers of the metal. The amount of metal compound is chosen having regard to the desired TBN of the final product but typically ranges from about 100 to 220 mass % (preferably at least 125 mass %) of that stoichiometrically required.

Metal salts of phenols and sulfurized phenols are prepared by reaction with an appropriate metal compound such as an oxide or hydroxide and neutral or overbased products may be obtained by methods well known in the art. Sulfurized phenols may be prepared by reacting a phenol with sulfur or a sulfur containing compound such as hydrogen sulfide, sulfur monohalide or sulfur dihalide, to form products which are generally mixtures of compounds in which 2 or more phenols are bridged by sulfur containing bridges.

Carboxylate detergents, e.g., salicylates, can be prepared by reacting an aromatic carboxylic acid (such as a $C_{5-100}$, $C_{9-30}$, $C_{14-24}$ alkyl-substituted hydroxy-benzoic acid) with an appropriate metal compound such as an oxide or hydroxide and neutral or overbased products may be obtained by methods well known in the art. The aromatic moiety of the aromatic carboxylic acid can contain heteroatoms, such as nitrogen and oxygen. Preferably, the moiety contains only carbon atoms; more preferably the moiety contains six or more carbon atoms; for example benzene is a preferred moiety. The aromatic carboxylic acid may contain one or more aromatic moieties, such as one or more benzene rings, either fused or connected via alkylene bridges.

Preferred substituents in oil-soluble salicylic acids are alkyl substituents. In alkyl-substituted salicylic acids, the alkyl groups advantageously contain 5 to 100, preferably 9 to 30, especially 14 to 20, carbon atoms. Where there is more than one alkyl group, the average number of carbon atoms in all of the alkyl groups is preferably at least 9 to ensure adequate oil solubility.

In embodiments, the ratio of atomic detergent metal to atomic molybdenum in the lubricating oil composition may be less than 3:1, such as less than 2:1.

Further, as metal organic and inorganic base salts which are used as detergents can contribute to the sulfated ash content of a lubricating oil composition, in embodiments of the present invention, the amounts of such additives are minimized. In order to maintain a low sulfur level, salicylate detergents can be used and the lubricating composition herein may comprise one or more salicylate detergents (said detergents are preferably used in amounts in the range of 0.05 to 20.0 mass %, more preferably from 1.0 to 10.0 mass % and most preferably in the range of from 2.0 to 5.0 mass %, based on the total weight of the lubricating composition).

The total sulfated ash content of the lubricating composition herein is typically not greater than 2.0 mass %, alternately at a level of not greater than 1.0 mass % and alternately at a level of not greater than 0.8 mass %, based on the total weight of the lubricating composition as determined by ASTM D874.

Furthermore, it is useful that each of the detergents, independently, have a TBN (total base number) value in the range of from 10 to 700 mg KOH/g, 10 to 500 mg KOH/g, alternately in the range of from 100 to 650, alternately in the range of from, 10 to 500 mg KOH/g, alternately in the range of from 30 to 350 mg KOH/g and alternately in the range of from 50 to 300 mg KOH/g, as measured by ISO 3771.

The detergent may comprise:

1) from 0.1 to 19.8 mass % (such as 0.25 to 9.0 mass %, such as 0.25 to 5 mass %), based upon the weight of the LOC, of at least one calcium detergent (such as calcium salicylate or sulfonate detergent) having a TBN of more than 100 mg KOH/g (such as 200 mg KOH/g or more, such as 250 mg KOH/g or more, such as 300 mg KOH/g or more, such as 350 mg KOH/g or more);
2) from 0.1 to 9.8 mass % (such as 0.25 to 8.0 mass %, such as 0.5 to 5 mass %), based upon the weight of the LOC, at least one calcium detergent (such as calcium salicylate or sulfonate detergent) having a TBN of 100 mg KOH/g or less (such as 90 mg KOH/g or less, such as 80 mg KOH/g or less, such as 70 mg KOH/g or less); and
3) from 0.1 to 19.8 mass % (such as 0.25 to 9.0 mass %, such as 0.5 to 5 mass %), based upon the weight of the LOC, at least one magnesium detergent (such as magnesium salicylate or sulfonate detergent) having a TBN of 100 mg KOH/g or more (such as 200 mg KOH/g or more, such as 250 mg KOH/g or more, such as 300 mg KOH/g or more, such as 350 mg KOH/g or more, having a TBN of 400 mg KOH/g or more, such as 450 mg KOH/g or more), where the difference in the TBN's for the Ca detergent having a TBN of 100 or less and Ca detergent having a TBN of more than 100 mg KOH/g is at least 100 mg KOH/g, such as at least 150 mg KOH/g, such as at least 200 mg KOH/g.

The detergent may comprise:

1) from 0.1 to 19.8 mass % (such as 0.25 to 9.0 mass %, such as 0.25 to 5 mass %), based upon the weight of the LOC, of at least one calcium salicylate detergent having a TBN of 200 mg KOH/g or more (such as 250 mg KOH/g or more, such as 300 mg KOH/g or more, such as 350 mg KOH/g or more);
2) from 0.1 to 9.8 mass % (such as 0.25 to 8.0 mass %, such as 0.5 to 5 mass %), based upon the weight of the LOC, at least one calcium salicylate) having a TBN of 100 mg KOH/g or less; and
3) from 0.1 to 19.8 mass % (such as 0.25 to 9.0 mass %, such as 0.5 to 5 mass %), based upon the weight of the LOC, at least one magnesium sulfonate detergent) having a TBN 200 mg KOH/g or more (such as 250 mg KOH/g or more, such as 300 mg KOH/g or more, such as 350 mg KOH/g or more, having a TBN of 400 mg KOH/g or more, such as 450 mg KOH/g or more), where the difference in the TBN's for the Ca detergent having a TBN of 100 or less and Ca detergent having a TBN of 200 or more is at least 120 mg KOH/g, such as at least 150 mg KOH/g, such as at least 200 mg KOH/g.

Typically, lubricating compositions formulated for use in light duty and or heavy duty diesel engines comprise detergents at from about 0.5 to about 10 mass %, alternately from about 2.5 to about 7.5 mass %, alternately from about 4 to about 6.5 mass %, based on the lubricating composition.

Typically, lubricating compositions formulated for use in automotive engines comprise detergents at from about 0.5 to about 10 mass %, alternately from about 2.5 to about 7.5 mass %, alternately from about 4 to about 6.5 mass %, based on the lubricating composition.

D. Friction Modifiers (Components D-1, D-2, and D-3)

A friction modifier is any material or materials that can alter the coefficient of friction of a surface lubricated by any lubricant or fluid containing such material(s). Friction modifiers, also known as friction reducers, or lubricity agents or oiliness agents, and other such agents that change the ability of base oils, formulated lubricating compositions, or functional fluids, to modify the coefficient of friction of a lubricated surface may be effectively used in combination with the base oils or lubricating compositions of the present disclosure if desired. Friction modifiers that lower the coefficient of friction are particularly advantageous in combination with the base oils and lubricating compositions of this disclosure. D-3 components may be selected from Mo containing compounds described herein below.

Illustrative friction modifiers may include, for example, organometallic compounds or materials, or mixtures thereof. Illustrative organometallic friction modifiers useful in the lubricating oil formulations of this disclosure include, for example, tungsten and or molybdenum compounds, such as molybdenum amine, molybdenum diamine, an organotungstenate, a molybdenum dithiocarbamate, molybdenum dithiophosphates, molybdenum amine complexes, molybdenum carboxylates, and the like, and mixtures thereof. Examples of useful molybdenum-containing compounds (D-3) may conveniently include molybdenum dithiocarbamates, trinuclear molybdenum compounds, for example as described in WO 98/26030, sulfides of molybdenum and molybdenum dithiophosphate.

Other known D-3 friction modifiers comprise oil-soluble organo-molybdenum compounds. Such organo-molybdenum friction modifiers may also provide antioxidant and anti-wear credits to a lubricating oil composition. Examples of such oil-soluble organo-molybdenum compounds include dithiocarbamates, dithiophosphates, dithiophosphinates, xanthates, thioxanthates, sulfides, and the like, and mixtures thereof. Particularly preferred are molybdenum dithiocarbamates, dialkyldithiophosphates, alkyl xanthates and alkylthioxanthates.

Additionally, the molybdenum compound may be an acidic molybdenum compound. These compounds will react with a basic nitrogen compound as measured by ASTM test D-664 or D-2896 titration procedure and are typically hexavalent. Included are molybdic acid, ammonium molybdate, sodium molybdate, potassium molybdate, and other alkali metal molybdates and other molybdenum salts, e.g., hydrogen sodium molybdate, $MoOCl_4$, $MoO_2Br_2$, $Mo_2O_3Cl_6$, molybdenum trioxide or similar acidic molybdenum compounds.

Among the molybdenum compounds useful in the compositions of this invention as D-3 are organo-molybdenum compounds of the formula $$Mo(R''OCS_2)_4 \text{ and}$$

$$Mo(R''SCS_2)_4$$

wherein R" is an organo group selected from the group consisting of alkyl, aryl, aralkyl and alkoxyalkyl, generally of from 1 to 30 carbon atoms, and preferably 2 to 12 carbon atoms and most preferably alkyl of 2 to 12 carbon atoms. Especially preferred are the dialkyldithiocarbamates of molybdenum.

Another group of organo-molybdenum compounds useful in the lubricating compositions of this invention are trinuclear molybdenum compounds, especially those of the formula $Mo_3S_kL_nQ_z$ and mixtures thereof wherein the L are independently selected ligands having organo groups with a sufficient number of carbon atoms to render the compound soluble or dispersible in the oil, n is from 1 to 4, k varies from 4 to 7, Q is selected from the group of neutral electron donating compounds such as water, amines, alcohols, phosphines, and ethers, and z ranges from 0 to 5 and includes non-stoichiometric values. At least 21 carbon atoms should be present among all the ligand organo groups, such as at least 25, at least 30, or at least 35, carbon atoms.

Lubricating oil compositions useful in all aspects of the present invention preferably contain at least 10 ppm, at least 30 ppm, at least 40 ppm and more preferably at least 50 ppm molybdenum. Suitably, lubricating oil compositions useful in all aspects of the present invention contain no more than 1000 ppm, no more than 750 ppm or no more than 500 ppm of molybdenum. Lubricating oil compositions useful in all aspects of the present invention preferably contain from 10 to 1000, such as 30 to 750 or 40 to 500, ppm of molybdenum (measured as atoms of molybdenum).

For more information or useful friction modifiers containing Mo, please see U.S. Pat. No. 10,829,712 (column 8, line 58 to column 11, line 31).

Molybdenum containing compounds useful as D-3 include: molybdenum dithiocarbamates, dialkyldithiophosphates, alkyl xanthates and alkylthioxanthates, where the alkyl groups are $C_1$ to $C_{30}$ linear, branched, cyclic alkyl groups, such as $C_{2\ to\ 15}$ alkyl groups, such as methyl, ethyl, propyl, isopropyl, butyl, isobutyl, cyclobutyl, pentyl, isopentyl, hexyl, isohexyl, cyclohexyl, phenyl, alkyl substituted phenyl, octyl, isooctyl, cyclooctyl, nononyl, decyl, isodecyl, undecyl, dodecyl, and isomers thereof.

Molybdenum containing compounds useful as D-3 may provide at least 10 ppm, at least 30 ppm, at least 40 ppm and more preferably at least 50 ppm molybdenum to the LOC. Further molybdenum containing compounds useful as D-3 typically provide no more than 1000 ppm, no more than 750 ppm or no more than 500 ppm of molybdenum to the LOC. Lubricating oil compositions useful in all aspects of the present invention preferably contain from 10 to 1000, such as 30 to 750 or 40 to 500, ppm of molybdenum (measured as atoms of molybdenum) provided by the molybdenum containing compounds useful as D-3.

Ashless friction modifiers may be present in the lubricating oil compositions of the present invention and are known generally and include esters formed by reacting carboxylic acids and anhydrides with alkanols and amine-based friction modifiers. Other useful friction modifiers generally include a polar terminal group (e.g. carboxyl or hydroxyl) covalently bonded to an oleophilic hydrocarbon chain. Esters of carboxylic acids and anhydrides with alkanols are described in U.S. Pat. No. 4,702,850. Examples of other conventional organic friction modifiers are described by M. Belzer in the "Journal of Tribology" (1992), Vol. 114, pp. 675-682 and M. Belzer and S. Jahanmir in "Lubrication Science" (1988), Vol. 1, pp. 3-26. Typically, the total amount of organic ashless friction modifier in a lubricant according to the present invention does not exceed 5 mass %, based on the total mass of the lubricating oil composition and preferably does not exceed 2 mass % and more preferably does not exceed 0.5 mass %.

Illustrative friction modifiers useful in the lubricating compositions described herein include, for example, alkoxylated fatty acid esters, alkanolamides, polyol fatty acid esters, borated glycerol fatty acid esters, fatty alcohol ethers, sulfurized fatty acid esters, and mixtures thereof.

Illustrative alkoxylated fatty acid esters include, for example, polyoxyethylene stearate, fatty acid polyglycol ester, and the like. These can include polyoxypropylene stearate, polyoxybutylene stearate, polyoxyethylene isostearate, polyoxypropylene isostearate, polyoxyethylene palmitate, and the like.

Illustrative alkanolamides include, for example, lauric acid diethylalkanolamide, palmic acid diethylalkanolamide, and the like. These can include oleic acid diethyalkanolamide, stearic acid diethylalkanolamide, oleic acid diethylalkanolamide, polyethoxylated hydrocarbylamides, polypropoxylated hydrocarbylamides, and the like.

Illustrative polyol fatty acid esters include, for example, glycerol mono-oleate, saturated mono-, di-, and tri-glyceride esters, glycerol mono-stearate, and the like. These can include polyol esters, hydroxyl-containing polyol esters, and the like.

Illustrative borated glycerol fatty acid esters include, for example, borated glycerol mono-oleate, borated saturated mono-, di-, and tri-glyceride esters, borated glycerol monosterate, and the like. In addition to glycerol polyols, these can include trimethylolpropane, pentaerythritol, sorbitan, and the like. These esters can be polyol monocarboxylate esters, polyol dicarboxylate esters, and on occasion polyoltricarboxylate esters. Preferred can be the glycerol monooleates, glycerol dioleates, glycerol trioleates, glycerol monostearates, glycerol distearates, and glycerol tristearates and the corresponding glycerol monopalmitates, glycerol dipalmitates, and glycerol tripalmitates, and the respective isostearates, linoleates, and the like. Ethoxylated, propoxylated, butoxylated fatty acid esters of polyols, especially using glycerol as underlying polyol are useful herein.

Illustrative fatty alcohol ethers include, for example, stearyl ether, myristyl ether, and the like. Alcohols, including those that have carbon numbers from $C_3$ to $C_{50}$, can be ethoxylated, propoxylated, or butoxylated to form the corresponding fatty alkyl ethers. The underlying alcohol portion can preferably be stearyl, myristyl, $C_{11}$-$C_{13}$ hydrocarbon, oleyl, isosteryl, and the like.

Illustrative sulfurized fatty acid esters useful as component D-1, include sulfurized fatty acid methyl esters, such as sulfurized fatty acid ester derived from any suitable fatty acid ester, such as those derived from a vegetable oil (e.g. glycerol ester or trans-esterification product), such as, but not limited to, one or more of palm oil, corn oil, grapeseed oil, coconut oil, cottonseed oil, wheatgerm oil, soya oil, safflower oil, olive oil, peanut oil, rapeseed oil and sunflower oil, or an animal oil (e.g. glycerol ester or trans-esterification product) such as tallow oil or lard oil. The sulfurized fatty acid ester may be derived from one or more of palm oil, rapeseed oil, soya oil, tallow oil, lard oil, or a trans-esterified product thereof. More preferably, the sulfurized fatty acid ester is derived from a vegetable oil, especially one or more of palm oil, soya oil, rapeseed oil, or a trans-esterified product thereof. The sulfurized fatty acid ester suitably comprises substantially only sulfurized fatty acid ester and no other sulfurized carboxylic acid ester. For further descriptions of fatty acid esters, such as fatty acid methyl esters, please see U.S. Pat. No. 11,136,523, especially Col 8, line 1-56, Col 12, line 56 to Col 16, line 60, which is incorporated by reference herein. Preferably one or more oil-soluble or oil-dispersible sulfurized fatty acid ester(s), such as sulfurized fatty acid methyl ester(s), are present as an additive in an amount providing the lubricating oil composition with 0.02 (such as 0.05, such as 0.08) or more mass % sulfur, based on the total mass of the lubricating oil composition. Suitably, the one or more sulfurized fatty acid ester(s) provides the lubricating oil composition with 0.30 (such as 0.25, such as 0.20) or less mass % sulfur, based on the total mass of the lubricating oil composition. Suitably, the one or more sulfurized fatty acid ester(s) provides the lubricating oil composition with from 0.02 mass % to 0.30 mass % sulfur, preferably from 0.05 mass % to 0.30 mass % sulfur, more preferably 0.05 to 0.20 mass % sulfur.

Useful concentrations of friction modifiers may range from 0.01 weight percent to 5 weight percent, or about 0.1 weight percent to about 2.5 weight percent, or about 0.1 weight percent to about 1.5 weight percent, or about 0.1 weight percent to about 1 weight percent. Concentrations of molybdenum-containing materials are often described in terms of Mo metal concentration. Advantageous concentrations of Mo may range from 25 ppm to 700 ppm or more, and often with a preferred range of 50-200 ppm. Friction modifiers of all types may be used alone or in mixtures with the materials of this disclosure. Often mixtures of two or more friction modifiers, or mixtures of friction modifier(s) with alternate surface active material(s), are also desirable. For example, combinations of Mo containing compounds with polyol fatty acid esters, such as glycerol mono-oleate are useful herein.

Compositions according to the present disclosure may contain sulfurized fatty acid ester that are described as friction modifiers herein. These sulfurized fatty acid ester additives are not included as friction modifiers for purposes of determining the amount of friction modifiers (D-2) in a lubricating oil composition or concentrate herein.

Likewise, compositions according to the present disclosure may comprise one or more molybdenum containing compounds that can act as friction modifiers providing a specific amount of molybdenum atoms to the lubricating oil composition. These molybdenum compounds are not included as friction modifiers for purposes of determining the amount of friction modifiers in a lubricating oil composition or concentrate herein.

E. Antioxidants (Component E)

Antioxidants retard the oxidative degradation of base oils during service. Such degradation may result in deposits on metal surfaces, the presence of sludge, or a viscosity increase in a lubricant. A wide variety of oxidation inhibitors that are useful in lubricating oil compositions. See *Lubricants and Related Products*, Klamann, Wiley VCH, 1984; U.S. Pat. Nos. 4,798,684; and 5,084,197, for example.

Useful antioxidants include hindered phenols (i.e., phenol based antioxidants useful in component E). These phenolic antioxidants may be ashless (metal-free) phenolic compounds or neutral or basic metal salts of certain phenolic compounds. Typical phenolic antioxidant compounds are the hindered phenolics which contain a sterically hindered hydroxyl group, and these include those derivatives of dihydroxy aryl compounds in which the hydroxyl groups are in the o- or p-position to each other. Typical phenolic antioxidants include the hindered phenols substituted with $C_{6+}$ alkyl groups and the alkylene coupled derivatives of these hindered phenols. Examples of phenolic materials of this type 2-t-butyl-4-heptyl phenol; 2-t-butyl-4-octyl phenol; 2-t-butyl-4-dodecyl phenol; 2,6-di-t-butyl-4-heptyl phenol; 2,6-di-t-butyl-4-dodecyl phenol; 2-methyl-6-t-butyl-4-heptyl phenol; and 2-methyl-6-t-butyl-4-dodecyl phenol. Other useful hindered mono-phenolic antioxidants may include, for example, hindered 2,6-di-alkyl-phenolic proprionic ester derivatives. Bis-phenolic antioxidants may also be advantageously used herein. Examples of ortho-coupled phenols include: 2,2'-bis(4-heptyl-6-t-butyl-phenol); 2,2'-bis(4-octyl-6-t-butyl-phenol); and 2,2'-bis(4-dodecyl-6-t-butyl-phenol). Para-coupled bisphenols include for example 4,4'-bis (2,6-di-t-butyl phenol) and 4,4'-methylene-bis(2,6-di-t-butyl phenol).

Effective amounts of one or more catalytic antioxidants may also be used. The catalytic antioxidants comprise an effective amount of a) one or more oil soluble polymetal organic compounds; and, effective amounts of b) one or more substituted N,N'-diaryl-o-phenylenediamine compounds or c) one or more hindered phenol compounds; or a combination of both b) and c). Catalytic antioxidants useful herein are more fully described in U.S. Pat. No. 8,048,833.

Non-phenolic oxidation inhibitors which may be used include aromatic amine antioxidants (amine based antioxidants useful in component E) and these may be used either as such or in combination with phenolics. Typical examples of non-phenolic antioxidants include: alkylated and non-alkylated aromatic amines such as aromatic monoamines of the formula $R^8R^9R^{10}N$ where $R^8$ is an aliphatic, aromatic or substituted aromatic group, $R^9$ is an aromatic or a substituted aromatic group, and $R^{10}$ is H, alkyl, aryl or $R^{11}S(O)_xR^{12}$ where $R^{11}$ is an alkylene, alkenylene, or aralkylene group, $R^{12}$ is an alkyl group, or an alkenyl, aryl, or alkaryl group, and x is 0, 1 or 2. The aliphatic group $R^8$ may contain from 1 to about 20 carbon atoms, and preferably contains from about 6 to 12 carbon atoms. The aliphatic group is typically a saturated aliphatic group. Preferably, both $R^8$ and $R^9$ are aromatic or substituted aromatic groups, and the aromatic group may be a fused ring aromatic group such as naphthyl. Aromatic groups $R^8$ and $R^9$ may be joined together with other groups such as S.

Typical aromatic amines antioxidants have alkyl substituent groups of at least about 6 carbon atoms. Examples of aliphatic groups include hexyl, heptyl, octyl, nonyl, and decyl. Generally, the aliphatic groups will not contain more than about 14 carbon atoms. The general types of amine antioxidants useful in the present compositions include diphenylamines, phenyl naphthylamines, phenothiazines, imidodibenzyls and diphenyl phenylene diamines. Mixtures of two or more aromatic amines are also useful. Polymeric amine antioxidants can also be used. Particular examples of aromatic amine antioxidants useful in the present disclosure include: p,p'-dioctyldiphenylamine; t-octylphenyl-alpha-naphthylamine; phenyl-alphanaphthylamine; and p-octylphenyl-alpha-naphthylamine. The antioxidant in component E) may be solely (consist of or consist essentially of) amine based antioxidants, such as aromatic amine antioxidants. The antioxidant in component E) may be solely (consist of or consist essentially of) phenyl amine (such as diphenyl amine) based antioxidants. The antioxidant in component E) may exclude phenol based antioxidants.

Sulfur containing anti-oxidants are also useful herein. In particular, one or more oil-soluble or oil-dispersible sulfur containing anti-oxidant(s)can be used as an antioxidant additive. For example, sulfurized alkyl phenols and alkali or alkaline earth metal salts thereof also are useful antioxidants herein. Suitably, the lubricating oil composition(s) of the present invention may include the one or more sulfur containing anti-oxidant(s) in an amount to provide the lubricating oil composition with from 0.02 to 0.2, preferably from 0.02 to 0.15, even more preferably 0.02 to 0.1, even more preferably 0.04 to 0.1, mass % sulfur based on the total mass of the lubricating oil composition. Optionally the oil-soluble or oil-dispersible sulfur containing anti-oxidant(s) are selected from sulfurized $C_4$ to $C_{25}$ olefin(s), sulfurized aliphatic ($C_7$ to $C_{29}$) hydrocarbyl fatty acid ester(s), ashless sulfurized phenolic anti-oxidant(s), sulfur containing organo-molybdenum compound(s), and combinations thereof. For further information, on sulfurized materials useful as anti-oxidants herein, please see U.S. Pat. No. 10,731,101 (column 15, line 55 to column 22, line 12).

Antioxidants useful herein include hindered phenols, arylamines. These antioxidants may be used individually by type or in combination with one another.

Typical antioxidants include: Irganox™ L67, Irganox™ L135, ETHANOX™ 4702, Lanxess Additin™ RC 7110; ETHANOX™ 4782J; Irganox™ 1135, Irganox™ 5057, sulfurized lard oil and palm oil fatty acid methyl ester.

Antioxidant additives may be used in an amount of about 0.01 to 5 weight percent, preferably about 0.01 to 3 weight percent, more preferably 0.01 to 1.5 weight percent, more preferably 0.01 to less than 1 weight percent, based upon the weight of the lubricating composition.

Compositions according to the present disclosure may contain an additive having a different enumerated function that also has secondary effects as an antioxidant (for example, phosphorus-containing anti-wear agents (such as ZDDP) may also have antioxidant effects). These additives are not included as antioxidants for purposes of determining the amount of antioxidant in a lubricating oil composition or concentrate herein. However amine based antioxidants and phenol based antioxidant are included as as antioxidants for purposes of determining the amount of antioxidant in a lubricating oil composition or concentrate herein. The antioxidant may consist of or consist essentially of amine based antioxidants and/or phenol based antioxidant. The antioxidant may exclude antioxidants that are not amine based antioxidant and/or phenol based antioxidant.

F. Pour Point Depressants

Conventional pour point depressants (also known as lube oil flow improvers) may be added to the compositions of the present disclosure if desired. These pour point depressant may be added to lubricating compositions of the present disclosure to lower the minimum temperature at which the fluid will flow or can be poured. Examples of suitable pour point depressants include polymethacrylates, polyacrylates, polyarylamides, condensation products of haloparaffin waxes and aromatic compounds, vinyl carboxylate polymers, copolymers of dialkyl fumarate and vinyl acetates (such as copolymers of $C_8$-$C_{18}$dialkyl fumarate/vinyl acetate), terpolymers of dialkylfumarates, vinyl esters of fatty acids and allyl vinyl ethers. U.S. Pat. Nos. 1,815,022; 2,015,748; 2,191,498; 2,387,501; 2,655,479; 2,666,746; 2,721,877; 2,721,878; and 3,250,715 describe useful pour point depressants and/or the preparation thereof. Such additives may be used in an amount of about 0.01 to 5 weight percent, preferably about 0.01 to 1.5 weight percent.

G. Anti-Foam Agents

Anti-foam agents may advantageously be added to lubricant compositions described herein. These agents prevent or retard the formation of stable foams. Silicones and organic polymers are typical anti-foam agents. For example, polysiloxanes, such as silicon oil or polydimethyl siloxane, provide antifoam properties.

Anti-foam agents are commercially available and may be used in minor amounts such as 5 mass % or less, 3 mass % or less, 1 mass % or less, 0.1 mass % or less, such as from 5 to mass % to 0.1 ppm such as from 3 mass % to 0.5 ppm, such as from 1 mass % to 10 ppm.

For example, it may be that the lubricating oil composition comprises an anti-foam agent comprising polyalkyl siloxane, such as a polydialkyl siloxane, for example wherein the alkyl is a $C_1$-$C_{10}$ alkyl group, e.g. a polydimethylsiloxane (PDMS), also known as a silicone oil. Alternately, the siloxane is a poly($R^3$)siloxane, wherein $R^3$ is one or more same or different linear branched or cyclic hydrocarbyls, such as alkyls or aryls, typically having 1 to 20 carbon atoms. It may be that, for example, the lubricating oil composition comprises a polymeric siloxane compound according to Formula 1 below wherein $R^1$ and $R^2$ are independently are independently methyl, ethyl, propyl, butyl, pentyl, hexyl, heptyl, octyl, nonyl or decyl, phenyl, naphthyl, alkyl substituted phenyl, or isomers thereof (such as methyl, phenyl) and n is from 2 to 1000, such as 50 to 450 alternately such as 40 to 100.

Additionally or alternatively, it may be that the lubricating oil composition comprises an organo modified siloxane (OMS), such as a siloxane modified with an organo group such as a polyether (e.g. ethylene-propyleneoxide copolymer), long chain hydrocarbyl (e.g. $C_{11}$-$C_{100}$ alkyl), or aryl (e.g. $C_6$-$C_{14}$ aryl). It may be that, for example, the lubricating oil composition comprises an organo modified siloxane compound according to Formula 1, wherein n is from 2 to 1000, such as 50 to 450 (alternately such as 40 to 100), and wherein $R^1$ and $R^2$ are the same or different, optionally wherein each of $R^1$ and $R^2$ is, independently an organo group, such as an organo group selected from polyether (e.g. ethylene-propyleneoxide copolymer), long chain hydrocarbyl (e.g. $C_{11}$-$C_{100}$ alkyl), or aryl (e.g. $C_6$-$C_{14}$ aryl). Preferably, one of $R^1$ and $R^2$ is $CH_3$.

Formula 1

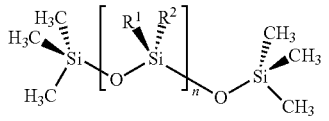

Based on the total weight of the lubricant composition, the siloxane according to Formula 1 is incorporated so as to provide about 0.1 to less than about 30 ppm Si, or about 0.1 to about 25 ppm Si, or about 0.1 to about 20 ppm Si, or about 0.1 to about 15 ppm Si, or about 0.1 to about 10 ppm Si. More preferably, it is in the range of about 3-10 ppm Si.

In an embodiment, silicone antifoam agents useful herein are available from Dow Corning Corporation and Union Carbide Corporation, such as Dow Corning FS-1265 (1000 centistokes), Dow Corning DC-200, and Union Carbide UC-L45. Silicone anti-foamants useful herein are polydimethylsiloxane, phenyl-methyl polysiloxane, linear, cyclic or branched siloxanes, silicone polymers and copolymers, and organo-silicone copolymers. Also, a siloxane polyether copolymer antifoamant available from OSI Specialties, Inc. of Farmington Hills, Mich. and may be substituted or included. One such material is sold as SILWET-L-7220.

Acrylate polymer antifoam agent can also be used herein. Typical acrylate anti-foamants include polyacrylate antifoamant available from Monsanto Polymer Products Co. known as PC-1244. A preferred acrylate polymer antifoam agent useful herein is PX™3841 (i.e., an alkyl acrylate polymer), commercially available from Dorf Ketl, also referred to as Mobilad™C402.

In embodiments, a combination of sililcone anti-foamant and acrylate anti-foamant can be used, such as at a weight ratio of the silicone anti-foamant to the acrylate anti-foamant of from about 5:1 to about 1:5, see for example US 2021/0189283A1.

H. Viscosity Modifers

Viscosity modifiers (also referred to as viscosity index improvers or viscosity improvers) can be included in the lubricating compositions described herein. Viscosity modifiers provide lubricants with high and low temperature operability. These additives impart shear stability at elevated temperatures and acceptable viscosity at low temperatures. Suitable viscosity modifiers include high molecular weight hydrocarbons, polyesters, and viscosity modifier dispersants that can function as both a viscosity modifier and a dispersant. Typical molecular weights of these polymers are between about 10,000 to 1,500,000 g/mol, more typically about 20,000 to 1,200,000 g/mol, and even more typically between about 50,000 and 1,000,000 g/mol.

Examples of suitable viscosity modifiers are linear or star-shaped polymers and copolymers of methacrylate, butadiene, olefins, styrene, or alkylated styrenes. Polyisobutylene is a commonly used viscosity modifier. Another suitable viscosity modifier is polymethacrylate (copolymers of various chain length alkyl methacrylates, for example), some formulations of which also serve as pour point depressants. Other suitable viscosity modifiers include copolymers of ethylene and propylene, hydrogenated styrene-diene block copolymer, hydrogenated block copolymers of styrene and isoprene, hydrogenated block copolymers of styrene and isobutylene, and polyacrylates (copolymers of various chain length acrylates, for example). Specific examples include styrene-isoprene or styrene-butadiene based polymers of 50,000 to 200,000 g/mol molecular weight.

Copolymers useful as viscosity modifiers include those commercially available from Chevron Oronite Company LLC under the trade designation "PARATONE™" (such as "PARATONE™ 8921," PARATONE™ 68231," and "PARATONE™ 8941"); from Afton Chemical Corporation under the trade designation "HiTEC™" (such as HiTEC™ 5850B, and HiTEC™5777); and from The Lubrizol Corporation under the trade designation "Lubrizol™ 7067C". Hydrogenated polyisoprene star polymers useful as viscosity modifiers herein include those commercially available from Infineum International Limited, e.g., under the trade designation "Infineum SV200" and "Infineum SV600". Hydrogenated diene-styrene block copolymers useful as viscosity modifiers herein are commercially available from Infineum International Limited, e.g., under the trade designation "Infineum SV 50".

Polymers useful as viscosity modifiers herein include polymethacrylate or polyacrylate polymers, such as linear polymethacrylate or polyacrylate polymers, such as those available from Evnoik Industries under the trade designation "Viscoplex™" (e.g., Viscoplex™ 6-954) or star polymers which are available from Lubrizol Corporation under the trade designation Asteric™ (e.g., Lubrizol™ 87708 and Lubrizol 87725).

Vinyl aromatic-containing polymers useful as viscosity modifiers herein may be derived from vinyl aromatic hydrocarbon monomers, such as styrenic monomers, such as styrene. Illustrative vinyl aromatic-containing copolymers useful herein may be represented by the following general formula: A-B wherein A is a polymeric block derived predominantly from vinyl aromatic hydrocarbon monomer (such as styrene), and B is a polymeric block derived predominantly from conjugated diene monomer(such as isoprene).

Typically, the viscosity modifiers may be used in an amount of about 0.01 to about 10 weight percent, such as about 0.1 to about 7 weight percent, such as 0.1 to about 4 weight percent, such as about 0.2 to about 2 weight percent, such as such as about 0.2 to about 1 weight percent, and such as such as about 0.2 to about 0.5 weight percent, based on the total weight of the formulated lubricant composition.

Viscosity modifiers are typically added as concentrates, in large amounts of diluent oil. The "as delivered" viscosity modifier typically contains from 20 weight percent to 75 weight percent of an active polymer for polymethacrylate or polyacrylate polymers, or from 8 weight percent to 20 weight percent of an active polymer for olefin copolymers, hydrogenated polyisoprene star polymers, or hydrogenated diene-styrene block copolymers, in the "as delivered" polymer concentrate.

I. Dispersants

During engine operation, oil-insoluble oxidation byproducts are produced. Dispersants help keep these byproducts in solution, thus diminishing their deposition on metal surfaces. Dispersants used in the formulation of the lubricating compositions herein may be ashless or ash-forming in nature. Preferably, the dispersant is ashless. So called ashless dispersants are organic materials that form substantially no ash upon combustion. For example, non-metal-containing or borated metal-free dispersants are considered ashless. In contrast, metal-containing detergents tend form ash upon combustion.

Dispersants useful herein typically contain a polar group attached to a relatively high molecular weight hydrocarbon chain. The polar group typically contains at least one element of nitrogen, oxygen, or phosphorus. Typical hydrocarbon chains contain 50 to 400 carbon atoms.

Dispersants of (Poly)Alkenylsuccinic Derivatives

A particularly useful class of dispersants includes the (poly)alkenylsuccinic derivatives, typically produced by the reaction of a long chain hydrocarbyl substituted succinic compound, usually a hydrocarbyl substituted succinic anhydride, with a polyhydroxy or polyamino compound. The long chain hydrocarbyl group constituting the oleophilic portion of the molecule which confers solubility in the oil, is often a polyisobutylene group (typically the long chain hydrocarbyl group, such as a polyisobutylene group, has an Mn of 400 to 3000 g/mol, such as 450 to 2500 g/mol). Many examples of this type of dispersant are well known commercially and in the literature. Exemplary U.S. patents describing such dispersants include U.S. Pat. Nos. 3,172,892; 3,2145,707; 3,219,666; 3,316,177; 3,341,542; 3,444,170; 3,454,607; 3,541,012; 3,630,904; 3,632,511; 3,787,374 and 4,234,435. Other types of dispersant are described in U.S. Pat. Nos. 3,036,003; 3,200,107; 3,254,025; 3,275,554; 3,438,757; 3,454,555; 3,565,804; 3,413,347; 3,697,574; 3,725,277; 3,725,480; 3,726,882; 4,454,059; 3,329,658; 3,449,250; 3,519,565; 3,666,730; 3,687,849; 3,702,300; 4,100,082; 5,705,458. A further description of dispersants useful herein may be found, for example, in European Patent Application No. 0 471 071 and European Patent Application No. 0 451 380, to which reference is made for this purpose.

Hydrocarbyl-substituted succinic acid and hydrocarbyl-substituted succinic anhydride derivatives are useful dispersants. In particular, succinimide, succinate esters, or succinate ester amides prepared by the reaction of a hydrocarbon-substituted succinic acid or anhydride compound (typically having at least 25 carbon atoms, such as 28 to 400 carbon atoms, in the hydrocarbon substituent), with at least one equivalent of with a polyhydroxy or polyamino compound (such as an alkylene amine) are particularly useful herein. Hydrocarbyl-substituted succinic acid and hydrocarbyl-substituted succinic anhydride derivatives may have a number average molecular weight of at least 400 g/mol, such as at least 900 g/mol, such as at least 1500 g/mol, such as from 400 and 4000 g/mol, such as from 800 to 3000, such as from 2000 and 2800 g/mol, such from about 2100 to 2500 g/mol, and such as from about 2200 to about 2400 g/mol.

Succinimides, which are particularly useful herein, are formed by the condensation reaction between: 1) hydrocarbyl substituted succinic anhydrides, such as polyisobutylene succinic anhydride (PIBSA); and 2) polyamine (PAM). Examples of suitable polyamines include: polyalkylene polyamines, hydroxy-substituted polyamines, polyoxyalkylene polyamines, and combinations thereof. Examples of polyalkylene polyamines include tetraethylene pentamine, pentaethylene hexamine, tetraethylenepentamine (TEPA), pentaethylenehaxamine (PEHA), and other polyamines having an average of 5, 6, 7, 8, or 9 nitrogen atoms per molecule). Mixtures where the average number of nitrogen atoms per polyamine molecule is greater than 7 are commonly called heavy polyamines or H-PAMs and may be commercially available under trade names such as HPA™ and HPA-X™ from DowChemical, E100™ from Huntsman Chemical, et al. Examples of hydroxy-substituted polyamines include N-hydroxyalkyl-alkylene polyamines such as N-(2-hydroxyethyl)ethylene diamine, N-(2-hydroxyethyl)piperazine, and/or N-hydroxyalkylated alkylene diamines of the type described, for example, in U.S. Pat. No. 4,873,009. Examples of polyoxyalkylene polyamines include polyoxyethylene and/or polyoxypropylene diamines and triamines (as well as co-oligomers thereof) having an average Mn from about 200 to about 5000 g/mol. Products of this type are commercially available under the tradename Jeffamine™. Representative examples of useful succinimides are shown in U.S. Pat. Nos. 3,087,936; 3,172,892; 3,219,666; 3,272,746; 3,322,670; 3,652,616; 3,948,800; 6,821,307; and Canada Patent No. 1,094,044.

Succinate esters useful as dispersants include those formed by the condensation reaction between hydrocarbyl substituted succinic anhydrides and alcohols or polyols. For example, the condensation product of a hydrocarbyl substituted succinic anhydride and pentaerythritol is a useful dispersant.

Succinate ester amides useful herein are formed by a condensation reaction between hydrocarbyl substituted succinic anhydrides and alkanol amines. Suitable alkanol amines include ethoxylated polyalkylpolyamines, propoxylated polyalkylpolyamines, and polyalkenylpolyamines such as polyethylene polyamines and or propoxylated hexamethylenediamine. Representative examples are shown in U.S. Pat. No. 4,426,305.

Hydrocarbyl substituted succinic anhydrides (such as PIBSA) esters of hydrocarbyl bridged aryloxy alcohols are also useful as dispersants herein. For information on such dispersants, please see U.S. Pat. No. 7,485,603, particularly, column 2, line 65 to column 6, line 22 and column 23, line 40 to column 26, line 46. In particular PIBSA esters of methylene-bridged naphthyloxy ethanol (i.e., 2-hydroxyethyl-1-naphthol ether (or hydroxy-terminated ethylene oxide oligomer ether of naphthol) are useful herein.

The molecular weight of the hydrocarbyl substituted succinic anhydrides used in the preceding paragraphs will typically range from 350 to 4000 g/mol, such as 400 to 3000 g/mol, such as 450 to 2800 g/mol, such as 800 to 2500 g/mol. The above (poly)alkenylsuccinic derivatives can be post-reacted with various reagents such as sulfur, oxygen, formaldehyde, carboxylic acids such as oleic acid.

The above (poly)alkenylsuccinic derivatives and/or functionalized olefin polymers, can also be post reacted with boron compounds such as boric acid, borate esters or highly borated dispersants, to form borated dispersants generally having from about 0.1 to about 5 moles of boron per mole of dispersant reaction product.

Dispersants useful herein include borated succinimides, including those derivatives from mono-succinimides, bis-succinimides, and/or mixtures of mono- and bis-succinimides, wherein the hydrocarbyl succinimide is derived from a hydrocarbylene group such as polyisobutylene having a Mn of from about 300 to about 5000 g/mol, or from about 500 to about 3000 g/mol, or about 1000 to about 2000 g/mol, or a mixture of such hydrocarbylene groups, often with high terminal vinylic groups.

The boron-containing dispersant may be present at 0.01 mass % to 20 mass %, or 0.1 mass % to 15 mass %, or 0.1 mass % to 10 mass %, or 0.5 mass % to 8 mass %, or 1.0 mass % to 6.5 mass %, or 0.5 mass % to 2.2 mass % of the lubricating composition.

The boron-containing dispersant may be present in an amount to deliver boron to the composition at 15 ppm to 2000 ppm, or 25 ppm to 1000 ppm, or 40 ppm to 600 ppm, or 80 ppm to 350 ppm.

The borated dispersant may be used in combination with non-borated dispersant and may be the same or different compound as the non-borated dispersant. In one embodiment, the lubricating composition may include one or more boron-containing dispersants and one or more non-borated dispersants, wherein the total amount of dispersant may be 0.01 mass % to 20 mass %, or 0.1 mass % to 15 mass %, or 0.1 mass % to 10 mass %, or 0.5 mass % to 8 mass %, or 1.0 mass % to 6.5 mass %, or 0.5 mass % to 2.2 mass % of the lubricating composition and wherein the ratio of borated dispersant to non-boronated dispersant may be 1:10 to 10:1 (weight:weight) or 1:5 to 3:1 or 1:3 to 2:1.

Dispersants of Mannich Bases

Mannich base dispersants useful herein are typically made from the reaction of an amine component, a hydroxy aromatic compound (substituted or unsubstituted, such as alkyl substituted), such as alkylphenols, and an aldehyde, such as formaldehyde. See U.S. Pat. Nos. 4,767,551 and 10,899,986. Process aids and catalysts, such as oleic acid and sulfonic acids, can also be part of the reaction mixture. Representative examples are shown in U.S. Pat. Nos. 3,697,574; 3,703,536; 3,704,308; 3,751,365; 3,756,953; 3,798,165; 3,803,039; 4,231,759 9,938,479; 7,491,248; 10,899,986, and WO 01/42399.

Dispersants of Polymethacrylate or Polyacrylate Derivatives

Polymethacrylate or polyacrylate derivatives are another class of dispersants useful herein. These dispersants are typically prepared by reacting a nitrogen containing monomer and a methacrylic or acrylic acid esters containing 5-25 carbon atoms in the ester group. Representative examples are shown in U.S. Pat. Nos. 2,100,993, and 6,323,164. Polymethacrylate and polyacrylate dispersants are typically lower molecular weights.

The lubricating composition of the invention typically comprises dispersant at 0.1 mass % to 20 mass % of the composition, such as 0.2 to 15 mass %, such as 0.25 to 10 mass %, such as 0.3 to 5 mass %, such as 1.0 mass % to 3.0 mass % of the lubricating oil composition. Alternately the dispersant may be present at 0.1 mass % to 5 mass %, or 0.01 mass % to 4 mass %, or 0.05 mass % to 2 mass % of the lubricating composition.

For further information on dispersants useful herein, please see U.S. Pat. No. 10,829,712 column 13, line 36 to column 16, line 67; and U.S. Pat. No. 7,485,603, column 2, line 65 to column 6, line 22, column 8, line 25 to column 14, line 53, and column 23, line 40 to column 26, line 46.

J. Corrosion Inhibitors/Antirust Agents

Corrosion inhibitors may be used to reduce the corrosion of metals and are often alternatively referred to as metal deactivators or metal passivators. Some corrosion inhibitors may alternatively be characterized as antioxidants.

Suitable corrosion inhibitors may include nitrogen and/or sulfur containing heterocyclic compounds such as triazoles (e.g., benzotriazoles), substituted thiadiazoles, imidazoles, thiazoles, tetrazoles, hydroxyquinolines, oxazolines, imidazolines, thiophenes, indoles, indazoles, quinolines, benzoxazines, dithiols, oxazoles, oxatriazoles, pyridines, piperazines, triazines and derivatives of any one or more thereof. A particular corrosion inhibitor is a benzotriazole represented by the structure:

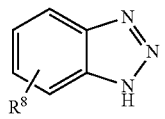

wherein $R^8$ is absent (hydrogen) or is a $C_1$ to $C_{20}$ hydrocarbyl or substituted hydrocarbyl group which may be linear or branched, saturated or unsaturated. It may contain ring structures that are alkyl or aromatic in nature and/or contain heteroatoms such as N, O, or S. Examples of suitable compounds may include benzotriazole, alkyl-substituted benzotriazoles (e.g., tolyltriazole, ethylbenzotriazole, hexylbenzotriazole, octylbenzotriazole, etc.), aryl substituted benzotriazole, alkylaryl- or arylalkyl-substituted benzotriazoles, and the like, as well as combinations thereof. For instance, the triazole may comprise or be a benzotriazole and/or an alkylbenzotriazole in which the alkyl group contains from 1 to about 20 carbon atoms or from 1 to about 8 carbon atoms. Non-limiting examples of such corrosion inhibitors may comprise or be benzotriazole, tolyltriazole, and/or optionally substituted benzotriazoles such as Irgamet™ 39, which is commercially available from BASF of Ludwigshafen, Germany. A preferred corrosion inhibitor may comprise or be benzotriazole and/or tolyltriazole.

Additionally or alternatively, the corrosion inhibitor may include a substituted thiadiazoles represented by the structure:

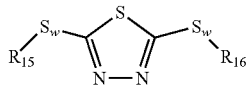

wherein $R^{15}$ and $R^{16}$ are independently hydrogen or a hydrocarbon group, which group may be aliphatic or aromatic, including cyclic, alicyclic, aralkyl, aryl and alkaryl, and wherein each w is independently 1, 2, 3, 4, 5, or 6 (preferably 2, 3, or 4, such as 2). These substituted thiadiazoles are derived from the 2,5-dimercapto-1,3,4-thiadiazole (DMTD) molecule. Many derivatives of DMTD have been described in the art, and any such compounds may be included in the fluid used in the present disclosure. For example, U.S. Pat. Nos. 2,719,125, 2,719,126, and 3,087,937 describe the preparation of various 2, 5-bis-(hydrocarbon dithio)-1,3,4-thiadiazoles.

Further additionally or alternatively, the corrosion inhibitor may include one or more other derivatives of DMTD, such as a carboxylic ester in which $R^{15}$ and $R^{16}$ may be joined to the sulfide sulfur atom through a carbonyl group. Preparation of these thioester containing DMTD derivatives is described, for example, in U.S. Pat. No. 2,760,933. DMTD derivatives produced by condensation of DMTD with alpha-halogenated aliphatic carboxylic acids having at least 10 carbon atoms are described, for example, in U.S. Pat. No. 2,836,564. This process produces DMTD derivatives wherein $R^{15}$ and $R^{16}$ are HOOC—CH($R^{19}$)—($R^{19}$ being a hydrocarbyl group). DMTD derivatives further produced by amidation or esterification of these terminal carboxylic acid groups may also be useful.

The preparation of 2-hydrocarbyldithio-5-mercapto-1,3,4-thiadiazoles is described, for example, in U.S. Pat. No. 3,663,561.

A class of DMTD derivatives may include mixtures of a 2-hydrocarbyldithio-5-mercapto-1,3,4-thiadiazole and a 2,5-bis-hydrocarbyldithio-1,3,4-thiadiazole. Such mixtures may be sold under the tradename HiTEC® 4313 and are commercially available from Afton Chemical Company.

The preparation of 2-hydrocarbyldithio-5-mercapto-1,3,4-thiadiazoles is described, for example, in U.S. Pat. No. 3,663,561.

A class of DMTD derivatives may include mixtures of a 2-hydrocarbyldithio-5-mercapto-1,3,4-thiadiazole and a 2,5-bis-hydrocarbyldithio-1,3,4-thiadiazole. Such mixtures may be sold under the tradename HiTEC™ 4313 and are commercially available from Afton Chemical Company.

Still further additionally or alternatively, the corrosion inhibitor may include a trifunctional borate having the structure, $B(OR^{46})_3$, in which each $R^{46}$ may be the same or different. As the borate may typically be desirably compatible with the non-aqueous medium of the composition, each $R^{46}$ may in particular comprise or be a hydrocarbyl $C_1$-$C_8$ moiety. For compositions in which the non-aqueous medium comprises or is a lubricating oil basestock, for example, better compatibility can typically be achieved when the hydrocarbyl moieties are each at least $C_4$. Non-limiting examples of such corrosion inhibitors thus include, but are not limited to, triethylborate, tripropylborates such as triisopropylborate, tributylborates such as tri-tert-butylborate, tripentylborates, trihexylborates, trioctylborates such as tri-(2-ethylhexyl)borate, monohexyl dibutylborate, and the like, as well as combinations thereof.

When used, a corrosion inhibitor may comprise a substituted thiadiazole, a substituted benzotriazole, a substituted triazole, a trisubstituted borate, or a combination thereof.

When desired, corrosion inhibitors can be used in any effective amount, but, when used, may typically be used in amounts from about 0.001 mass % to 5.0 mass %, based on the weight of the composition, e.g., from 0.005 mass % to 3.0 mass % or from 0.01 mass % to 1.0 mass %. Alternately, Such additives may be used in an amount of about 0.01 to 5 weight percent, preferably about 0.01 to 1.5 weight percent, based upon the weight of the lubricating composition.

In some embodiments, 3,4-oxypyridinone-containing compositions may contain substantially no (e.g., 0, or less than 0.001 mass %, 0.0005 mass % or less, not intentionally added, and/or absolutely no) triazoles, benzotriazoles, substituted thiadiazoles, imidazoles, thiazoles, tetrazoles, hydroxyquinolines, oxazolines, imidazolines, thiophenes, indoles, indazoles, quinolines, benzoxazines, dithiols, oxazoles, oxatriazoles, pyridines, piperazines, triazines, derivatives thereof, combinations thereof, or all corrosion inhibitors.

K. Anti-Wear Agents (Component K)

Anti-wear agents described herein exclude compounds represented by the formula (I) in section G above. Compositions according to the present disclosure may contain an additive having a different enumerated function that also has secondary effects as an anti-wear (for example, organo-molybdenum friction modifiers (such as molybdenum dithiocarbamates, dialkyldithiophosphates, alkyl xanthates and alkylthioxanthates) may also have anti-wear effects). These additives are not included as anti-wear additives for purposes of determining the amount of anti-wear additives in a lubricating oil composition or concentrate herein.

The lubricating oil composition of the present invention can contain one or more anti-wear agents that can reduce friction and excessive wear. Any anti-wear agent known by a person of ordinary skill in the art may be used in the lubricating oil composition. Non-limiting examples of suitable anti-wear agents include zinc dithiophosphate, metal (e.g., Pb, Sb, Mo and the like) salts of dithiophosphates, metal (e.g., Zn, Pb, Sb, Mo and the like) salts of dithiocarbamates, metal (e.g., Zn, Pb, Sb and the like) salts of fatty acids, boron compounds, phosphate esters, phosphite esters, amine salts of phosphoric acid esters or thiophosphoric acid esters, reaction products of dicyclopentadiene and thiophosphoric acids and combinations thereof. The amount of the anti-wear agent may vary from about 0.01 mass % to about 5 mass %, from about 0.05 mass % to about 3 mass %, or from about 0.1 mass % to about 1 mass %, based on the total weight of the lubricating oil composition.

In embodiments, the anti-wear agent is or comprises a dihydrocarbyl dithiophosphate metal salt, such as zinc dialkyl dithiophosphate compounds. The metal of the dihydrocarbyl dithiophosphate metal salt may be an alkali or alkaline earth metal, or aluminum, lead, tin, molybdenum, manganese, nickel or copper. In some embodiments, the metal is zinc. In other embodiments, the alkyl group of the dihydrocarbyl dithiophosphate metal salt has from about 3 to about 22 carbon atoms, from about 3 to about 18 carbon atoms, from about 3 to about 12 carbon atoms, or from about 3 to about 8 carbon atoms. In further embodiments, the alkyl group is linear or branched.

In embodiments, the lubricating oil compositions described herein are absent added dihydrocarbyl dithiophosphate metal salt where the metal is copper.

Useful anti-wear agents also include substituted or unsubstituted thiophosphoric acids, and salts thereof include zinc-containing compounds such as zinc dithiophosphate compounds selected from zinc dialkyl-, diaryl- and/or alkylaryl-dithiophosphates.

A metal alkylthiophosphate and more particularly a metal dialkyl dithiophosphate in which the metal constituent is zinc, or zinc dialkyl dithiophosphate (ZDDP) can be a useful component of the lubricating compositions of this disclosure. ZDDP can be derived from primary alcohols, secondary alcohols or mixtures thereof. ZDDP compounds generally are of the formula $Zn[SP(S)(OR^1)(OR^2)]_2$ where $R^1$ and $R^2$ are $C_1$-$C_{18}$ alkyl groups, preferably C2-C12 alkyl groups. These alkyl groups may be straight chain or branched. Alcohols used in the ZDDP can be 2-propanol, butanol, secondary butanol, pentanols, hexanols such as 4-methyl-2-pentanol, n-hexanol, n-octanol, 2-ethyl hexanol, alkylated phenols, and the like. Mixtures of secondary alcohols or of primary and secondary alcohol can be used. Alkyl aryl groups may also be used. Useful zinc dithiophosphates include secondary zinc dithiophosphates such as those available from The Lubrizol Corporation under the trade designations "LZ 677A", "LZ 1095" and "LZ 1371", from Chevron Oronite under the trade designation "OLOA 262" and from Afton Chemical under the trade designation "HITEC™ 7169".

The ZDDP is typically used in amounts of from about 0.4 weight percent to about 1.2 weight percent, preferably from about 0.5 weight percent to about 1.0 weight percent, and more preferably from about 0.6 weight percent to about 0.8 weight percent, based on the total weight of the lubricating composition, although more or less can often be used advantageously. Preferably, the ZDDP is a secondary ZDDP and present in an amount of from about 0.6 to 1.0 weight percent of the total weight of the lubricating composition.

In embodiments, the zinc compound can be a zinc dithiocarbamate complex, such as the zinc dithiocarbamates represented by the formula:

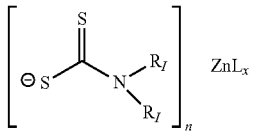

where each $R_1$ is independently a linear, cyclic, or branched, saturated or unsaturated, aliphatic hydrocarbon moiety having from 1 to about 10 carbon atoms, n is 0, 1, or 2, L is a ligand that saturates the coordination sphere of zinc, and x is 0, 1, 2, 3, or 4. In certain embodiments, the ligand, L, is selected from the group consisting of water, hydroxide, ammonia, amino, amido, alkylthiolate, halide, and combinations thereof.

The ZDDP and or the zinc carbamates are typically used in amounts of from about 0.4 weight percent to about 1.2 weight percent, preferably from about 0.5 weight percent to about 1.0 weight percent, and more preferably from about 0.6 weight percent to about 0.8 weight percent, based on the total weight of the lubricating composition, although more or less can often be used advantageously. Preferably, the ZDDP is a secondary ZDDP and present in an amount of from about 0.6 to 1.0 weight percent of the total weight of the lubricating composition.

Anti-wear additives useful herein also include boron-containing compounds, such as borate esters, borated fatty amines, borated epoxides, alkali metal (or mixed alkali metal or alkaline earth metal) borates and borated overbased metal salts.

L. Demulsifiers

Demulsifiers useful herein include those described in U.S. Pat. No. 10,829,712 (Col 20, In 34-40). Typically, a small amount of a demulsifying component may be used herein. A preferred demulsifying component is described in EP 330, 522. It is obtained by reacting an alkylene oxide with an adduct obtained by reacting a bis-epoxide with a polyhydric alcohol. Such additives may be used in an amount of about 0.001 to 5 weight percent, preferably about 0.01 to 2 weight percent.

M. Seal Compatibility Agents

Optional additives include seal compatibility agents such as organic phosphates, aromatic esters, aromatic hydrocarbons, esters (butylbenzyl phthalate, for example), and polybutenyl succinic anhydride. Such additives may be used in an amount of about 0.001 to 5 weight percent, preferably about 0.01 to 2 weight percent.

N. Extreme Pressure Agents.

The lubricating oil composition of the present invention can contain one or more extreme pressure agents that can prevent sliding metal surfaces from seizing under conditions of extreme pressure. Any extreme pressure agent known by a person of ordinary skill in the art may be used in the lubricating oil composition. Generally, the extreme pressure agent is a compound that can combine chemically with a metal to form a surface film that prevents the welding of asperities in opposing metal surfaces under high loads. Non-limiting examples of suitable extreme pressure agents include sulfurized animal or vegetable fats or oils, sulfurized animal or vegetable fatty acid esters, fully or partially esterified esters of trivalent or pentavalent acids of phosphorus, sulfurized olefins, dihydrocarbyl polysulfides, sulfurized Diels-Alder adducts, sulfurized dicyclopentadiene, sulfurized or co-sulfurized mixtures of fatty acid esters and monounsaturated olefins, co-sulfurized blends of fatty acid, fatty acid ester and alpha-olefin, functionally-substituted dihydrocarbyl polysulfides, thia-aldehydes, thia-ketones, epithio compounds, sulfur-containing acetal derivatives, co-sulfurized blends of terpene and acyclic olefins, and poly sulfide olefin products, amine salts of phosphoric acid esters or thiophosphoric acid esters and combinations thereof. The amount of the extreme pressure agent may vary from about 0.01 mass % to about 5 mass %, from about 0.05 mass % to about 3 mass %, or from about 0.1 mass % to about 1 mass %, based on the total weight of the lubricating oil composition.

O. Alpha-Olefins

In embodiments, the LOC comprises one or more alpha-olefins, such as linear alpha-olefins (LAO), having 8 to 36 carbon atoms, such as 8 to 24 carbon atoms, more preferably 10 to 20 carbon atoms, more preferably 12 to 20 carbon atoms, more preferably 14 to 18 carbon atoms. In embodiments, the base oil comprises mixtures of linear alpha-olefins, having 8 to 24 carbon atoms, more preferably 10 to 20 carbon atoms, more preferably 12 to 20 carbon atoms, more preferably 14 to 18 carbon atoms. In embodiments, the base oil comprises mixtures of linear alpha-olefins, having 14 or more carbon atoms. In embodiments, the LOC may comprise from 0.001 to 15 mass %, (in particular 0.15 to 10 mass %, alternately 0.20 mass % to 5 mass %, alternately 0.25 to 2 mass %) based upon the weight of the lubricating composition, of one or more $C_8$ to $C_{36}$ alpha olefins. In embodiments, the LOC may comprise from 0.001 to 15 mass %, (in particular 0.15 to 10 mass %, alternately 0.20 mass % to 5 mass %, alternately 0.25 to 2 mass %) based upon the weight of the lubricating composition, of one, two, three, four, five or more $C_8$ to $C_{36}$ alpha olefins, such linear alpha olefins having 8 to 24 carbon atoms, more preferably 10 to 20 carbon atoms, more preferably 12 to 20 carbon atoms, more preferably 14 to 18 carbon atoms.

When lubricating oil compositions contain one or more of the additives discussed above, the additive(s) are typically blended into the composition in an amount sufficient for it to perform its intended function. Typical amounts of such additives useful in the present disclosure, especially for use in crankcase lubricants, are shown the Tables below.

It is noted that many of the additives are shipped from the additive manufacturer as a concentrate, containing one or more additives together, with a certain amount of base oil or other diluents. Accordingly, the weight amounts in the Tables below, as well as other amounts mentioned herein, are directed to the amount of active ingredient (that is the non-diluent portion of the ingredient). The weight percent (mass %) indicated below is based on the total weight of the lubricating oil composition.

Typical Amounts of Optional Lubricating Oil Components in LOC

| ADDITIVE FORMULATIONS | A (mass %) | B (mass %) | C (mass %) |
|---|---|---|---|
| Dispersant (borated and non-borated) | 0.1-40 | 1-20 | 4 to 15 |

-continued

| ADDITIVE FORMULATIONS | A (mass %) | B (mass %) | C (mass %) |
|---|---|---|---|
| Detergents | 0.1-20 | 0.2-15 | 2 to 10 |
| Functionalized olefin copolymer | 0.1-15 | 0.5-5 | 1 to 5 |
| Amine and or phenol based Antioxidant | 0.01-7 | 0.10-5 | 1 to 5 |
| Sulfurized fatty acid ester | 0.01-20 | 0.1 to 10 | 0.5-5 |
| Molybdenum containing compound | 0.01-10 | 0.1 to 7 | 0.1 to 5 |
| Antifoaming Agent | 0.001-5 | 0.001-0.2 | 0.001-0.1 |
| Friction Modifier | 0-5 | 0-1.5 | 0.1 to 5 |
| Viscosity Modifier | 0.01-25 | 1-20 | 5-15 |
| LAO | 0.1 to 10 | 0.1 to 5 | 0.1 to 2.5 |
| Optional additional additives | 0-20 | 0.1-10 | 0.1-5 |
| Basestock (50 to 99 mass %) | Balance | Balance | Balance |

Typical Amounts of Optional Lubricating Oil Components in LOC (Continued)

| ADDITIVE FORMULATIONS | D (mass %) | E (mass %) | F (mass %) |
|---|---|---|---|
| Dispersant borated | 0.1-10 | 0.5-8 | 0.5-5 |
| Dispersant non-borated | 0.1 to 30 | 0.5 to 20 | 1 to 15 |
| Detergent Ca high TBN | 0.1-19.8 | 0.25-9 | 0.25 to 5 |
| Detergent Mg, preferably high TBN | 0.1-19.8 | 0.5-8 | 0.5 to 5 |
| Detergent Ca low TBN | 0.1-9.8 | 0.5-8 | 0.5 to 5 |
| Functionalized olefin copolymer | 0.1-15 | 0.5-5 | 0.5 to 3 |
| Amine and or phenol (preferably amine) based antioxidant | 0.01-7 | 0.10-5 | 1 to 5 |
| Sulfurized fatty acid ester | 0.01-20 | 0.1 to 10 | 0.5-5 |
| Molybdenum containing compound | 0.01-10 | 0.1 to 7 | 0.1 to 5 |
| Antifoaming Agent | 0.001-5 | 0.001-0.2 | 0.001-0.1 |
| Friction Modifier | 0-5 | 0-1.5 | 0.1 to 5 |
| Viscosity Modifier | 0.01-25 | 1-20 | 5-15 |
| LAO | 0.1 to 10 | 0.1 to 5 | 0.1 to 2.5 |
| Optional additional additives | 0-20 | 0.1-10 | 0.1-10 |
| Basestock (50 to 99 mass %) | Balance | Balance | Balance |

The compositions described here, such as those it the Tables above, may have a Kv 100 of 9.3 to less than 12.5 cSt and an HTHS150 of at least 2.9 cP.

The foregoing additives are typically commercially available materials. These additives may be added independently but are usually pre-combined in packages which can be obtained from suppliers of lubricant oil additives. Additive packages with a variety of ingredients, proportions and characteristics are available and selection of the appropriate package will take the use of the ultimate composition into account.

Fuels

This invention also relates to a method of lubricating an automotive internal combustion engine during operation of the engine comprising:

(i) providing to a crankcase of the automotive internal combustion engine a lubricating composition of described herein, (ii) providing a hydrocarbon fuel in the automotive internal combustion engine; and (iii) combusting the fuel in the automotive internal combustion engine, such as a spark-ignited or compression-ignited two- or four-stroke reciprocating engine, such as a diesel engine or passenger car engine (such as a spark-ignited combustion engine).

This invention also relates to a fuel composition comprising the lubricating oil compositions described herein and a hydrocarbon fuel, wherein the fuel may be derived from petroleum and or biological sources ("biofuel" or "renewable fuel"). In embodiments, the fuel comprises from 0.1 to 100 mass % renewable fuel, alternately from 1 to 75 mass % renewable fuel, alternately from 5 to 50 mass % renewable fuel, based upon the total mass of the from 1 to 50 mass % renewable fuel and the petroleum derived fuel.

In embodiments, this invention relates to a fuel composition comprising the lubricating oil composition described herein and a hydrocarbon fuel, optionally the hydrocarbon fuel is derived from petroleum sources and or renewable (such as biological) sources.

The renewable fuel component is typically produced from vegetable oil (such as palm oil, rapeseed oil, soybean oil, jatropha oil), microbial oil (such as algae oil), animal fats (such as cooking oil, animal fat, and/or fish fat) and or biogas. Renewable fuel refers to biofuel produced from biological resources formed through contemporary biological processes. In an embodiment, the renewable fuel component is produced by means of a hydrotreatment process. Hydrotreatment involves various reactions where molecular hydrogen reacts with other components, or the components undergo molecular conversions in the presence of molecular hydrogen and a solid catalyst. The reactions include, but are not limited to, hydrogenation, hydrodeoxygenation, hydrodesulfurization, hydrodenitrification, hydrodemetallization, hydrocracking, and isomerization. The renewable fuel component may have different distillation ranges which provide the desired properties to the component, depending on the intended use.

Uses

The lubricating compositions of the invention may be used to lubricate mechanical engine components, particularly in internal combustion engines, e.g. spark-ignited or compression-ignited two- or four-stroke reciprocating engines, by adding the lubricant thereto. Typically, they are crankcase lubricants such as passenger car motor oils, light duty diesel engine lubricants, or heavy duty diesel engine lubricants.

In particular, the lubricating compositions of the present invention are suitably used in the lubrication of the crankcase of a compression-ignited (or spark assisted compression ignited) internal combustion engine, such as a light duty diesel engine, a heavy duty diesel engine, or an automotive diesel engine.

In particular, the lubricating compositions of the present invention are suitably used in the lubrication of the crankcase of a spark-ignited turbo charged internal combustion engine.

This invention further relates to:

1. A lubricating oil composition comprising or resulting from the admixing of:

a) 50 to 99 mass %, based upon the weight of the lubricating composition, of one or more base oils;

b) 0.1 to 15 mass %, based on total weight of the lubricating composition, of one or more functionalized olefin copolymer having an Mn of from 10,000 to about 35,000 g/mol, c) 0.1 to 20 mass %, based on total weight of the lubricating composition, of one or more detergents wherein the detergent comprises at least one calcium detergent having a TBN of more than 100 mg KOH/g; at least one calcium detergent having a TBN of 100 mg KOH/g or less; and at least one magnesium detergent, where the difference in the TBN's for the Ca detergent having a TBN of 100 mg KOH/g or less and Ca detergent having a TBN of more than 100 mg KOH/g is at least 100 mg KOH/g;

d) 0.01 to 40 mass %, based on total weight of the lubricating composition, of one or more dispersants wherein the dispersants comprise at least one borated dispersant and at least one non borated dispersant;

e) 0.01 to 20 mass %, based upon the weight of the lubricating composition, sulfurized fatty acid ester;

f) 0.01 to 10 mass %, based upon the weight of the lubricating composition, molybdenum containing compound;

g) 0.01 to 10 mass %, based upon the weight of the lubricating composition, of one or more amine or phenol based antioxidants, and where the lubricating oil composition has:

1) a sulfated ash (ASTM D874) content of 0.9 mass % or less;

2) a Mack T-11 final soot %@15 cSt (ASTM D7156-19) of 6.7% or more;

3) a total base number (ASTM D2896) of 5 to 30 mg KOH/g;

4) an HTCBT (ASTM D6594) copper level increase of 20 ppm or less;

5) a T-13 IR peak at end of test (ASTM D 8048) of 40 absorbance per cm or less; and 6) a Cam wear outlet (CEC OM646LA (CEC L-99-08)) of 45 μm or less.

2. The lubricating oil composition of paragraph 1, wherein the lubricating oil composition further comprises one, two, three, four, five, or all six of:

i) 0.01 to 5 mass %, based on total weight of the lubricating composition, of one or more friction modifiers other than e) the sulfurized fatty acid ester and f) molybdenum containing compound;

ii) 0.001 to 10 mass %, based on total weight of the lubricating composition, of one or more anti-wear agents;

iii) 0.01 to 5 mass %, based on total weight of the lubricating composition, of one or more pour point depressants;

iv) 0.001 to 5 mass %, based on total weight of the lubricating composition of one or more anti-foam agents;

v) 0.001 to 10 mass %, based on total weight of the lubricating composition, of one or more viscosity modifiers; and vi) 0.01 to 5 mass %, based on total weight of the lubricating composition, of one or more inhibitors and/or antirust agents.

3. The lubricating oil composition of paragraph 1 or 2, wherein the lubricating oil composition has:

1) a sulfated ash (ASTM D874) content of 0.85 mass % or less;

2) a Mack T-11 final soot %@15 cSt (ASTM D7156-19) of 7% or more;

3) a total base number (ASTM D2896) of 5 to 20 mg KOH/g;

4) an HTCBT (ASTM D6594) copper level increase of 10 ppm less;

5) aT-13 IR peak at end of test (ASTM D 8048) of 30 absorbance per cm or less; and 6) a Cam wear outlet (CEC OM646LA (CEC L-99-08)) of 35 μm or less.

4. The lubricating oil composition of paragraph 1, 2, or 3 wherein the lubricating oil composition has:

a) an HTCBT (ASTM D6594) copper level increase of 10 ppm less;

b) aT-13 IR peak at end of test (ASTM D 8048) of 30 absorbance per cm or less; and c) a Cam wear outlet (CEC 0M646LA (CEC L-99-08)) of 25 μm or less.

5. The lubricating oil composition of any of paragraphs 1 to 4, wherein the lubricating oil composition further comprises 0.001 to 15 mass %, based upon the weight of the lubricating composition, of one or more $C_8$ to $C_{36}$ linear alpha olefins.

6. The lubricating oil composition of any of paragraphs 1 to 5, wherein the lubricating oil composition further comprises 0.001 to 15 mass %, based upon the weight of the lubricating composition, of one or more polyisobutylene succinic anhydrides.

7. The lubricating oil composition of any of paragraphs 1 to 6, wherein the lubricating oil composition further comprises 0.001 to 15 mass %, based upon the weight of the lubricating composition, of one or more zinc dialkyl dithiophosphates (ZDDP) which are optionally derived from primary alcohols, secondary alcohols or mixtures thereof.

8. The lubricating oil composition of any of paragraphs 1 to 7, wherein the lubricating oil composition further comprises from 0.001 to 10 mass %, based upon the weight of the lubricating composition, of one or more Mo containing compound providing from 600-1500 ppm of molybdenum atoms to the lubricating oil composition.

9. The lubricating oil composition of any of paragraphs 1 to 8 wherein the lubricating oil composition further comprises from 0.001 to 15 mass %, based upon the weight of the lubricating composition, of pour point depressant.

10. The lubricating oil composition of any of paragraphs 1 to 9 wherein the lubricating oil composition further comprises 0.001 to 15 mass %, based upon the weight of the lubricating composition, of pour point depressant selected from the group consisting of copolymers of dialkyl fumarate and vinyl acetate.

11. The lubricating oil composition of any of paragraphs 1 to 10, wherein the lubricating oil composition further comprises from 0.01 to 10 mass %, based upon the weight of the lubricating composition, of one or more viscosity modifiers selected from polyacrylate, polymethacrylate, ethylene propylene copolymers, hydrogenated styrene-diene block copolymers, hydrogenated block copolymers of styrene and isoprene, hydrogenated block copolymers of styrene and isobutylene, hydrogenated polyisoprene star polymers and polyacrylates.

12. The lubricating oil composition of any of paragraphs 1 to 11, wherein the lubricating oil composition further comprises from 0.001 to 15 mass %, based upon the weight of the lubricating composition, of hydrogenated styrene-diene block copolymer.

13. The lubricating oil composition of any of paragraphs 1 to 12, wherein the dispersant comprises one or more borated PIBSA-PAM dispersant and one or more non-borated PIBSA-PAM dispersant.

14. The lubricating oil composition of any of paragraphs 1 to 13, wherein the detergent comprises Ca alkyl salicylate having a TBN of 200 mg KOH/g or more; Ca alkyl salicylate having a TBN of 100 mg KOH/g or less; and Mg sulfonate detergent having a TBN of 250 mg KOH/g or more, where the difference in the TBN's for the Ca alkyl salicylate having a TBN of 100 mg KOH/g or less and Ca alkyl salicylate having a TBN of 200 mg KOH/g is at least 200 mg KOH/g.

15. The lubricating oil composition of any of paragraphs 1 to 14, wherein the detergent comprises:

Ca alkyl salicylate having a TBN of more than 100 mg KOH/g;

Ca alkyl salicylate having a TBN of 100 mg KOH/g or less; and

Mg sulfonate detergent having a TBN of 250 mg KOH/g or more, where the difference in the TBN's for the Ca alkyl salicylate having a TBN of 100 mg KOH/g or less and Ca alkyl salicylate having a TBN of more than 100 mg KOH/g is at least 250 mg KOH/g.

16. The lubricating oil composition of any of paragraphs 1 to 15, wherein the sulfurized fatty acid ester comprises one or more sulfurized fatty acid methyl esters.

17. The lubricating oil composition of any of paragraphs 1 to 16, wherein the sulfurized fatty acid ester is derived from sulfurized palm oil, corn oil, grapeseed oil, coconut oil, cottonseed oil, wheatgerm oil, soya oil, safflower oil, olive oil, peanut oil, rapeseed oil and sunflower oil, or an animal oil (e.g. glycerol ester or trans-esterification product) such as tallow oil or lard oil.

18. The lubricating oil composition of any of paragraphs 1 to 17, wherein the sulfurized fatty acid ester comprises one or more of sulfurized lard oil and palm oil fatty acid methyl ester, and sulfurized rapeseed fatty acid methyl ester.

19. The lubricating oil composition of any of paragraphs 1 to 18, wherein the functionalized olefin copolymer comprises an amine functionalized ethylene propylene copolymer having an Mn of 15,000 to 30,000 g/mol.

20. The lubricating composition according of any of paragraphs 1 to 19, wherein the lubricating composition is a heavy-duty diesel engine oil.

21. The lubricating oil composition of any of paragraphs 1 to 20, wherein the lubricating oil composition has an HTCBT (ASTM D6594) copper level increase of 10 ppm less.

22. The lubricating oil composition of any of paragraphs 1 to 21, wherein the lubricating oil composition has aT-13 IR peak at end of test (ASTM D 8048) of 30 absorbance per cm or less.

23. The lubricating oil composition of any of paragraphs 1 to 22, wherein the lubricating oil composition has a Cam wear outlet (CEC OM646LA (CEC L-99-08)) of 25 μm or less.

24. The lubricating oil composition of any of paragraphs 1 to 23, wherein the lubricating oil composition has aT-13 IR peak at end of test (ASTM D 8048) of 30 absorbance per cm or less and a Cam wear outlet (CEC OM646LA (CEC L-99-08)) of 25 μm or less.

25. The lubricating oil composition of any of paragraphs 1 to 24, wherein the lubricating oil composition is identified by the viscometric descriptor 0W-16, 0W-20, 5W-20, 5W-30, 10W-30, or 10W-40.

26. A method of lubricating an automotive internal combustion engine during operation of the engine comprising:

(i) providing to a crankcase of the automotive internal combustion engine an automotive crankcase the lubricating composition of any of paragraphs 1 to 25;

(ii) providing a fuel, such as hydrocarbon fuel, in the automotive internal combustion engine; and (iii) combusting the fuel in the automotive internal combustion engine.

27. A method of lubricating an automotive internal combustion diesel engine during operation of the diesel engine comprising:

(i) providing to a crankcase of the automotive internal combustion diesel engine an automotive crankcase the lubricating composition of any of paragraphs 1 to 25;

(ii) providing a hydrocarbon fuel in the automotive internal combustion diesel engine; and (iii) combusting the fuel in the automotive internal combustion diesel engine.

28. A fuel composition comprising the composition of any of paragraphs 1 to 25 and a hydrocarbon fuel.

29. The fuel composition of paragraph 28 wherein a portion of the fuel is derived from petroleum sources.

30. The fuel composition of paragraph 28 wherein at least a portion of the fuel is derived from renewable sources.

31. The fuel composition of paragraph 28 wherein at least a portion of the fuel is derived from biological sources and a portion of the fuel is derived from petroleum sources.

32. A concentrate comprising or resulting from the admixing of:

a) from 1 to less than 50 mass %, based upon the weight of concentrate, of one or more base oils;

b) from 0.1 to 15 mass %, based upon the weight of concentrate, of one or more functionalized olefin copolymer having an Mn of from 10,000 to about 35,000 g/mol;

c) from 0.10 to 20 mass %, based upon the weight of concentrate, of one or more detergents wherein the detergent comprises at least one calcium detergent having a TBN of more than 100 mg KOH/g; at least one calcium detergent having a TBN of 100 mg KOH/g or less; and at least on magnesium detergent, where the difference in the TBN's for the Ca detergent having a TBN of 100 mg KOH/g or less and Ca detergent having a TBN of more than 100 mg KOH/g is at least 100 mg KOH/g;

d) from 0.01 to 40 mass %, based on total weight of the lubricating composition, of one or more dispersants wherein the dispersants comprise at least one borated dispersant and at least one non borated dispersant;

e) 0.01 to 20 mass %, based upon the weight of concentrate, of sulfurized fatty acid ester;

f) 0.01 to 25 mass %, based upon the weight of concentrate, of one or more amine or phenol based antioxidants; and g) 0.01 to 15 mass %, based upon the weight of concentrate, molybdenum containing compound.

33. A method to prepare a concentrate (such as the concentrate of paragraph 32), comprising combining:

a) from 1 to less than 50 mass %, based upon the weight of concentrate, of one or more base oils;

b) from 0.1 to 15 mass %, based upon the weight of concentrate, of one or more functionalized olefin copolymer having an Mn of from 10,000 to about 35,000 g/mol;

c) from 0.10 to 20 mass %, based upon the weight of concentrate, of one or more detergents wherein the detergent comprises at least one calcium detergent having a TBN of more than 100 mg KOH/g; at least one calcium detergent having a TBN of 100 mg KOH/g or less; and at least on magnesium detergent, where the difference in the TBN's for the Ca detergent having a TBN of 100 mg KOH/g or less and Ca detergent having a TBN of more than 100 mg KOH/g is at least 100 mg KOH/g;

d) from 0.01 to 40 mass %, based upon the weight of concentrate, of one or more dispersants wherein the dispersants comprise at least one borated dispersant and at least one non borated dispersant;

e) 0.01 to 20 mass %, based upon the weight of concentrate, of sulfurized fatty acid ester;

f) 0.01 to 25 mass %, based upon the weight of concentrate, of one or more amine or phenol based antioxidants; and g) 0.01 to 15 mass %, based upon the weight of concentrate, molybdenum containing compound.

34. A method to prepare a lubricating oil composition (such as the lubricating oil composition of paragraphs 1 to 25) comprising combining:

a) 50 to 99 mass %, based upon the weight of the lubricating composition, of one or more base oils;

b) 0.1 to 15 mass %, based on total weight of the lubricating composition, of one or more functionalized olefin copolymer having an Mn of from 10,000 to about 35,000 g/mol;

c) 0.1 to 20 mass %, based on total weight of the lubricating composition, of one or more detergents wherein the detergent comprises at least one calcium detergent having a TBN of more than 100 mg KOH/g; at least one calcium detergent having a TBN of 100 mg KOH/g or less; and at least one magnesium detergent, where the difference in the TBN's for the Ca detergent having a TBN of 100 mg KOH/g or less and Ca detergent having a TBN of more than 100 mg KOH/g is at least 100 mg KOH/g;

d) 0.01 to 40 mass %, based on total weight of the lubricating composition, of one or more dispersants wherein the dispersants comprise at least one borated dispersant and at least one non borated dispersant;

e) 0.01 to 20 mass %, based upon the weight of the lubricating composition, of sulfurized fatty acid ester;

f) 0.01 to 10 mass %, based upon the weight of the lubricating composition, molybdenum containing compound; and g) 0.01 to 10 mass %, based upon the weight of the lubricating composition, of one or more amine or phenol based antioxidants.

35. The method of paragraph 34, comprising additionally combining, with components a), b), c), d), e), f), and g), with one, two, three, four, five, or all six of:

i) 0.01 to 5 mass %, based on total weight of the lubricating composition, of one or more friction modifiers other than e) the sulfurized fatty acid ester and f) molybdenum containing compound;

ii) 0.001 to 10 mass %, based on total weight of the lubricating composition, of one or more anti-wear agents;

iii) 0.01 to 5 mass %, based on total weight of the lubricating composition, of one or more pour point depressants;

iv) 0.001 to 5 mass %, based on total weight of the lubricating composition of one or more anti-foam agents;

v) 0.001 to 10 mass %, based on total weight of the lubricating composition, of one or more viscosity modifiers; and vi) 0.01 to 5 mass %, based on total weight of the lubricating composition, of one or more inhibitors and/or antirust agents.

36. The method of paragraph 34, comprising additionally combining, with components a), b), c), d), e), f), and g), with one, two, three, four, five, six or all seven of:

1) 0.001 to 15 mass %, based upon the weight of the lubricating composition, of one or more $C_8$ to $C_{36}$ linear alpha olefins;

2) 0.001 to 15 mass %, based upon the weight of the lubricating composition, of one or more polyisobutylene succinic anhydrides;

3) 0.001 to 15 mass %, based upon the weight of the lubricating composition, of one or more zinc dialkyl dithiophosphates (ZDDP) which are optionally derived from primary alcohols, secondary alcohols or mixtures thereof;
4) 0.001 to 10 mass %, based upon the weight of the lubricating composition, of one or more Mo containing compound providing from 600-1500 ppm of molybdenum atoms to the lubricating oil composition;
5) 0.001 to 15 mass %, based upon the weight of the lubricating composition, of pour point depressant, preferably selected from the group consisting of copolymers of dialkyl fumarate and vinyl acetate;
6) 0.01 to 10 mass %, based upon the weight of the lubricating composition, of one or more viscosity modifiers selected from polyacrylate, polymethacrylate, ethylene propylene copolymers, hydrogenated styrene-diene block copolymers, hydrogenated block copolymers of styrene and isoprene, hydrogenated block copolymers of styrene and isobutylene, hydrogenated polyisoprene star polymers and polyacrylates; and or
7) 0.001 to 15 mass %, based upon the weight of the lubricating composition, of hydrogenated styrene-diene block copolymer.

37. The method of any of paragraphs 33 to 36, wherein the dispersant comprises one or more borated PIBSA-PAM dispersant and one or more non-borated PIB SA-PAM dispersant.

38. The method of any of paragraphs 33 to 37, wherein the detergent comprises Ca alkyl salicylate having a TBN of 200 mg KOH/g or more; Ca alkyl salicylate having a TBN of 100 mg KOH/g or less; and Mg sulfonate detergent having a TBN of 250 mg KOH/g or more, where the difference in the TBN's for the Ca alkyl salicylate having a TBN of 100 mg KOH/g or less and Ca alkyl salicylate having a TBN of 200 mg KOH/g is at least 200 mg KOH/g.

39. The method of any of paragraphs 33 to 38, wherein the detergent comprises:

Ca alkyl salicylate having a TBN of more than 100 mg KOH/g;

Ca alkyl salicylate having a TBN of 100 mg KOH/g or less; and

Mg sulfonate detergent having a TBN of 250 mg KOH/g or more, where the difference in the TBN's for the Ca alkyl salicylate having a TBN of 100 mg KOH/g or less and Ca alkyl salicylate having a TBN of more than 100 mg KOH/g is at least 250 mg KOH/g.

40. The method of any of paragraphs 33 to 39, wherein the sulfurized fatty acid ester comprises one or more sulfurized fatty acid methyl esters, preferably one or more of sulfurized lard oil and palm oil fatty acid methyl ester, and sulfurized rapeseed fatty acid methyl ester.

41. The method of any of paragraphs 33 to 40, wherein the sulfurized fatty acid ester is derived from sulfurized palm oil, corn oil, grapeseed oil, coconut oil, cottonseed oil, wheatgerm oil, soya oil, safflower oil, olive oil, peanut oil, rapeseed oil and sunflower oil, or an animal oil (e.g. glycerol ester or trans-esterification product) such as tallow oil or lard oil.

42. The method of any of paragraphs 33 to 41, wherein the functionalized olefin copolymer comprises an amine functionalized ethylene propylene copolymer having an Mn of 15,000 to 30,000 g/mol.

43. The method of any of paragraphs 34 to 42, where the lubricating oil composition has:

1) a sulfated ash (ASTM D874) content of 0.9 mass % or less;
2) a Mack T-11 final soot %@15 cSt (ASTM D7156-19) of 6.7% or more;
3) a total base number (ASTM D2896) of 5 to 30 mg KOH/g;
4) an HTCBT (ASTM D6594) copper level increase of 20 ppm or less;
5) a T-13 IR peak at end of test (ASTM D 8048) of 40 absorbance per cm or less; and
6) a Cam wear outlet (CEC OM646LA (CEC L-99-08)) of 45 μm or less.

44. The use of the lubricating oil composition of paragraphs 1 to 25 to lubricate an internal combustion engine.

This invention further relates to:

1A. A lubricating oil composition comprising or resulting from the admixing of:

a) 50 to 99 mass %, based upon the weight of the lubricating composition, of one or more base oils;
b) 0.1 to 15 mass %, based on total weight of the lubricating composition, of one or more functionalized olefin copolymer having an Mn of from 10,000 to about 35,000 g/mol;
c) 0.1 to 20 mass %, based on total weight of the lubricating composition, of one or more detergents wherein the detergent comprises at least one calcium detergent having a TBN of more than 100 mg KOH/g; at least one calcium detergent having a TBN of 100 mg KOH/g or less; and at least one magnesium detergent, where the difference in the TBN's for the Ca detergent having a TBN of 100 mg KOH/g or less and Ca detergent having a TBN of more than 100 mg KOH/g is at least 100 mg KOH/g;
d) 0.01 to 40 mass %, based on total weight of the lubricating composition, of one or more dispersants wherein the dispersants comprise at least one borated dispersant and at least one non borated dispersant;
e) 0.01 to 20 mass %, based upon the weight of the lubricating composition, of sulfurized fatty acid ester;
f) 0.01 to 10 mass %, based upon the weight of the lubricating composition, of molybdenum containing compound;
g) 0.01 to 10 mass %, based upon the weight of the lubricating composition, of one or more amine or phenol based antioxidants, and where the lubricating oil composition has:

1) a sulfated ash (ASTM D874) content of 0.9 mass % or less;
2) a Mack T-11 final soot %@15 cSt (ASTM D7156-19) of 6.7% or more;
3) a total base number (ASTM D2896) of 5 to 30 mg KOH/g;
4) an HTCBT (ASTM D6594) copper level increase of 20 ppm or less;
5) a T-13 IR peak at end of test (ASTM D 8048) of 40 absorbance per cm or less; and
6) a Cam wear outlet (CEC OM646LA (CEC L-99-08)) of 45 μm or less.

2A. The lubricating oil composition of paragraph 1A, wherein the lubricating oil composition further comprises one, two, three, four, five, or all six of:

i) 0.01 to 5 mass %, based on total weight of the lubricating composition, of one or more friction modifiers other than e) the sulfurized fatty acid ester and f) molybdenum containing compound;

ii) 0.001 to 10 mass %, based on total weight of the lubricating composition, of one or more anti-wear agents;

iii) 0.01 to 5 mass %, based on total weight of the lubricating composition, of one or more pour point depressants;

iv) 0.001 to 5 mass %, based on total weight of the lubricating composition, of one or more anti-foam agents;

v) 0.001 to 10 mass %, based on total weight of the lubricating composition, of one or more viscosity modifiers; and vi) 0.01 to 5 mass %, based on total weight of the lubricating composition, of one or more inhibitors and/or antirust agents.

3A. The lubricating oil composition of paragraph 1A, wherein the lubricating oil composition has:

1) a sulfated ash (ASTM D874) content of 0.85 mass % or less;

2) a Mack T-11 final soot %@15 cSt (ASTM D7156-19) of 7% or more;

3) a total base number (ASTM D2896) of 5 to 20 mg KOH/g;

4) an HTCBT (ASTM D6594) copper level increase of 10 ppm less;

5) aT-13 IR peak at end of test (ASTM D 8048) of 30 absorbance per cm or less; and 6) a Cam wear outlet (CEC OM646LA (CEC L-99-08)) of 35 μm or less.

4A. The lubricating oil composition of paragraph 1A, wherein the lubricating oil composition has:

a) an HTCBT (ASTM D6594) copper level increase of 10 ppm less;

b) aT-13 IR peak at end of test (ASTM D 8048) of 30 absorbance per cm or less; and c) a Cam wear outlet (CEC OM646LA (CEC L-99-08)) of 25 μm or less.

5A. The lubricating oil composition of paragraph 1A, wherein the lubricating oil composition further comprises 0.001 to 15 mass %, based upon the weight of the lubricating composition, of one or more $C_8$ to $C_{36}$ linear alpha olefins.

6A. The lubricating oil composition of paragraph 1A, wherein the lubricating oil composition further comprises 0.001 to 15 mass %, based upon the weight of the lubricating composition, of one or more polyisobutylene succinic anhydrides.

7A. The lubricating oil composition of paragraph 1A, wherein the lubricating oil composition further comprises 0.001 to 15 mass %, based upon the weight of the lubricating composition, of one or more zinc dialkyl dithiophosphates (ZDDP) which are optionally derived from primary alcohols, secondary alcohols or mixtures thereof.

8A. The lubricating oil composition of paragraph 1A, wherein the lubricating oil composition further comprises from 0.001 to 10 mass %, based upon the weight of the lubricating composition, of one or more Mo containing compound providing from 600-1500 ppm of molybdenum atoms to the lubricating oil composition.

9A. The lubricating oil composition of paragraph 1A, wherein the lubricating oil composition further comprises from 0.001 to 15 mass %, based upon the weight of the lubricating composition, of pour point depressant.

10A. The lubricating oil composition of paragraph 1, wherein the lubricating oil composition further comprises 0.001 to 15 mass %, based upon the weight of the lubricating composition, of pour point depressant selected from the group consisting of copolymers of dialkyl fumarate and vinyl acetate.

11A. The lubricating oil composition of paragraph 1A, wherein the lubricating oil composition further comprises from 0.01 to 10 mass %, based upon the weight of the lubricating composition, of one or more viscosity modifiers selected from polyacrylate, polymethacrylate, ethylene propylene copolymers, hydrogenated styrene-diene block copolymers, hydrogenated block copolymers of styrene and isoprene, hydrogenated block copolymers of styrene and isobutylene, hydrogenated polyisoprene star polymers and polyacrylates.

12A. The lubricating oil composition of paragraph 1A, wherein the lubricating oil composition further comprises from 0.001 to 15 mass %, based upon the weight of the lubricating composition, of hydrogenated styrene-diene block copolymer.

13A. The lubricating oil composition of paragraph 1A, wherein the dispersant comprises one or more borated PM SA-PAM dispersant and one or more non-borated PM SA-PAM dispersant.

14A. The lubricating oil composition of paragraph 1A, wherein the detergent comprises Ca alkyl salicylate having a TBN of 200 mg KOH/g or more; Ca alkyl salicylate having a TBN of 100 mg KOH/g or less; and Mg sulfonate detergent having a TBN of 250 mg KOH/g or more, where the difference in the TBN's for the Ca alkyl salicylate having a TBN of 100 mg KOH/g or less and Ca alkyl salicylate having a TBN of 200 mg KOH/g is at least 200 mg KOH/g.

15A. The lubricating oil composition of paragraph 1A, wherein the detergent comprises:

Ca alkyl salicylate having a TBN of more than 100 mg KOH/g;

Ca alkyl salicylate having a TBN of 100 mg KOH/g or less; and

Mg sulfonate detergent having a TBN of 250 mg KOH/g or more, where the difference in the TBN's for the Ca alkyl salicylate having a TBN of 100 mg KOH/g or less and Ca alkyl salicylate having a TBN of more than 100 mg KOH/g is at least 250 mg KOH/g.

16A. The lubricating oil composition of paragraph 1A, wherein the sulfurized fatty acid ester comprises one or more sulfurized fatty acid methyl esters.

17A. The lubricating oil composition of paragraph 1A, wherein the sulfurized fatty acid ester is derived from sulfurized palm oil, corn oil, grapeseed oil, coconut oil, cottonseed oil, wheatgerm oil, soya oil, safflower oil, olive oil, peanut oil, rapeseed oil and sunflower oil, or an animal oil (e.g. glycerol ester or trans-esterification product) such as tallow oil or lard oil.

18A. The lubricating oil composition of paragraph 1A, wherein the sulfurized fatty acid ester comprises one or more of sulfurized lard oil and palm oil fatty acid methyl ester, and sulfurized rapeseed fatty acid methyl ester.

19A. The lubricating oil composition of paragraph 1A, wherein the functionalized olefin copolymer comprises an amine functionalized ethylene propylene copolymer having an Mn of 15,000 to 30,000 g/mol.

20A. The lubricating composition according to paragraph 1A, wherein the lubricating composition is a heavy-duty diesel engine oil.

21A. The lubricating oil composition of paragraph 1A, wherein the lubricating oil composition has an HTCBT (ASTM D6594) copper level increase of 10 ppm less.

22A. The lubricating oil composition of paragraph 1A, wherein the lubricating oil composition has aT-13 IR peak at end of test (ASTM D 8048) of 30 absorbance per cm or less.

23A. The lubricating oil composition of paragraph 1A, wherein the lubricating oil composition has a Cam wear outlet (CEC OM646LA (CEC L-99-08)) of 25 μm or less.

24A. The lubricating oil composition of paragraph 1A, wherein the lubricating oil composition has aT-13 IR peak at end of test (ASTM D 8048) of 30 absorbance per cm or less and a Cam wear outlet (CEC OM646LA (CEC L-99-08)) of 25 μm or less.

25A. The lubricating oil composition of paragraph 1A, wherein the lubricating oil composition is identified by the viscometric descriptor 0W-16, 0W-20, 5W-20, 5W-30, 10W-30, or 10W-40.

26A. A method of lubricating an automotive internal combustion engine during operation of the engine comprising:

(i) providing to a crankcase of the automotive internal combustion engine an automotive crankcase the lubricating composition of any of paragraphs 1 to 25A;

(ii) providing a hydrocarbon fuel in the automotive internal combustion engine; and (iii) combusting the fuel in the automotive internal combustion engine.

27A. A method of lubricating an automotive internal combustion diesel engine during operation of the diesel engine comprising:

(i) providing to a crankcase of the automotive internal combustion diesel engine an automotive crankcase the lubricating composition of any of paragraphs 1 to 25A;

(ii) providing a hydrocarbon fuel in the automotive internal combustion diesel engine; and (iii) combusting the fuel in the automotive internal combustion diesel engine.

28A. A fuel composition comprising the composition of any of paragraphs 1 to 25A and a hydrocarbon fuel.

29A. The fuel composition of paragraph 28A wherein a portion of the fuel is derived from petroleum sources.

30A. The fuel composition of paragraph 28A wherein at least a portion of the fuel is derived from renewable sources.

31A. The fuel composition of paragraph 29A wherein at least a portion of the fuel is derived from biological sources and a portion of the fuel is derived from petroleum sources.

32A. A concentrate comprising or resulting from the admixing of:

a) from 1 to less than 50 mass % based upon the weight of the lubricating composition, of one or more base oils;

b) from 0.1 to 15 mass %, based on total weight of the lubricating composition, of one or more functionalized olefin copolymer having an Mn of from 10,000 to about 35,000 g/mol;

c) from 0.10 to 20 mass %, based on total weight of the lubricating composition, of one or more detergents wherein the detergent comprises at least one calcium detergent having a TBN of more than 100 mg KOH/g; at least one calcium detergent having a TBN of 100 mg KOH/g or less; and at least on magnesium detergent, where the difference in the TBN's for the Ca detergent having a TBN of 100 mg KOH/g or less and Ca detergent having a TBN of more than 100 mg KOH/g is at least 100 mg KOH/g;

d) from 0.01 to 40 mass %, based on total weight of the lubricating composition, of one or more dispersants wherein the dispersants comprise at least one borated dispersant and at least one non borated dispersant;

e) 0.01 to 20 mass % sulfurized fatty acid ester;

f) 0.01 to 25 mass %, based on total weight of the lubricating composition, of one or more amine or phenol based antioxidants; and g) 0.01 to 15 mass % molybdenum containing compound.

33A. A method to prepare a concentrate (such as the concentrate of paragraph 32A), comprising combining:

a) from 1 to less than 50 mass %, based upon the weight of concentrate, of one or more base oils;

b) from 0.1 to 15 mass %, based upon the weight of concentrate, of one or more functionalized olefin copolymer having an Mn of from 10,000 to about 35,000 g/mol;

c) from 0.10 to 20 mass %, based upon the weight of concentrate, of one or more detergents wherein the detergent comprises at least one calcium detergent having a TBN of more than 100 mg KOH/g; at least one calcium detergent having a TBN of 100 mg KOH/g or less; and at least on magnesium detergent, where the difference in the TBN's for the Ca detergent having a TBN of 100 mg KOH/g or less and Ca detergent having a TBN of more than 100 mg KOH/g is at least 100 mg KOH/g;

d) from 0.01 to 40 mass %, based upon the weight of concentrate, of one or more dispersants wherein the dispersants comprise at least one borated dispersant and at least one non borated dispersant;

e) 0.01 to 20 mass %, based upon the weight of concentrate, of sulfurized fatty acid ester;

f) 0.01 to 25 mass %, based upon the weight of concentrate, of one or more amine or phenol based antioxidants; and g) 0.01 to 15 mass %, based upon the weight of concentrate, of molybdenum containing compound.

34A. A method to prepare a lubricating oil composition (such as the lubricating oil composition of paragraphs 1A to 25A) comprising combining a) 50 to 99 mass %, based upon the weight of the lubricating composition, of one or more base oils;

b) 0.1 to 15 mass %, based on total weight of the lubricating composition, of one or more functionalized olefin copolymer having an Mn of from 10,000 to about 35,000 g/mol;

c) 0.1 to 20 mass %, based on total weight of the lubricating composition, of one or more detergents wherein the detergent comprises at least one calcium detergent having a TBN of more than 100 mg KOH/g; at least one calcium detergent having a TBN of 100 mg KOH/g or less; and at least one magnesium detergent, where the difference in the TBN's for the Ca detergent having a TBN of 100 mg KOH/g or less and Ca detergent having a TBN of more than 100 mg KOH/g is at least 100 mg KOH/g;

d) 0.01 to 40 mass %, based on total weight of the lubricating composition, of one or more dispersants wherein the dispersants comprise at least one borated dispersant and at least one non borated dispersant;

e) 0.01 to 20 mass %, based upon the weight of the lubricating composition, of sulfurized fatty acid ester;

f) 0.01 to 10 mass %, based upon the weight of the lubricating composition, of molybdenum containing compound;

g) 0.01 to 10 mass %, based upon the weight of the lubricating composition, of one or more amine or phenol based antioxidants.

35A. The method of paragraph 33A or 34A, comprising additionally combining, with components a), b), c), d), e), f), and g), with one, two, three, four, five, or all six of:

i) 0.01 to 5 mass %, based on total weight of the lubricating composition, of one or more friction modifiers other than e) the sulfurized fatty acid ester and f) molybdenum containing compound;

ii) 0.001 to 10 mass %, based on total weight of the lubricating composition, of one or more anti-wear agents;

iii) 0.01 to 5 mass %, based on total weight of the lubricating composition, of one or more pour point depressants;

iv) 0.001 to 5 mass %, based on total weight of the lubricating composition of one or more anti-foam agents;

v) 0.001 to 10 mass %, based on total weight of the lubricating composition, of one or more viscosity modifiers; and vi) 0.01 to 5 mass %, based on total weight of the lubricating composition, of one or more inhibitors and/or antirust agents.

36A. The method of paragraph 33A or 34A, comprising additionally combining, with components a), b), c), d), e), f), and g), with one, two, three, four, five, six or all seven of:

1) 0.001 to 15 mass %, based upon the weight of the lubricating composition, of one or more $C_8$ to $C_{36}$ linear alpha olefins;

2) 0.001 to 15 mass %, based upon the weight of the lubricating composition, of one or more polyisobutylene succinic anhydrides;

3) 0.001 to 15 mass %, based upon the weight of the lubricating composition, of one or more zinc dialkyl dithiophosphates (ZDDP) which are optionally derived from primary alcohols, secondary alcohols or mixtures thereof;

4) 0.001 to 10 mass %, based upon the weight of the lubricating composition, of one or more Mo containing compound providing from 600-1500 ppm of molybdenum atoms to the lubricating oil composition;

5) 0.001 to 15 mass %, based upon the weight of the lubricating composition, of pour point depressant, preferably selected from the group consisting of copolymers of dialkyl fumarate and vinyl acetate;

6) 0.01 to 10 mass %, based upon the weight of the lubricating composition, of one or more viscosity modifiers selected from polyacrylate, polymethacrylate, ethylene propylene copolymers, hydrogenated styrene-diene block copolymers, hydrogenated block copolymers of styrene and isoprene, hydrogenated block copolymers of styrene and isobutylene, hydrogenated polyisoprene star polymers and polyacrylates; and or 7) 0.001 to 15 mass %, based upon the weight of the lubricating composition, of hydrogenated styrene-diene block copolymer.

37A. The method of paragraph 34A, comprising additionally combining, with components a), b), c), d), e), f), and g), 0.001 to 15 mass %, based upon the weight of the lubricating composition, of one or more $C_8$ to $C_{36}$ linear alpha olefins.

38A. The method of paragraph 34A, comprising additionally combining, with components a), b), c), d), e), f), and g), 0.001 to 15 mass %, based upon the weight of the lubricating composition, of one or more polyisobutylene succinic anhydrides.

39A. The method of paragraph 34A, comprising additionally combining, with components a), b), c), d), e), f), and g), 0.001 to 15 mass %, based upon the weight of the lubricating composition, of one or more zinc dialkyl dithiophosphates (ZDDP) which are optionally derived from primary alcohols, secondary alcohols or mixtures thereof.

40A. The method of paragraph 34A comprising additionally combining, with components a), b), c), d), e), f), and g), 0.001 to 10 mass %, based upon the weight of the lubricating composition, of one or more Mo containing compound providing from 600-1500 ppm of molybdenum atoms to the lubricating oil composition.

41A. The method of paragraph 34A comprising additionally combining, with components a), b), c), d), e), f), and g), 0.001 to 15 mass %, based upon the weight of the lubricating composition, of pour point depressant.

42A. The method of paragraph 34A comprising additionally combining, with components a), b), c), d), e), f), and g), 0.001 to 15 mass %, based upon the weight of the lubricating composition, of pour point depressant selected from the group consisting of copolymers of dialkyl fumarate and vinyl acetate.

43A. The method of paragraph 34A comprising additionally combining, with components a), b), c), d), e), f), and g), 0.01 to 10 mass %, based upon the weight of the lubricating composition, of one or more viscosity modifiers selected from polyacrylate, polymethacrylate, ethylene propylene copolymers, hydrogenated styrene-diene block copolymers, hydrogenated block copolymers of styrene and isoprene, hydrogenated block copolymers of styrene and isobutylene, hydrogenated polyisoprene star polymers and polyacrylates.

44A. The method of paragraph 34A comprising additionally combining, with components a), b), c), d), e), f), and g), 0.001 to 15 mass %, based upon the weight of the lubricating composition, of hydrogenated styrene-diene block copolymer.

45A. The method of paragraph 33A or 34A comprising additionally combining, with components a), b), c), d), e), f), and g), one or more borated PIB SA-PAM dispersant and one or more non-borated PIBSA-PAM dispersant.

46A. The method of paragraph 33A or 34A, wherein the detergent comprises Ca alkyl salicylate having a TBN of 200 mg KOH/g or more; Ca alkyl salicylate having a TBN of 100 mg KOH/g or less; and Mg sulfonate detergent having a TBN of 250 mg KOH/g or more, where the difference in the TBN's for the Ca alkyl salicylate having a TBN of 100 mg KOH/g or less and Ca alkyl salicylate having a TBN of 200 mg KOH/g is at least 200 mg KOH/g.

47A. The method of paragraph 33A 34A, wherein the detergent comprises:

Ca alkyl salicylate having a TBN of more than 100 mg KOH/g;

Ca alkyl salicylate having a TBN of 100 mg KOH/g or less; and

Mg sulfonate detergent having a TBN of 250 mg KOH/g or more, where the difference in the TBN's for the Ca alkyl salicylate having a TBN of 100 mg KOH/g or less and Ca alkyl salicylate having a TBN of more than 100 mg KOH/g is at least 250 mg KOH/g.

48A. The method of paragraph 33A or 34A, wherein the sulfurized fatty acid ester comprises one or more sulfurized fatty acid methyl esters.

49A. The method of paragraph 33A or 34A, wherein the sulfurized fatty acid ester is derived from sulfurized palm oil, corn oil, grapeseed oil, coconut oil, cottonseed oil, wheatgerm oil, soya oil, safflower oil, olive oil, peanut oil, rapeseed oil and sunflower oil, or an animal oil (e.g. glycerol ester or trans-esterification product) such as tallow oil or lard oil.

50A. The method of paragraph 33A or 34A, wherein the sulfurized fatty acid ester comprises one or more of sulfurized lard oil and palm oil fatty acid methyl ester, and sulfurized rapeseed fatty acid methyl ester.

51A. The method of paragraph 33A or 34A, wherein the functionalized olefin copolymer comprises an amine functionalized ethylene propylene copolymer having an Mn of 15,000 to 30,000 g/mol.

52A. The use of the lubricating oil composition of paragraphs 1A to 24A to reduce Cam wear outlet (CEC OM646LA (CEC L-99-08)) to 45 μm or less, comprising lubricating an internal combustion engine with said lubricating oil composition.

The following non-limiting examples are provided to illustrate the disclosure.

EXPERIMENTAL

All molecular weights are number average unless otherwise noted.

Mn is number average molecular weight and is reported in g/mol.

A.I., a.i., or ai is active ingredient.

PIB is polyisobutylene.

PIBSA is polyisobutylene succinic anhydride.

PIBSA-PAM is polyisobutylene succinimide.

CEC is Coordinating European Council.

Testing Procedures

Total Base Number (TBN) is determined according to ASTM D2896 and reported in units of mg KOH/g.

KV100 is Kinematic viscosity measured at 100° C. according to ASTM D445-19a and is reported in cSt.

KV40 is Kinematic viscosity measured at 40° C. according to ASTM D445-19a and is reported in cSt.

Sulfated ash ("SASH") content is measured by ASTM D874.

Sulfur, Phosphorus, Boron, Calcium, Zinc, Molybdenum, and Magnesium content are measured by ASTM D5185.

Soot Level is determined via TGA (thermo-gravimetric analysis) according to ASTM D5967, unless otherwise indicated.

Mack T11 Test for Soot-Induced Viscosity Control, ASTM D7156-19 (Final soot % at 12 cSt, Final soot % at 15 cSt, Final soot % at 4 cSt) was conducted in a Mack E-TECH V-MAC III diesel engine with exhaust gas recirculation. Two, 30-minute oil flushes, followed by 252 hours at constant speed 1800 rpm. The fuel injection timing was adjusted to targets of soot level (TGA, ASTM D5967) at 96 hours, 192 hours, and 228 hours, specifically a TGA soot level of 2.75%+/−0.25% at 96 h, 5.50%+/−0.35% at 192 h, and 6.53%+/−0.44% at 228 h. Oil samples were taken every 12 hours to measure the soot level (TGA, ASTM D5967) and the kinematic viscosity at 100° C. The performance of the oil was determined by comparing the soot level at which a specified viscosity increase (4 cSt, 12 cSt and 15 cSt) is observed.

Mack T-12 Test (Avg. Liner Wear (μm), Avg, Top Ring Weight Loss (mg), Delta Pb 250-300 hr (ppm), End of test lead (ppm), Mack merits (T-10), Oil consumption (g/hr)), was conducted according to ASTM D7422 in a Mack ASET Engine with electronically controlled fuel injection, 2002 low-swirl cylinder heads and two modified configured dual-fitted turbochargers in series; a Variable Geometry Turbocharger (VGT) and a cooled Exhaust Gas Recirculation (EGR). This is an open-chamber, in-line six cylinder 12 L engine with lead-based bearings. Test Operation Run engine for 300 hours at two test conditions with ULSD (ultra-low sulfur diesel). The first 100 hours at 1800 RPM and rated power with 35% cooled EGR and retarded injection timing to generate 4.0-4.6% soot, then transition to 1200 RPM and peak torque (~2600 N·m), 15% cooled EGR, Oil Temperature at 116° C., and 3500 psi PCP (peak cylinder pressure) for 200 hours to evaluate oil consumption, piston rings, liners, and connecting rod bearings for wear. Mack T-13 Test was conducted according to ASTM D 8048, in a 2010 Volvo/Mack D13/MP8, 505BHP, 13L in-line six cylinder diesel engine with electronically controlled fuel injection, with six electronic unit injectors, VGT (variable geometry turbocharger), and cooled EGR (exhaust gas recirculation). Test Operation is a 360 hour test at 1500 RPM steady state conditions at a given fuel flow, producing approximately 2200 N·m and 130° C. oil temperature with 19-20% EGR to evaluate the oxidation stability performance of engine oils at an elevated oil temperature. Oxidative stability is measured at the end of the test (EOT) by infrared absorbance (IR) and reported in units of absorbance per centimeter).

HTCBT (High Temperature Corrosion Bench Test) is determined pursuant to ASTM D6594 and reported in units of ppm. In the HTCBT procedure, a 100 ml oil sample is heated for 168 hours at 135° C. with a 5 liter/hour air flow rate in the presence of suspended copper, lead, tin and phosphor bronze metal coupons. The change in concentration of copper metal (D Cu, ppm) between the new and aged oil is determined by method ASTM D5185 using an ICP-AES instrument.

Cam wear outlet is determined using the CEC OM646LA (CEC L-99-08) Test using a Daimler engine and is reported in units of μm. The CEC L-99-08 test for wear and cleanliness is conducted on a Mercedes Benz OM646 DE 22 LA light duty diesel engine. The engine is a 2.2-litre common-rail diesel engine rated at 110 kW with approximately 6.5-litres volume of engine oil. The main part of the test is a 300-hour alternating main run on the candidate oil. The engine has chain-driven, dual overhead camshafts with hydraulic tappets. To determine the outlet cam wear, the shape of each cam on the outlet camshaft is scanned by a measuring device such as a coordinate measuring machine. The outlet cam wear is the average of the maximum wear of each of the 8 cams in μm.

Engine sludge, avg., Piston cleanliness (avg. 4 pistons), Ring Sticking, and RL255 Piston Cleanliness were determined using the CEC L-104-16 OM646LA Bio-Diesel Test. The CEC L-104 test is conducted in Mercedes-Benz four cylinder, in line, light duty diesel engine. The test engine is identified as PE645 010 002 for the CEC L-104 test. The engine is a 2.2-litre common-rail diesel engine rated at 110 kW with approximately 6.5-litres volume of engine oil. The main test procedure is a 120-hour test on the candidate oil comprising a 3-hour cycle repeated 40 times. Every 8 cycles (24 hours), an oil drain and specified refill is performed in order to enforce a controlled "oil consumption" over the main test procedure. The test fuel is a B15 biodiesel blend. At the end of each 3-hour cycle, specified amounts of B100 biodiesel is dosed directly into the engine oil sump, during the 1000 rpm phase, to ensure that an appropriate FAME content is achieved. At the end of test, engine parts are rated for average Piston Cleanliness (Merits), Ring sticking (ASF value) and average engine sludge (Merits) according to method set out in Section 08 of the CEC L-104-16 test procedure. The piston cleanliness merits are compared with those obtained from the latest RL255 reference oil result.

L109 Oxidation 168 hr (reported in units of absorbance per centimeter) was determined using the CEC-L-109-14 Oxidation Test for Engine Oils Operating in the Presence of Biodiesel Fuel. The CEC L-109-14 is a blown air bench oxidation test where the oil sample is aged for 168 hours at a temperature of 150° C. with an air flow rate of 10 liters/hour in the presence of 7% B100 biodiesel (80% RME/20% SME) and 100 ppm $Fe^{III}$ catalyst. The oxidation of the aged oil at end of test is determined by the Infrared spectrometric method DIN 51453.

Bore polishing, Engine sludge, Oil consumption, and Piston cleanliness were determined using the CEC-L-101-09 Heavy Duty Diesel Engine Test (OM 501LA Test). The test is conducted in an OM 501 LA Euro 5 heavy-duty diesel engine. The engine is of V6 configuration with aluminum pistons and is of 11.9 liters in capacity. The engine has a specific output of 350 kW. The test procedure consists of both steady state and cyclic phases with a total duration of 300 hours. The test fuel contains 5% biodiesel. Engine parts are rated for average Piston Cleanliness (Merit), average Bore Polish (%) and average Engine Sludge (Merit) according to methods set out in Section 08 of the CEC L-101-09 test procedure.

Materials

| Component Table | |
|---|---|
| B-PIBSA-PAM-950 | Borated PIBSA-PAM dispersant (950 Mn PIB) in~50% oil) |
| PIBSA-PAM 1000 Mn | PIBSA-PAM dispersant (1000 Mn PIB) in~53% oil |
| PIBSA-PAM 2200 Mn | PIBSA-PAM dispersant (2200 Mn PIB) in~43% oil, ai~55) |
| Amine Funct EP Copol | amine functionalized ethylene propylene copolymer (~23,000 Mn, in~65% oil) |
| Ca Salicylate-350 TBN | Ca salicylate/PDMS Blend TBN 350 in~43 wt % oil/antifoamant |
| Mg sulfonate-400 TBN | Mg sulfonate detergent (400 TBN, n~43 wt % oil) |
| Ca salicylate-64 TBN | Ca alkyl salicylate (TBN~64, in~60 wt % oil) |
| ZDDP | ZDDP (derived from iso-octanol/2-butanol [15/85]), ai~75) |
| Mo Friction modifier | Trimeric MoDTC AO/FM (ai~45) |
| DPA antioxidant | Diphenyl amine Antioxidant |
| Phenol antioxidant | Hindered phenol Antioxidant |
| Sulfurized FAME | Sulfurized Lard Oil and Palm Oil Fatty Acid Methyl Ester |
| LAO | blend of $C_{14}$+ Linear Alpha Olefins |
| PIBSA | PIBSA (Mn 950, ai~72) |
| Anti-foamant | PDMS silicone anti-foamant |
| PIB- 950 Mn | Polyisobutylene having an Mn of 950 g/mol |
| lube oil flow improver (LOFI) | fumarate/vinyl acetate copolymer in oil |
| H-SIB block copol VM | Hydrogenated Styrene-Isoprene Butadiene Block Copolymer VM\LOFI blend (6.5/2.07) in Gp 3 oil (balance) |
| Star H-SD block copol VM | Hydrogenated styrene-diene block copolymer star viscosity modifier |
| Yubase 4 | Group III Basestock 4 cSt |
| Yubase 4+ | Group III+ Basestock 4 cSt |
| Yubase 6 | Group III Basestock 6 cSt |
| Priolube ™ 3970 | Group V ester base oil (trimethylpropane ester from $C_{8-10}$ fatty acids) Kv100 approx. 4.4 cSt from Croda International Chemical Co. |
| Purity ™ VHVI 4 | PetroCanada Group III base oil, Kv100 4 cSt, Viscosity Index 128 |
| Purity ™ VHVI 8 | PetroCanada Group III base oil, Kv100 8 cSt, Viscosity Index 128 |

Example 1

Oils A-2 to A-7 and Comparative Oils B-3 to B-8 were prepared and tested according to tests described above. The formulations are reported in FIG. 1. The test data are reported in FIG. 2.

Example 2

Oil A-8 was prepared and tested according to tests described above. The formulations as compared to comparative blend B-8 and test data are reported in the Table below and FIG. 3 (Dashed line is oil B-8, Solid line is oil A-8).

| Constituent | B-8 (wt %) | A-8 (wt %) |
|---|---|---|
| B- PIBSA-PAM-950 | 1.000 | 0.966 |
| PIBSA-PAM 1000 Mn | 2.851 | 2.500 |
| PIBSA-PAM 2200 Mn | 8.004 | 5.796 |
| Amine Funct EP Copol | | 1.381 |
| Ca Salicylate-350 TBN | 1.050 | 0.483 |
| Mg sulfonate-400 TBN | 1.000 | 0.966 |
| Ca salicylate -64 TBN | | 1.642 |
| ZDDP | 1.000 | 0.918 |
| Mo Friction modifier | 0.090 | 0.116 |
| DPA Antioxidant | 1.430 | 2.329 |
| Phenol antioxidant | 2.600 | |
| Sulfurized FAME | | 0.773 |
| LAO | | 0.580 |
| PIBSA | 0.600 | 0.194 |
| Anti-foamant | 0.002 | 0.002 |
| PIB- 950 Mn | 1.500 | |
| diluent | 1.172 | 1.154 |
| Additive Package Total (wt %) | 22.300 | 19.800 |
| Formulation | | |
| lube oil flow improver | | 0.20 |
| H-SIB block copol VM | 11.20 | |
| Star H-SD block copol VM | | 3.5 |

-continued

| Constituent | B-8 (wt %) | A-8 (wt %) |
|---|---|---|
| Yubase 4 | | 48.51 |
| Yubase 4+ | 56.10 | |
| Yubase 6 | 10.40 | 27.99 |
| Oil Total | 100 | 100 |
| Characterization | | |
| Salicylate (mmol) calculated | 4.095 | 9.087 |
| Sulfonate (mmol) calculated | 2.160 | 2.087 |

-continued

| Constituent | B-8 (wt %) | A-8 (wt %) |
|---|---|---|
| mmol Soap calculated | 6.255 | 11.174 |
| mass soap (mass %) calculated | 0.565 | 0.928 |
| ppm B calculated | 130 | 126 |
| mass % Ca calculated | 0.132 | 0.0982 |
| mass % Mg calculated | 0.092 | 0.088 |
| ppm Mo calculated | 50 | 64 |
| mass % N calculated | 0.216 | 0.220 |
| mass % P calculated | 0.080 | 0.073 |
| mass % S calculated | 0.211 | 0.280 |
| ppm Si calculated | 6 | 5 |
| mass % Zn calculated | 0.088 | 0.081 |
| T-13 IR peak at EOT Abs/cm | 54.1 | 28.9 |
| T-13 $KV_{40}$ increase @ 300-360 hrs (cSt) | 4.8 | 4.7 |
| OM 646LA-Cam wear outlet μm | 48.9 | 19.4 |
| Mack T-11-Final soot % @ 15 cSt | 6.71 | 7.48 |
| TBN (ASTM D2896) mg KOH/g | 12.4 | 13.0 |
| SASH wt % calculated | 0.95 | 0.82 |
| HTCBT-Cu change ppm | 23.6 | 8 |
| L109-Oxidation 168 Abs/cm | 36.4 | 31.4 |
| KV100 (cSt) | 12.12 | 9.49 |
| HTHS150 (cP) | 3.5 | 3.03 |

All documents described herein are incorporated by reference herein, including any priority documents and/or testing procedures, to the extent they are not inconsistent with this text. As is apparent from the foregoing general description and the specific embodiments, while forms of the invention have been illustrated and described, various modifications can be made without departing from the spirit and scope of the invention. Accordingly, it is not intended that the invention be limited thereby. The term "comprising" specifies the presence of stated features, steps, integers or components, but does not preclude the presence or addition of one or more other features, steps, integers, components or groups thereof. Likewise, the term "comprising" is considered synonymous with the term "including." Likewise, whenever a composition, an element, or a group of elements is preceded with the transitional phrase "comprising," it is understood that we also contemplate the same composition or group of elements with transitional phrases "consisting essentially of" "consisting of" "selected from the group of consisting of" or "is" preceding the recitation of the composition, element, or elements and vice versa.

What is claimed is:

1. A lubricating oil composition comprising or resulting from the admixing of:

a) 65 to 90 mass %, based upon the weight of the lubricating composition, of one or more base oils;

b) 1.0 to 3.0 mass %, based on total weight of the lubricating composition, of one or more amine functionalized ethylene propylene copolymer having an Mn of from 10,000 to about 35,000 g/mol;

c) 2.0 to 5.0 mass %, based on total weight of the lubricating composition, of one or more detergents wherein the detergent comprises at least one calcium detergent having a TBN of more than 300 mg KOH/g; at least one calcium detergent having a TBN of 70 mg KOH/g or less; and at least one magnesium detergent, where the difference in the TBN's for the Ca detergent having a TBN of 70 mg KOH/g or less and Ca detergent having a TBN of more than 300 mg KOH/g is at least 200 mg KOH/g;

d) 5.0 to 10.0 mass %, based on total weight of the lubricating composition, of one or more PIBSA-PAM dispersants wherein the PIBSA-PAM dispersants comprise at least one borated PIBSA-PAM dispersant and at least one non borated PIBSA-PAM dispersant;

e) 0.3 to 3.0 mass %, based upon the weight of the lubricating composition, of sulfurized fatty acid methyl ester;

f) 0.05 to 1.0 mass %, based upon the weight of the lubricating composition, of molybdenum containing compound comprising trimeric molybdenum dithiocarbamate;

g) 1.5 to 3.0 mass %, based upon the weight of the lubricating composition, of one or more amine or phenol based antioxidants, and where the lubricating oil composition has:

1) A sulfated ash (ASTM D874) content of 0.9 mass % or less;

2) A Mack T-11 final soot % @ 15 cSt (ASTM D7156-19) of 7.0% or more;

3) A total base number (ASTM D2896) of 5 to 30 mg KOH/g;

4) An HTCBT (ASTM D6594) copper level increase of 20 ppm or less;

5) a T-13 IR peak at end of test (ASTM D 8048) of 40 absorbance per cm or less; and 6) a Cam wear outlet (CEC OM646LA (CEC L-99-08)) of 45 μm or less.

2. The lubricating oil composition of claim 1, wherein the lubricating oil composition further comprises one, two, three, four, five, or all six of:

i) 0.01 to 5 mass %, based on total weight of the lubricating composition, of one or more friction modifiers other than e) the sulfurized fatty acid methyl ester and f) molybdenum containing compound comprising trimeric molybdenum dithiocarbamate;

ii) 0.15 to 3.0 mass %, based on total weight of the lubricating composition, of one or more ZDDP antiwear agents;

iii) 0.01 to 5 mass %, based on total weight of the lubricating composition, of one or more pour point depressants;

iv) 0.001 to 5 mass %, based on total weight of the lubricating composition, of one or more anti-foam agents;

v) 1.0 to 12.0 mass %, based on total weight of the lubricating composition, of one or more star hydrogenated styrene-isoprene butadiene block copolymer viscosity modifiers; and vi) 0.01 to 5 mass %, based on total weight of the lubricating composition, of one or more inhibitors and/or antirust agents.

3. The lubricating oil composition of claim 1, wherein the lubricating oil composition has:

1) A sulfated ash (ASTM D874) content of 0.85 mass % or less;

2) A Mack T-11 final soot % @ 15 cSt (ASTM D7156-19) of 7% or more;

3) A total base number (ASTM D2896) of 5 to 20 mg KOH/g;

4) An HTCBT (ASTM D6594) copper level increase of 10 ppm less;

5) aT-13 IR peak at end of test (ASTM D 8048) of 30 absorbance per cm or less; and 6) a Cam wear outlet (CEC OM646LA (CEC L-99-08)) of 35 μm or less.

4. The lubricating oil composition of claim 1, wherein the lubricating oil composition has:

a) an HTCBT (ASTM D6594) copper level increase of 10 ppm less;

b) a T-13 IR peak at end of test (ASTM D 8048) of 30 absorbance per cm or less; and c) a Cam wear outlet (CEC OM646LA (CEC L-99-08)) of 25 μm or less.

5. The lubricating oil composition of claim 1, wherein the lubricating oil composition further comprises: one, two, three, four, five, six or all seven of:

a) 0.25 to 2.0 mass %, based upon the weight of the lubricating composition, of one or more $C_8$ to $C_{36}$ linear alpha olefins;

b) 0.001 to 0.5 mass %, based upon the weight of the lubricating composition, of one or more polyisobutylene succinic anhydrides;

c) 0.25 to 2.0 mass %, based upon the weight of the lubricating composition, of one or more zinc dialkyl dithiophosphates (ZDDP) which are optionally derived from primary alcohols, secondary alcohols or mixtures thereof;

d) 0.05 to 1.0 mass %, based upon the weight of the lubricating composition, of one or more Mo containing compound comprising trimeric molybdenum dithiocarbamate providing from 600-1500 ppm of molybdenum atoms to the lubricating oil composition;

e) 0.001 to 15 mass %, based upon the weight of the lubricating composition, of pour point depressant, selected from the group consisting of copolymers of dialkyl fumarate and vinyl acetate;

f) 0.01 to 10 mass %, based upon the weight of the lubricating composition, of one or more viscosity modifiers selected from polyacrylate, polymethacrylate, ethylene propylene copolymers, hydrogenated styrene-diene block copolymers, hydrogenated block copolymers of styrene and isoprene, hydrogenated block copolymers of styrene and isobutylene, hydrogenated polyisoprene star polymers and polyacrylates; and or g) 1.0 to 12.0 mass %, based upon the weight of the lubricating composition, of star hydrogenated styrene-diene block copolymer.

6. The lubricating oil composition of claim 1, wherein the detergent comprises Ca alkyl salicylate having a TBN of 300 mg KOH/g or more; Ca alkyl salicylate having a TBN of 70 mg KOH/g or less; and Mg sulfonate detergent having a TBN of 250 mg KOH/g or more, where the difference in the TBN's for the Ca alkyl salicylate having a TBN of 70 mg KOH/g or less and Ca alkyl salicylate having a TBN of 300 mg KOH/g or more is at least 200 mg KOH/g.

7. The lubricating oil composition of claim 1, wherein the detergent comprises:

Ca alkyl salicylate having a TBN of more than 300 mg KOH/g;

Ca alkyl salicylate having a TBN of 70 mg KOH/g or less; and

Mg sulfonate detergent having a TBN of 250 mg KOH/g or more, where the difference in the TBN's for the Ca alkyl salicylate having a TBN of 70 mg KOH/g or less and Ca alkyl salicylate having a TBN of more than 300 mg KOH/g is at least 250 mg KOH/g.

8. The lubricating oil composition of claim 1, wherein the sulfurized fatty acid methyl ester is selected from the group consisting of sulfurized lard oil fatty acid methyl ester, palm oil fatty acid methyl ester, and sulfurized rapeseed fatty acid methyl ester.

9. The lubricating oil composition of claim 1, wherein the sulfurized fatty acid methyl ester is derived from sulfurized palm oil, corn oil, grapeseed oil, coconut oil, cottonseed oil, wheatgerm oil, soya oil, safflower oil, olive oil, peanut oil, rapeseed oil sunflower oil, and an animal oil.

10. The lubricating oil composition of claim 1, wherein the amine functionalized ethylene propylene copolymer has an Mn of 15,000 to 30,000 g/mol.

11. The lubricating composition claim 1, wherein the lubricating oil composition is a diesel engine oil, or a light duty diesel engine oil and or a heavy-duty diesel engine oil.

12. The lubricating oil composition of claim 1, wherein the lubricating oil composition is identified by the viscometric descriptor 0W-16, 0W-20, 5W-20, 5W-30, 10W-30, or 10W-40.

13. The lubricating oil composition of claim 1, wherein the lubricating oil composition has a sulfur content of 0.3 or less, based upon the weight of the lubricating composition.

14. A method of lubricating an automotive internal combustion engine during operation of the engine comprising:

(i) providing to a crankcase of the automotive internal combustion engine an automotive crankcase the lubricating composition of claim 1;

(ii) providing a hydrocarbon fuel in the automotive internal combustion engine; and (iii) combusting the fuel in the automotive internal combustion engine.

15. A fuel composition comprising the composition of claim 1 and a hydrocarbon fuel selected from the group consisting of petroleum sources, renewable sources and combinations thereof.

16. The fuel composition of claim 15 wherein at least a portion of the fuel is derived from biological sources and a portion of the fuel is derived from petroleum sources.

17. A concentrate comprising or resulting from the admixing of:

a) from 1 to less than 50 mass %, based upon the concentrate composition, of one or more base oils;

b) from 0.1 to 15 mass %, based upon the concentrate composition, of one or more amine functionalized ethylene propylene copolymer having an Mn of from 10,000 to about 35,000 g/mol;

c) from 0.10 to 20 mass %, based upon the concentrate composition, of one or more detergents wherein the detergent comprises at least one calcium detergent having a TBN of more than 300 mg KOH/g; at least one calcium detergent having a TBN of 70 mg KOH/g or less; and at least on magnesium detergent, where the difference in the TBN's for the Ca detergent having a TBN of 70 mg KOH/g or less and Ca detergent having a TBN of more than 300 mg KOH/g is at least 200 mg KOH/g;

d) from 0.01 to 40 mass %, based upon the concentrate composition, of one or more PIBSA-PAM dispersants wherein the PIBSA-PAM dispersants comprise at least one borated PIBSA-PAM dispersant and at least one non borated PIBSA-PAM dispersant;

e) 0.01 to 20 mass %, based upon the concentrate composition, of sulfurized fatty acid methyl ester;

f) 0.01 to 25 mass %, based on total weight of the lubricating composition, of one or more amine or phenol based antioxidants; and g) 0.01 to 15 mass %, based upon the concentrate composition, of molybdenum containing compound comprising trimeric molybdenum dithiocarbamate.

18. A method of lubricating an automotive internal combustion engine comprising:

(i) providing to a crankcase of the automotive internal combustion engine an automotive crankcase the lubricating composition of claim 1;

(ii) providing a fuel in the automotive internal combustion engine; and (iii) combusting the fuel in the automotive internal combustion engine.

19. A method to prepare a lubricating oil composition comprising combining:

a) 65 to 90 mass %, based upon the weight of the lubricating composition, of one or more base oils;

b) 1.0 to 3.0 mass %, based on total weight of the lubricating composition, of one or more amine functionalized olefin ethylene propylene copolymer having an Mn of from 10,000 to about 35,000 g/mol;

c) 2.0 to 5.0 mass %, based on total weight of the lubricating composition, of one or more detergents wherein the detergent comprises at least one calcium detergent having a TBN of more than 300 mg KOH/g; at least one calcium detergent having a TBN of 70 mg KOH/g or less; and at least one magnesium detergent, where the difference in the TBN's for the Ca detergent having a TBN of 70 mg KOH/g or less and Ca detergent having a TBN of more than 300 mg KOH/g is at least 200 mg KOH/g;

d) 5.0 to 10.0 mass %, based on total weight of the lubricating composition, of one or more PIBSA-PAM dispersants wherein the PIBSA-PAM dispersants comprise at least one borated PIBSA-PAM dispersant and at least one non borated PIBSA-PAM dispersant;

e) 0.3 to 3.0 mass %, based upon the weight of the lubricating composition, of sulfurized fatty acid methyl ester;

f) 0.05 to 1.0 mass %, based upon the weight of the lubricating composition, of molybdenum containing compound comprising trimeric molybdenum dithiocarbamate; and g) 1.5 to 3.0 mass %, based upon the weight of the lubricating composition, of one or more amine or phenol based antioxidants.

20. The method of claim 19, where the lubricating oil composition has:

1) A sulfated ash (ASTM D874) content of 0.9 mass % or less;

2) A Mack T-11 final soot % @ 15 cSt (ASTM D7156-19) of 7.0% or more;

3) A total base number (ASTM D2896) of 5 to 30 mg KOH/g;

4) An HTCBT (ASTM D6594) copper level increase of 20 ppm or less;

5) a T-13 IR peak at end of test (ASTM D 8048) of 40 absorbance per cm or less; and 6) a Cam wear outlet (CEC OM646LA (CEC L-99-08)) of 45 μm or less.

21. The lubricating oil composition of claim 1, wherein the lubricating oil composition is absent added copper.

* * * * *